US008555548B2

(12) United States Patent
Carter

(10) Patent No.: US 8,555,548 B2
(45) Date of Patent: Oct. 15, 2013

(54) MODULAR WINDOW OPERATING SYSTEM

(76) Inventor: Gregory George Carter, Waterloo (CA)

( * ) Notice: Subject to any disclaimer, the term of this patent is extended or adjusted under 35 U.S.C. 154(b) by 263 days.

(21) Appl. No.: 12/615,062

(22) Filed: Nov. 9, 2009

(65) Prior Publication Data

US 2010/0115846 A1 May 13, 2010

Related U.S. Application Data

(60) Provisional application No. 61/112,506, filed on Nov. 7, 2008.

(51) Int. Cl.
*E05D 15/28* (2006.01)

(52) U.S. Cl.
USPC ..... 49/249; 49/246; 49/248; 49/250; 49/252; 49/260

(58) Field of Classification Search
USPC ..... 49/246–252, 260, 261; 74/543–547, 74/528, 523
See application file for complete search history.

(56) References Cited

U.S. PATENT DOCUMENTS

| | | | | |
|---|---|---|---|---|
| 2,366,613 | A * | 1/1945 | Hagstrom | 49/252 |
| 3,032,330 | A * | 5/1962 | Stavenau | 49/249 |
| 3,145,021 | A * | 8/1964 | Anderson | 49/246 |
| 4,679,352 | A * | 7/1987 | Bates | 49/192 |
| 4,887,392 | A * | 12/1989 | Lense | 49/300 |
| 4,937,976 | A * | 7/1990 | Tucker et al. | 49/345 |
| 6,135,511 | A * | 10/2000 | Smith et al. | 292/156 |
| 6,269,521 | B1 * | 8/2001 | Gabel | 16/287 |
| 7,013,604 | B1 * | 3/2006 | Moody et al. | 49/341 |
| 7,066,505 | B2 * | 6/2006 | Van Klompenburg et al. | 292/336.3 |
| 2003/0110701 | A1 * | 6/2003 | Dawson | 49/246 |
| 2006/0144103 | A1 * | 7/2006 | Blanch | 70/330 |
| 2007/0230201 | A1 * | 10/2007 | Oba et al. | 362/501 |

* cited by examiner

*Primary Examiner* — Katherine Mitchell
*Assistant Examiner* — Marcus Menezes
(74) *Attorney, Agent, or Firm* — Daryl W. Schnurr

(57) ABSTRACT

A window operating system for casement and awning windows has two actuators that are connected to be controlled by one crank to operate simultaneously. The system is modular and the crank is preferably part of a crank assembly that is a separate component from the actuators. In a further embodiment, the operating system has at least one actuator with a crank assembly to operate the actuator being located at a different location on a window frame from the actuator. With a modular system, there are numerous variations for location and number of locks and the location of the crank assembly as well as other components. The system still further describes a lock for a window operating system.

15 Claims, 57 Drawing Sheets

FIGURE 62
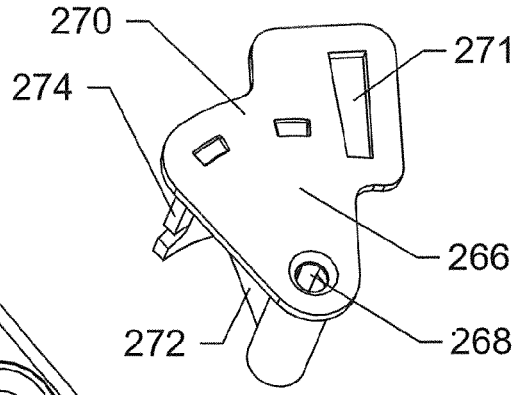
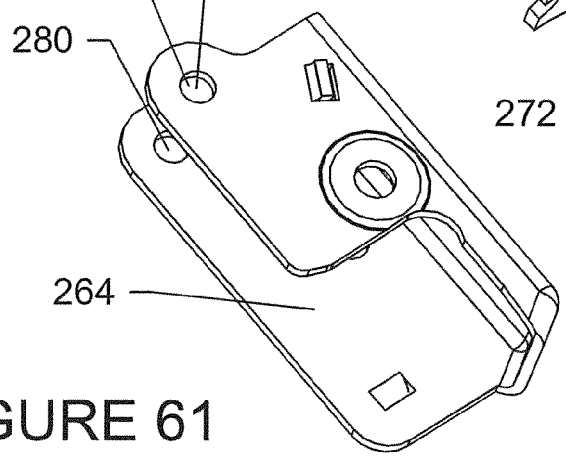
FIGURE 61
FIGURE 60
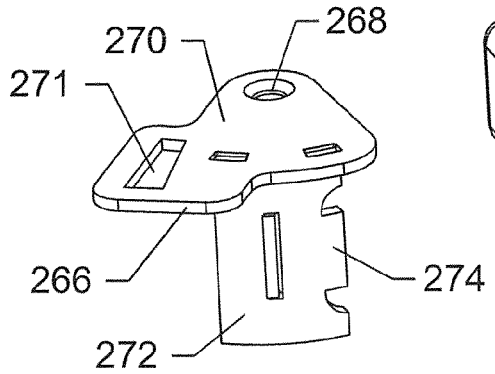
FIGURE 59
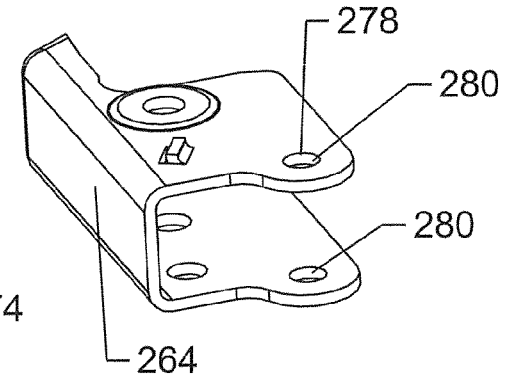

FIGURE 64
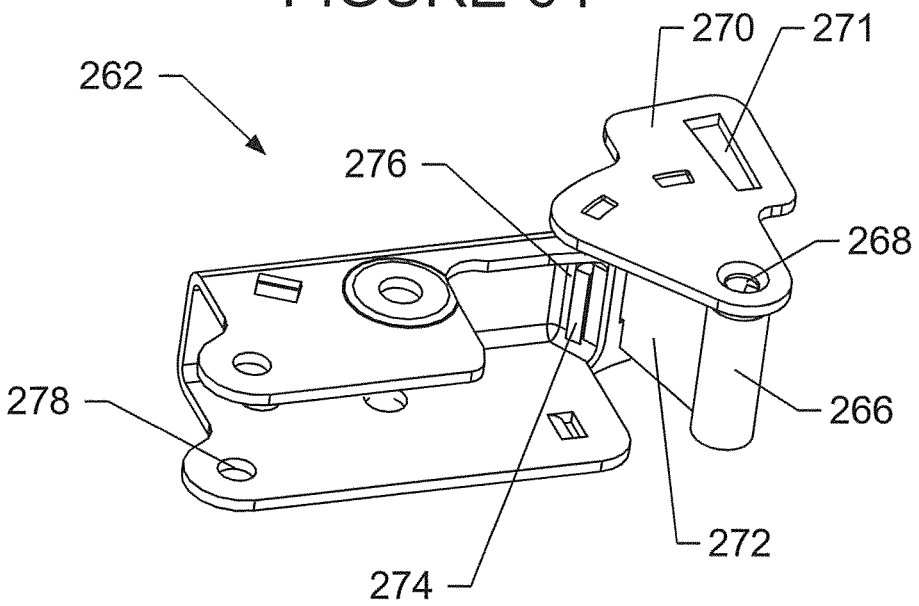
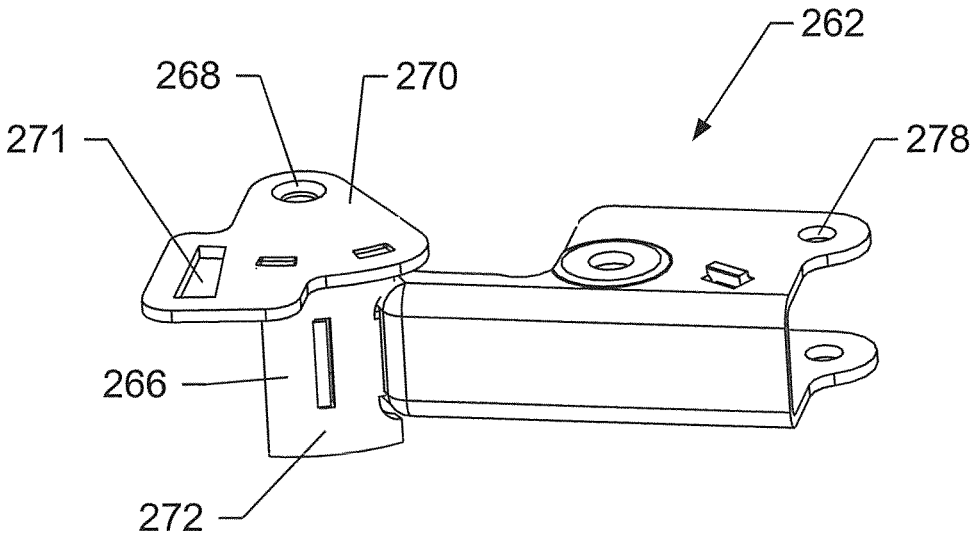
FIGURE 63

MODULAR WINDOW OPERATING SYSTEM

Applicant claims the benefit of United States Provisional Application Serial Number 61/112,506 filed Nov. 7, 2008.

BACKGROUND OF THE INVENTION

1. Field of the Invention

This invention relates to a window operating system for casement or awning windows. The operating system has two actuators that are connected to be controlled by one crank to operate simultaneously. In a further embodiment, the operating system has at least one actuator with a crank assembly to operate the actuator being located at a different location on a window frame from the actuator.

2. Description of the Prior Art

Window operators are known for casement windows and awning windows. Previous operators have a crank thereon and there is only one operator used on each window. Previous operators have been used in conjunction with locks whereby the lock is unlocked or locked by rotating the crank and the same crank is used to open and close the window.

The Tucker U.S. Pat. No. 5,152,103 describes an automatic window sash and lock operator whereby the window is unlocked, opened, closed and locked by rotating the crank on the operator. The Vetter U.S. Pat. No. 6,128,858 describes a window operator with a locking worm drive system. Both the window operator described in the Tucker patent and the window operator described in the Vetter patent have a hinge located at the top and bottom of the window in addition to the operator located at the bottom of the window. The previous window operators that unlock, open, close and lock the window did not operate sufficiently well to achieve commercial success.

Typically, a casement window or an awning window has two hinges. With a casement window, the hinges are typically located at the top and bottom of the window. With an awning window, the hinges are typically located on the two vertical sides of the window. In addition to the two hinges, both the casement window and awning window typically have an operator with a crank thereon to open and close the window. A casement window usually has at least one single point lock thereon or a multipoint lock. Awning windows usually have two single point locks, one lock being located on each vertical side of the frame. Many sashes, particularly in large windows are not sufficiently strong laterally to retain their shape. When a sash is closed against a frame using a single operator located at a bottom of the frame, even though the sash is closed at the bottom it can still be open at the top. When the multipoint lock is moved to the locked position, the bottom portion of the sash is locked, but there is a gap between the sash and the frame in the top portion.

In this application, an actuator is defined as a device for opening and closing casement or awning windows by turning a crank that is located on the actuator itself or is located apart from the actuator but is connected to operate the actuator. An operator is defined as an actuator with a crank located thereon.

SUMMARY OF THE INVENTION

It is an object of the present invention to provide a casement window or an awning window with at least one actuator, the actuator replacing a hinge between a sash and a window frame on the side of the frame where the actuator is located. Preferably, a window in accordance with the present invention has two actuators, one actuator being located on each side of a window frame, the actuators also functioning as hinges.

The actuators of the present invention are designed to function as a hinge and as an actuator with a single crank assembly located on the window frame to open and close the window. It is still a further object of the present invention to provide a window operating system having modular components that can be located at least partially or completely around a window frame, the modules being at least one actuator and preferable two actuators that are operated by a crank assembly having a single crank. Preferably, the window operating system has at least one lock that is synchronized and connected into the operating system to be operated by the single crank whereby the window lock is operated by the crank of the crank assembly to commence opening when the sash is desired to be opened relative to the frame. The window operating system can have more than one lock and can have locks on each side of the frame, if desired.

A window operating system is used with casement and awning windows, the windows having a frame and a sash. The system comprises two actuators that are located on opposing sides of the frame directly opposite to one another. The system has a crank, the crank being connected to control movement of the actuators simultaneously. The crank is rotatable in one direction to open the sash relative to the frame and is rotatable in opposite direction to close the sash relative to the frame.

A window operating system is used with casement and awning windows, the windows having a frame and a sash. The sash is movable between a closed position and an open position, the system comprising at least one actuator located on one side of the frame to open and close the sash. The actuator functions as a hinge as well as an actuator. A hinged support is located on the frame on a side opposite the actuator. A crank assembly is mounted on the frame, the crank assembly having a crank extending therefrom on an inner side of the frame. The crank assembly is located on the frame at a different location from the actuator. The crank is rotatable in one direction to operate the actuator to open the sash and in an opposite direction to operate the actuator to close the sash.

BRIEF DESCRIPTION OF THE DRAWINGS

FIG. 59 is a perspective view of a release bracket;

FIG. 60 is a perspective view of a release pivot;

FIG. 61 is a perspective view of the release bracket shown in FIG. 59;

FIG. 62 is a perspective view of the release pivot from a different angle;

FIG. 63 is a perspective view of the release bracket and the release pivot engaged with one another;

FIG. 64 is a perspective view of the release bracket and the release pivot when viewed from a different angle;

DETAILED DESCRIPTION OF A PREFERRED EMBODIMENT

Figure 1:
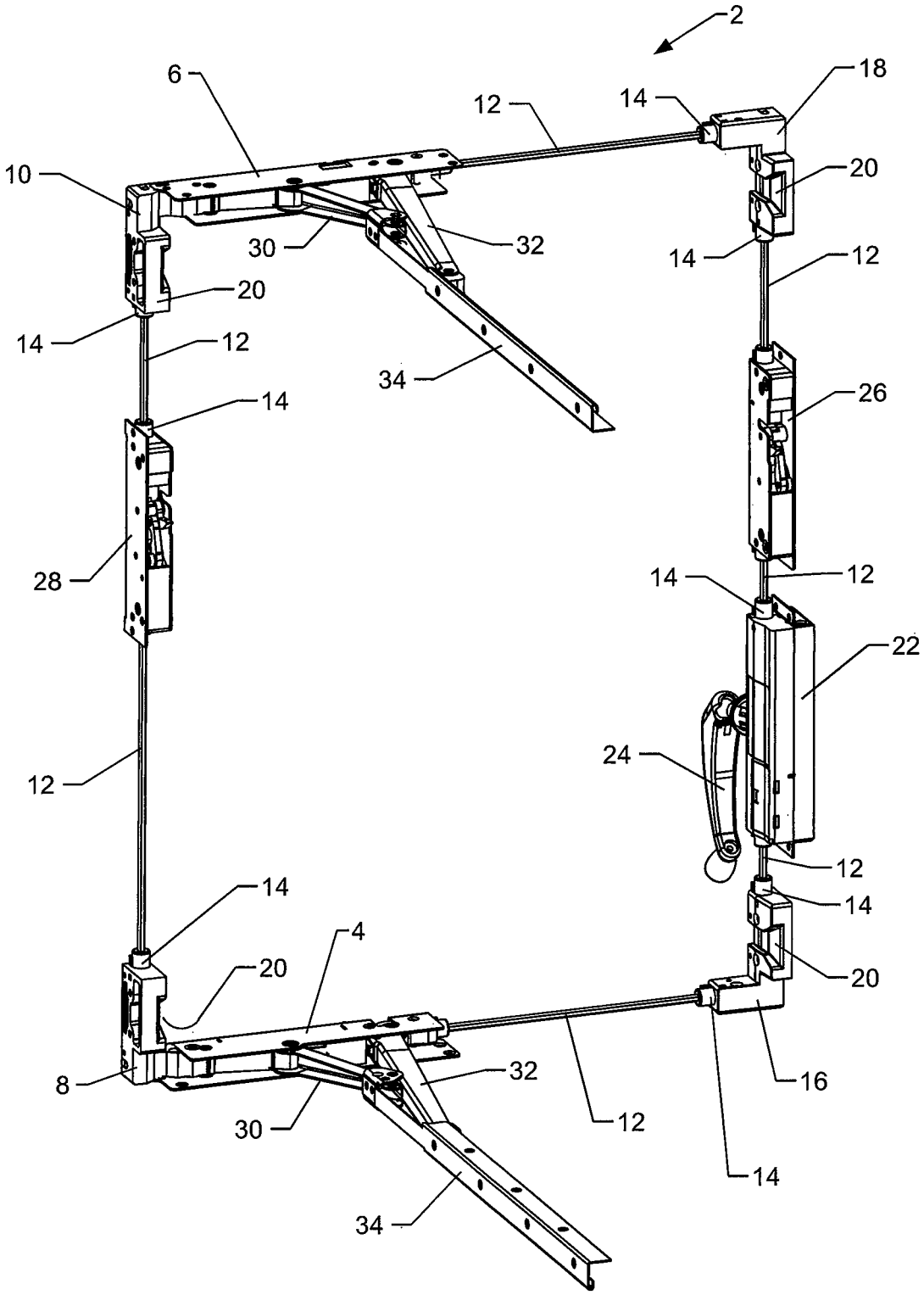
FIG. 1 is a schematic perspective view of one embodiment of a window operating system.

In FIG. 1, there is shown a schematic perspective view of one embodiment of a window operating system 2 for use with a casement window or awning window (not shown). The orientation of the system 2 shown in FIG. 1 is for a casement window (not shown). For an awning window (not shown), the orientation of the system 2 shown in FIG. 1 is rotated clockwise by ninety degrees. The operating system 2 is viewed from outside the window (not shown). The system comprises two actuators 4, 6, the actuators being mirror images of one another. The actuator 4 is the lower actuator and the actuator 6 is the upper actuator in the system 2. The actuators 4, 6 are directly opposite to one another and are connected into the system 2 to operate in synchronization with one another. The actuator 4 is connected directly to a first corner transfer 8 and the actuator 6 is directly connected to a second corner transfer 10. The corner transfers 8, 10 are mirror images of one another. The actuator 4 is connected through a connecting rod 12 and collars 14 through a third corner transfer 16. The actuator 6 is connected through the connecting rod 12 and collar 14 at the top of the system 2 to a fourth corner transfer 18. The corner transfers 16, 18 are mirror images of one another and each of the corner transfers 8, 10, 16, 18 has a channel 20 therein for receiving corresponding guides (not shown in FIG. 1) on a sash (not shown in FIG. 1) of the window (not shown in FIG. 1). The channels 20 are wider at an outer end and taper inward toward an inner end.

A crank assembly 22 having a crank 24 is connected by the connecting rod 12 and collars 14 to the third corner transfer 16. A lock 26 is connected by the connecting rod 12 and collars 14 to the crank assembly 22. The connecting rod 12 and collars 14 connect the lock 26 to the fourth corner transfer 18. A second lock 28 is connected between the first corner transfer 8 and second corner transfer 10 by connecting rods 12 and collars 14. When a connecting rod is used for the connection between two components, there is a collar 14 located at each end of the connecting rod to hold the connecting rod in place in each component. Some of the collars 14 in FIG. 1 are hidden by the component. The lock 26 on the right hand side of the system is a mirror image of the lock 28 on the left hand side of the system 2. The actuators 4, 6 each have a short arm 30 and a long arm 32 connected to a support 34. The sash (not shown in FIG. 1) is connected to the support 34. The same reference numerals are used for all of the connecting rods 12 regardless of their length. Since the window system is modular, the number and location of the components within the system can be varied as desired. The system 2 extends completely around the frame (not shown in FIG. 1).

Preferably, the system is designed so that when the crank is turned clockwise (when viewed from inside the window), the window closes and when the crank is turned counterclockwise the window opens. In the position of the support 34 and arms 30, 32 of the actuators 4, 6 shown in FIG. 1, the sash (not shown in FIG. 1) is in the fully open position substantially perpendicular to the frame. The actuators 4, 6 and the locks 26, 28 are synchronized with one another so that as the crank is turned clockwise, when viewed from inside the window, the actuators close the sash into the frame (not shown in FIG. 1) and the locks begin to lock when the sash approaches the fully closed position (not shown in FIG. 1) and continue to lock as the crank is continued to be rotated in the clockwise direction after the sash has reached the fully closed position, the window locks pulling the sash closer into the frame and compressing the seals (not shown) between the sash and the frame. When the window is desired to be opened, the crank is turned in the counterclockwise direction, the window locks begin to open first and become fully open as the sash moves out of contact with the frame. The crank assembly causes all of the rods 12 and the direct connectors to rotate in the same direction around the entire path of the window system 2. The direct connectors are connections directly between two components without the use of a rod between the components. The components are designed to operate appropriately based on the direction of rotation of the rods 12 and the direct connectors. As with the actuator 4 and corner transfer 8 and the actuator 6 and corner transfer 10, the components can be directly connected to each other, without the use of a connecting rod. While it is preferred that the system extend completely around the frame, a system can be designed to extend only partially around the frame. Since the system is modular, components can be added to the system 2 or removed from the system 2 as desired. For example, in FIG. 1, additional window locks can be added to the system or one or both of the window locks can be removed. If the system has no window locks, the actuators will hold the sash in the fully closed position within the frame. Also, the crank assembly can be located in any convenient location within the path. For example, the crank can be located at the bottom of the frame, on either side of the frame, or at the top of the frame. Only one crank assembly is required to operate all of the components within the system.

While it is preferable that the crank assembly be a separate modular component in the system, an operating system with two actuators can have the crank assembly located in one of the actuators. The two actuators can then be operated simultaneously by the single crank in one of the actuators. Any locks or other components can also be operated by the single crank.

As a further variation of the system 2, the system can have only one actuator rather than two actuators. When only one actuator is used in the system, a supporting hinge must be utilized directly opposite to the one actuator to support and move the sash in synchronization with the one actuator. Two actuators are preferred, particularly with large windows. When only one actuator is used, (usually at the bottom of the frame), the sash can bend slightly at the top of the frame and the window can be closed at the bottom but can still be open at the top. With two actuators, both the top and the bottom of the sash are controlled to being in complete synchronization and the upper actuator prevents the sash from bending relative to the lower actuator. The actuators 4, 6 function as hinges to support the sash on the frame as well as functioning actuators.

While the window system 2 is orientated in FIG. 1 to be a casement window, the identical system or a similar system can be used for an awning window with the lock 28 at the top and the crank assembly 22 and lock 26 at the bottom of the path.

Figure 2:
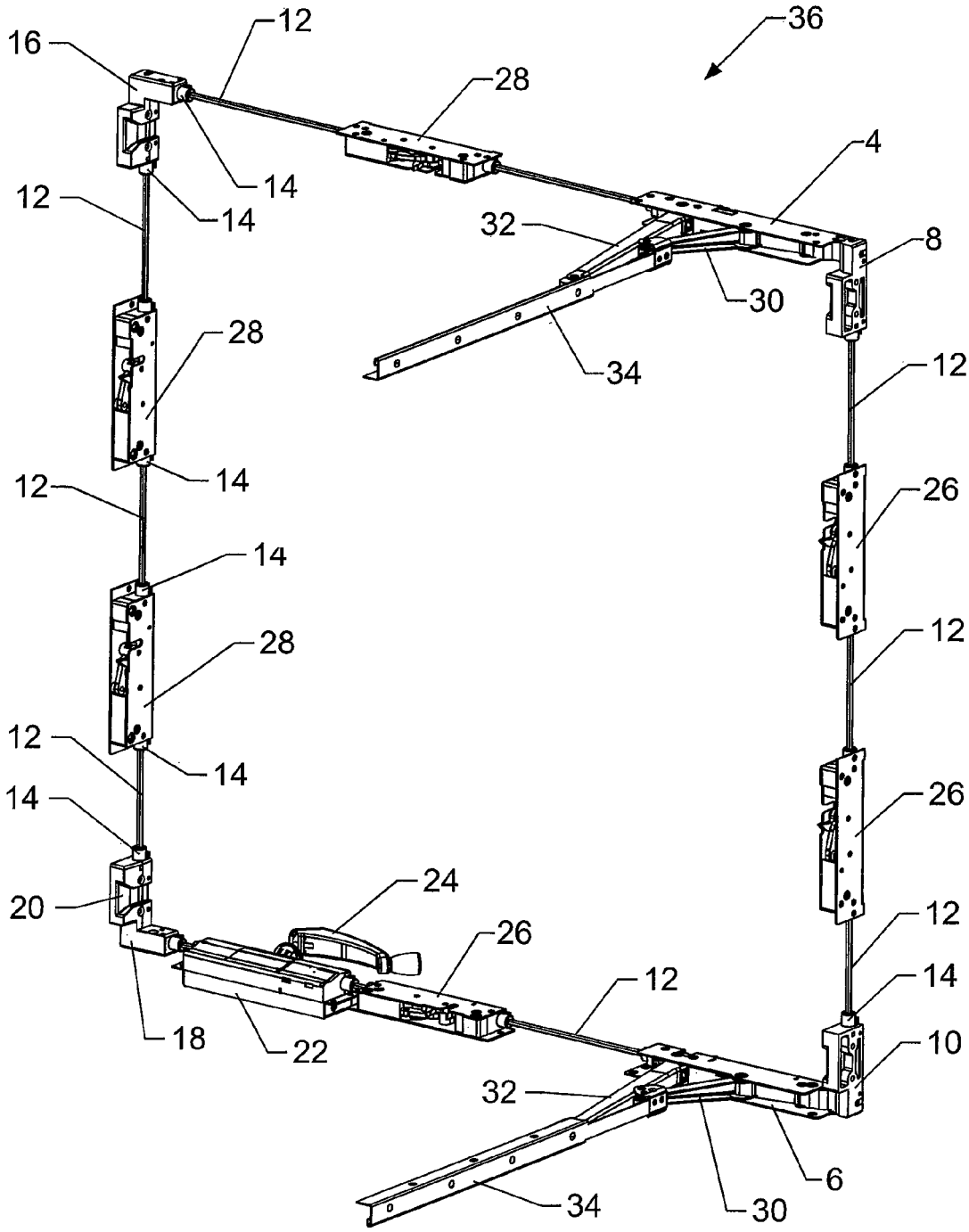
FIG. 2 is a schematic perspective view of another embodiment of a window operating system.
Figure 4:
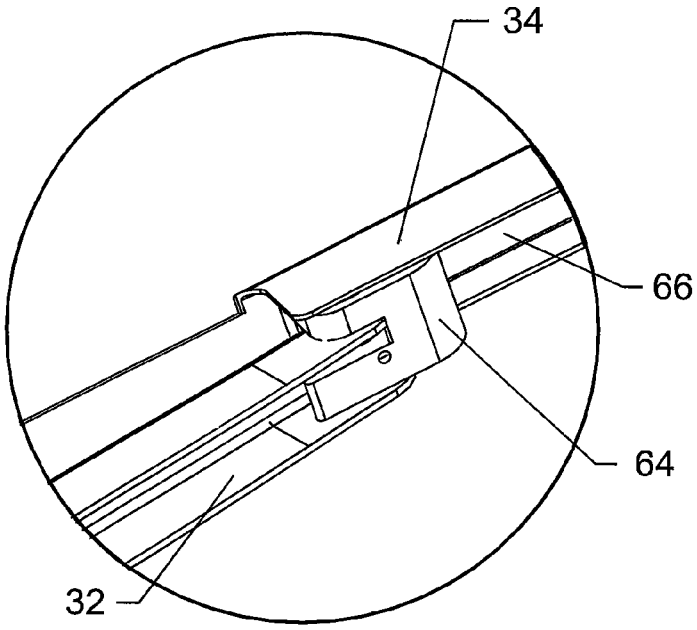
FIG. 4 is a partial perspective view of a connection between a long arm of the actuator and a support for the sash.

In FIG. 2, there is shown a further embodiment of a window system 36 and the same reference numerals are used in FIG. 2 as those used in FIG. 1 for those components that are identical. The sash (not shown) opens and closes in the opposite direction to the system 2 in that the actuators 4, 6 are located on the right hand side of the path when viewed from outside of the window (not shown) compared to the actuators in FIG. 1. The actuator 6 is the lower actuator in the system 36 and the actuator 4 is the upper actuator. The corner transfer components 8, 10, 16, 18 are also reversed. The crank assembly is located at the bottom of the window (not shown) and the window has six locks 26, 28, two on each side, one on the top and one at the bottom of the path. The corner transfer 8 at the upper right of the path of the system 36 is connected directly to the actuator 4 and the corner transfer 10 at the lower right of the path is connected directly to the actuator 6. In both FIG. 1 and FIG. 2, the crank 24 is in a folded inoperable position. The advantage of having six locks is greater security and a tighter fit against the seals (not shown) making the window more air tight. As with the embodiment 2 as shown in FIG. 1, the embodiment 36 can be varied by adding more locks or removing one or more locks or by changing the location of the various components. The embodiment 36 is oriented to be used as a casement window, but can be used as an awning window by changing the orientation by rotating the embodiment counterclockwise by ninety degrees. The actuators 4, 6 are shown in the fully open position. The system 36 completely surrounds the frame (not shown in FIG. 2)

It can be seen from FIGS. 1 and 2, that a sash connected to the supports 34 would be substantially perpendicular to the frame (not shown), which would correspond with the path though the various components. It can also be seen that the sash has moved away from the right hand side of the frame (not shown) in the fully open position, which allows the glass (not shown) and the sash to be cleaned on both sides from the inside of the building (not shown) in which the window is installed. The crank 24 controls the locks and actuators to unlock, open, close and lock the window and to operate all the components in the path. While the systems 2, 36 completely surround the frame, systems can be constructed in accordance with the present invention to extend only partially around the frame. Systems that extend completely around the frame are preferred. The actuators, locks, crank assemblies and corner transfers are individual modules that are connected to be operated by rotating the crank.

Figure 3:
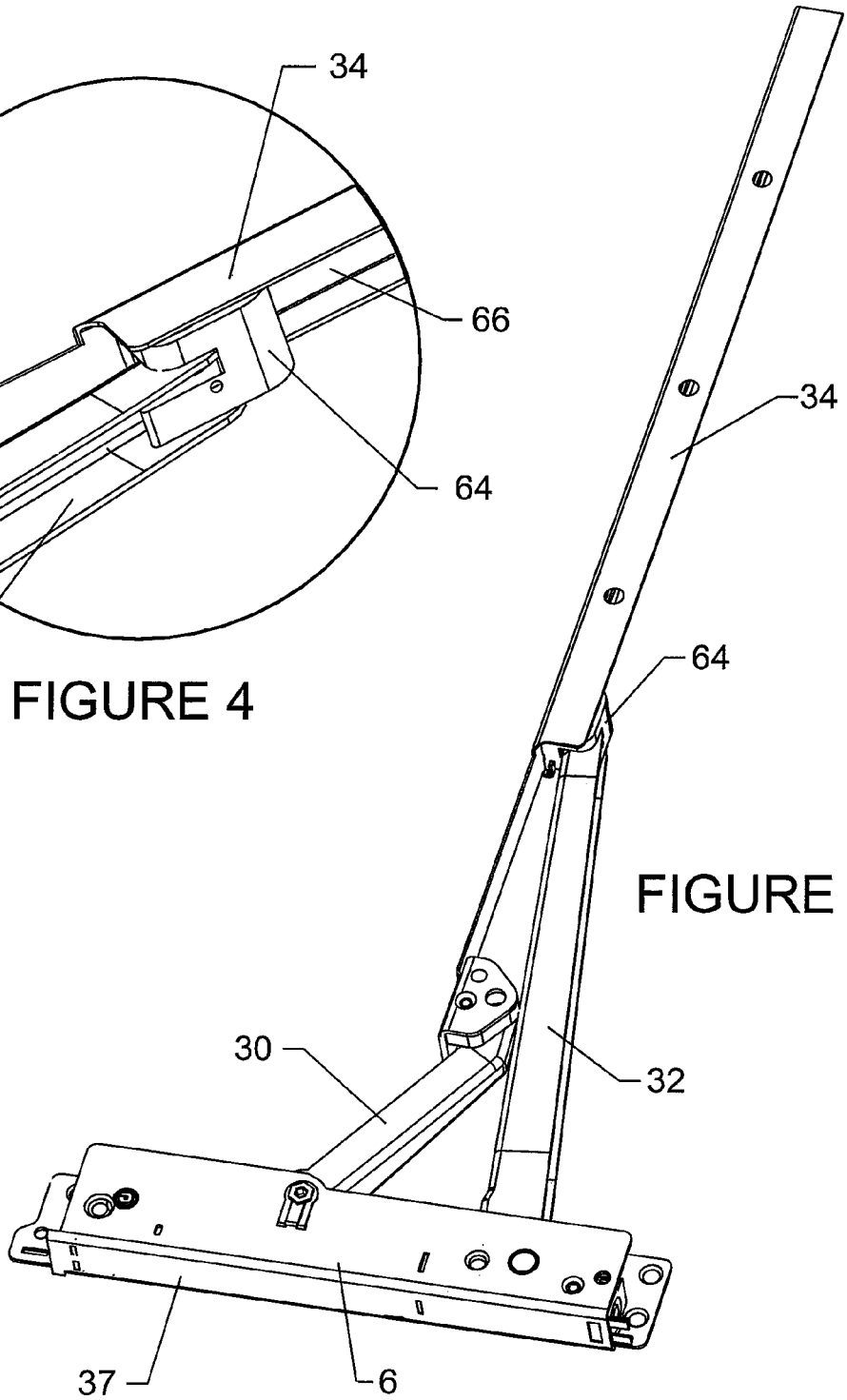
FIG. 3 is a perspective view of an actuator in a fully open position.
Figure 5:
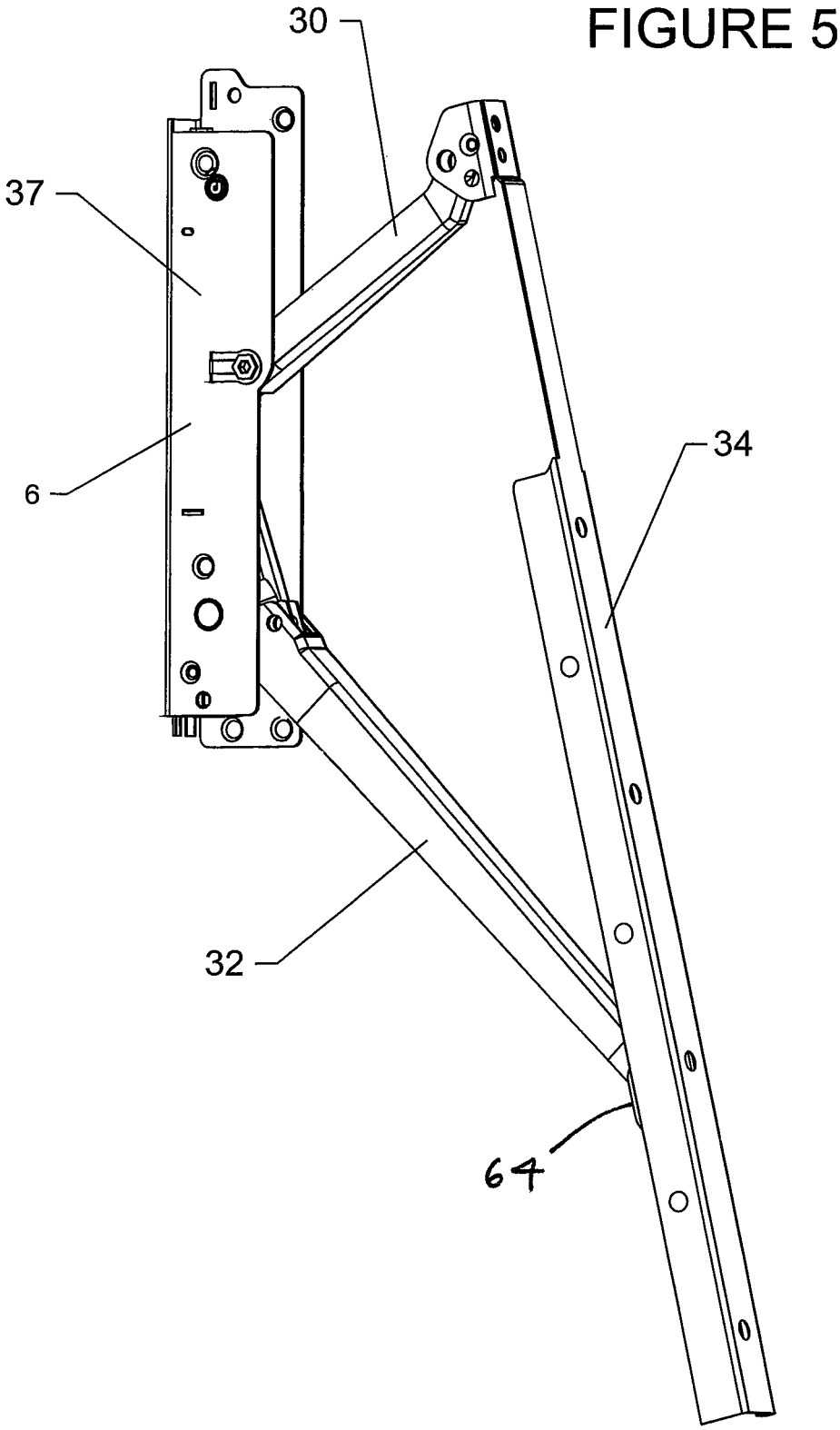
FIG. 5 is a perspective view of the actuator in a partially open position.
Figure 6:
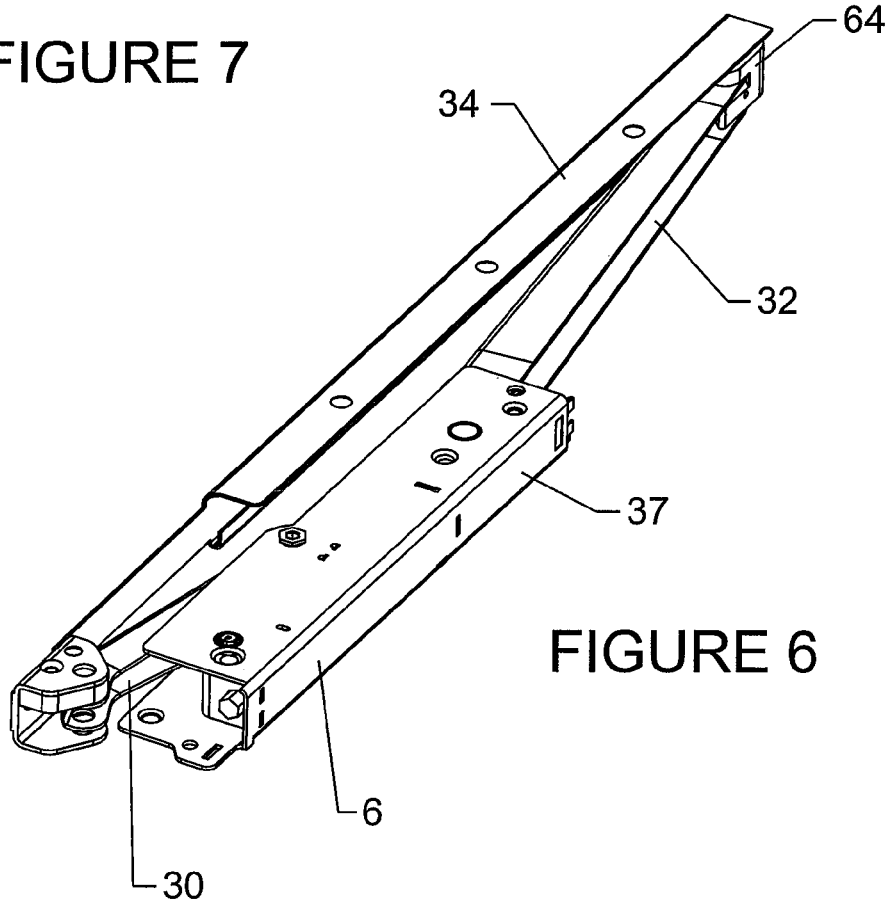
FIG. 6 is a perspective view of the actuator in a closed position.

In FIGS. 3 to 7, there are shown perspective views and partial perspective views of an actuator 6 in various positions. In FIG. 3, the actuator 6 is shown in a fully open position. In FIG. 5, the actuator is shown in a partially open position and in FIG. 6 the actuator 6 is shown to be in a closed position. In FIGS. 3, 5 and 6, it can be seen that the actuator 6 has a U-shaped cover 37 and that both the short arm 30 and long arm 32 extend from the cover 37 to the support 34 of the sash (not shown).

Figure 8:
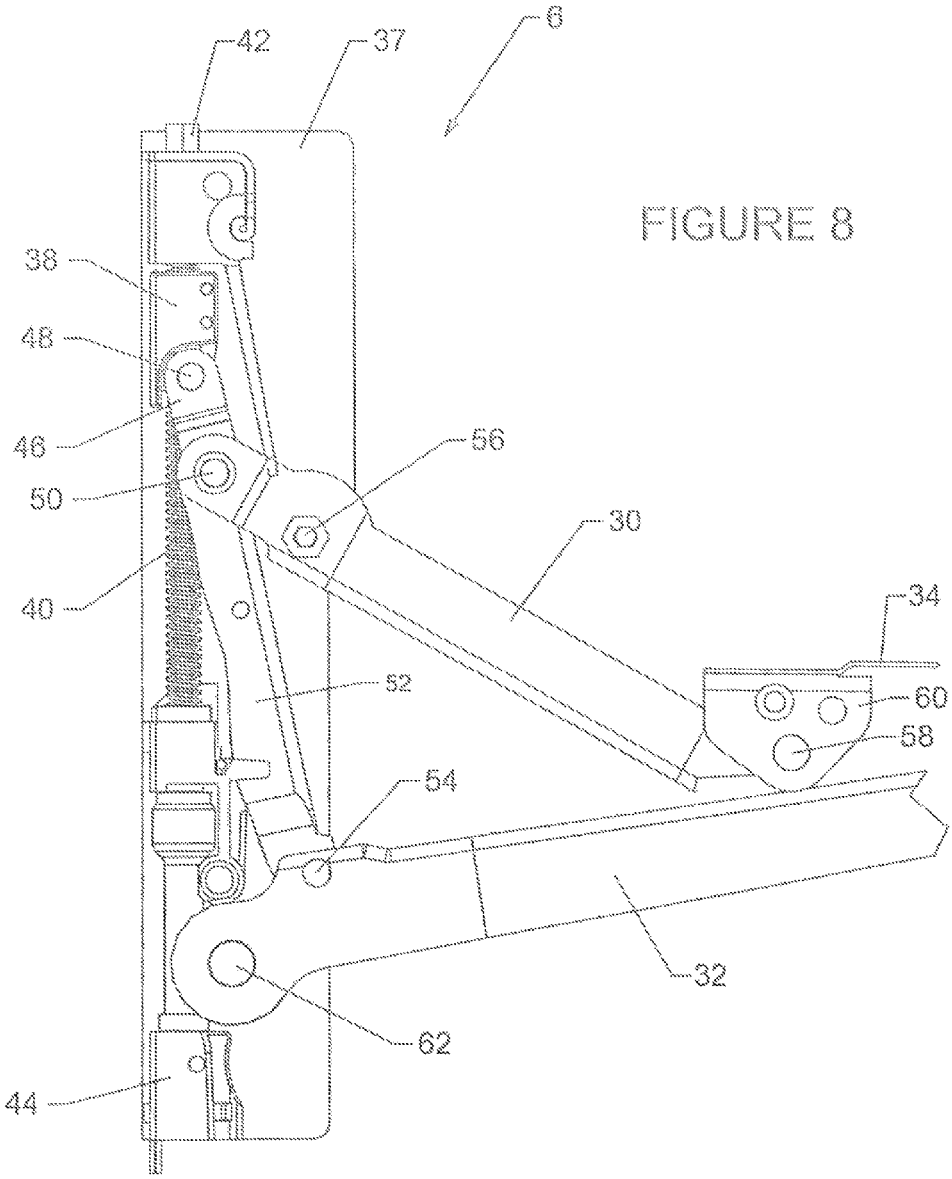
FIG. 8 is a top view of an actuator with a cover removed where the actuator is in a fully open position.

In FIGS. 8 to 14, there is shown a partial top view of the actuator 6 with an upper portion of the cover 37 removed to expose an interior. In FIG. 8, the actuator 6 is in a fully open position and a threaded sleeve 38 is installed on a rotatable universal screw 40. The universal screw is rotated by a connecting rod or a direct connector connected to either or both of the projection 42 at one end of the actuator 6 or the receptacle 44 at an opposite end. The receptacle 44 has a projection (not shown in FIGS. 8 to 14) located therein that is the same as the projection 42. A first short linkage 46 is connected to a pivot axis 48 located on the sleeve 38 and the pivot axis 50 located at an inner end of the short arm 30. A second long linkage 52 is also pivoted at an inner end about a pivot axis 50. An outer end of the second linkage 52 pivots about an axis 54 on the long arm 32. The short arm 30 pivots about the pivot axis 50 as well as the pivot axis 56, which is located near the inner end of the arm 30. An outer end of the short arm 30 pivots about the pivot axis 58 located in a support 60 that is rigidly affixed to the support 34. The pivot axes 50, 58 are movable axes. The pivot axis 56 is fixed. The long arm 32 is pivoted about a pivot axis 62 at an inner end thereof and about a pivot axis in a bracket (not shown in FIG. 8) which slides in a track portion (not shown in FIG. 8) of support 34 at an outer end thereof (not shown in FIG. 8).

Figure 7:
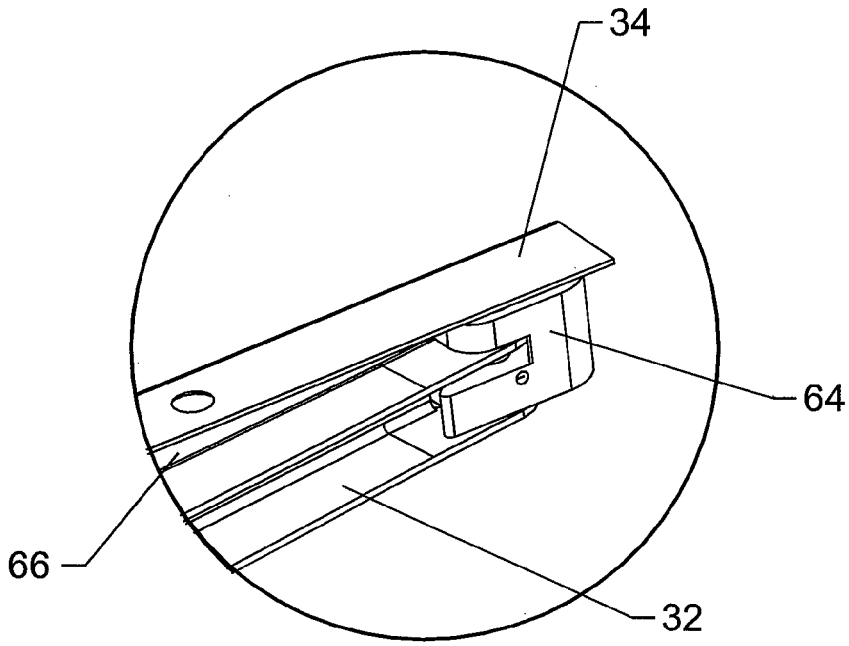
FIG. 7 is a perspective view of the connection between the long arm of the actuator and the support for the sash in the closed position.

Returning to FIGS. 3 to 7, an outer end of the long arm 32 is pivotally connected to a bracket 64 that is slidably mounted in a track 66 of the support 34 (best seen in FIGS. 4 and 7). By comparing FIGS. 3 to 7, it can be seen that the bracket 64 is located at an inner end of the track 66 when the actuator 6 is in the fully open position shown in FIGS. 3 and 4. In FIG. 5, the bracket 64 has moved partially toward an outer end of the support 34 when the actuator 6 is in the partially open position shown in FIG. 3. In FIGS. 6 and 7, when the actuator is in the closed position, the bracket 64 has slid to the outer end of the support 34 along the track 66.

Figure 9:
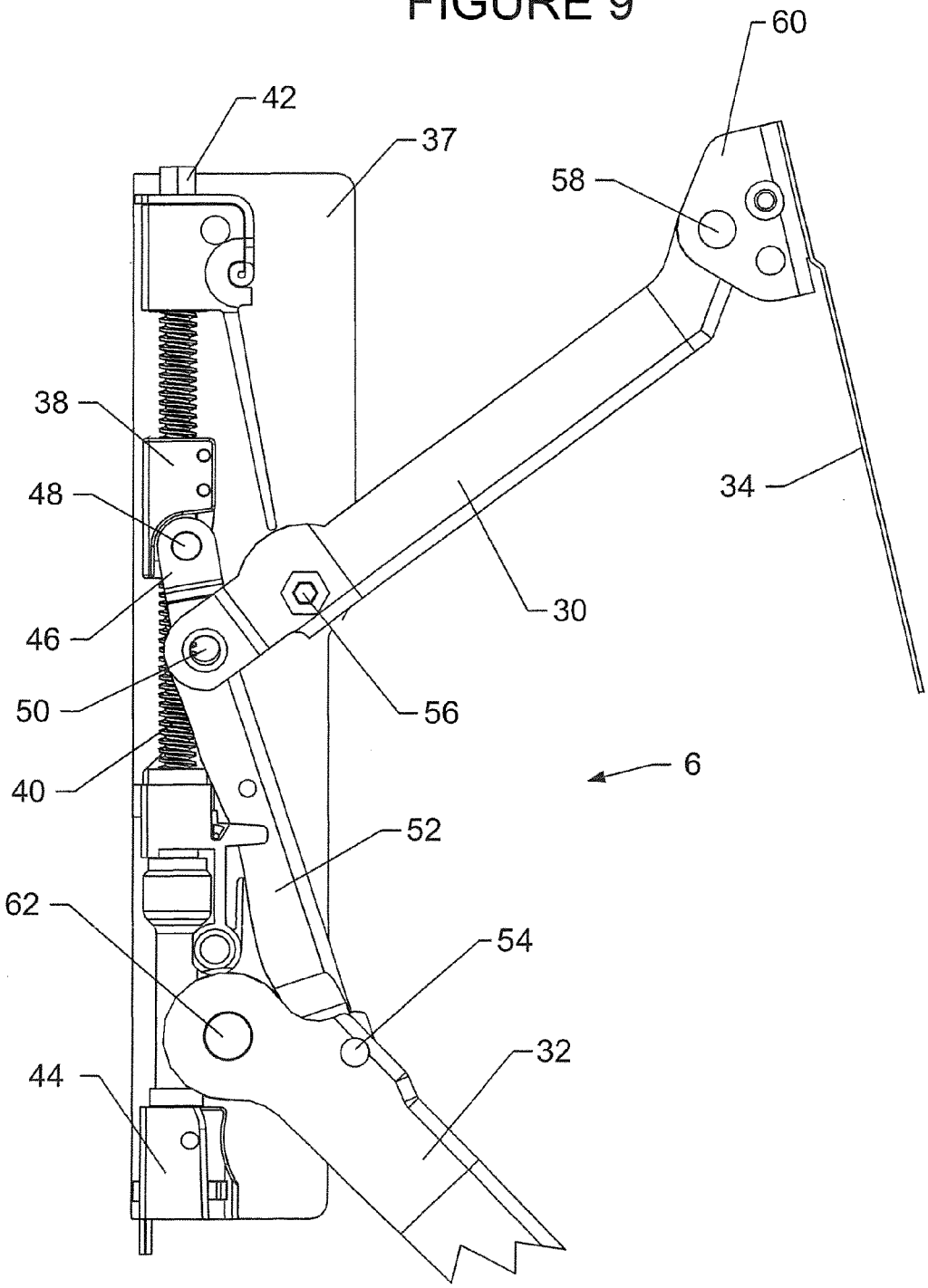
FIG. 9 is a top view of the actuator as shown in FIG. 8 where the actuator has moved toward a closed position.

As the crank (not shown in FIGS. 8 to 14), is turned to close the window (not shown in FIGS. 8 to 14), the universal screw 40 is rotated in an opposite direction to the direction when the window was being opened and the sleeve 38 moves further away from a projection 42, thereby causing the first pivot arm 46, the second pivot arm 52, the short arm 30, the long arm 32 and the support 34 to move toward a closed position as shown in FIG. 9.

Figure 10:
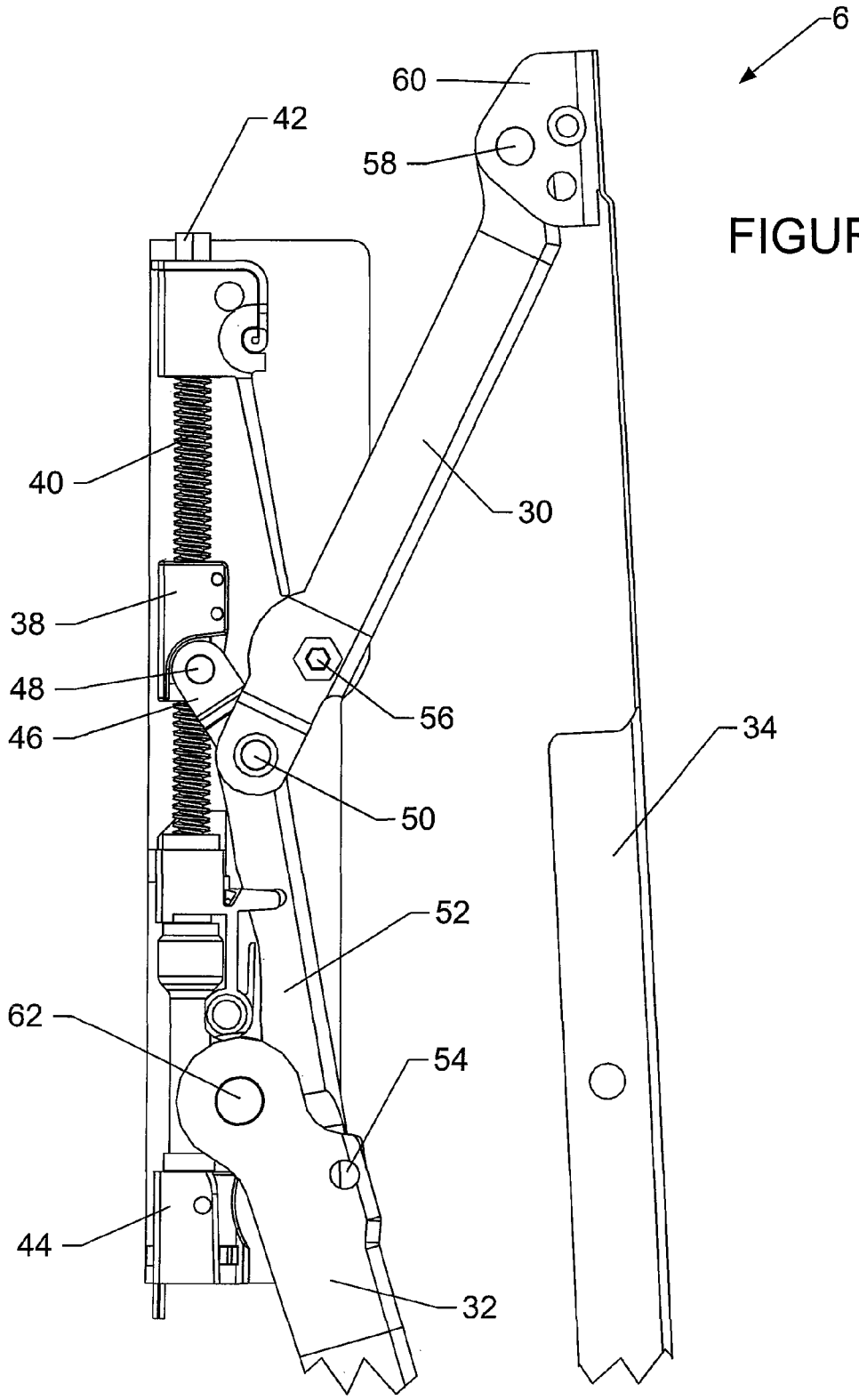
FIG. 10 is a top view of the actuator as shown in FIG. 9 where the actuator has moved further toward a closed position.

In FIG. 10, as the crank has continued to be turned, the sleeve 38 has moved still further from the projection 42 and the first pivot arm 46, the second pivot arm 52, the short arm 30, the long arm 32 and the bracket 34 have pivoted to the location shown, with the support 34 being nearly parallel to the frame (not shown) through the housing 36 of the actuator 6.

Figure 11:
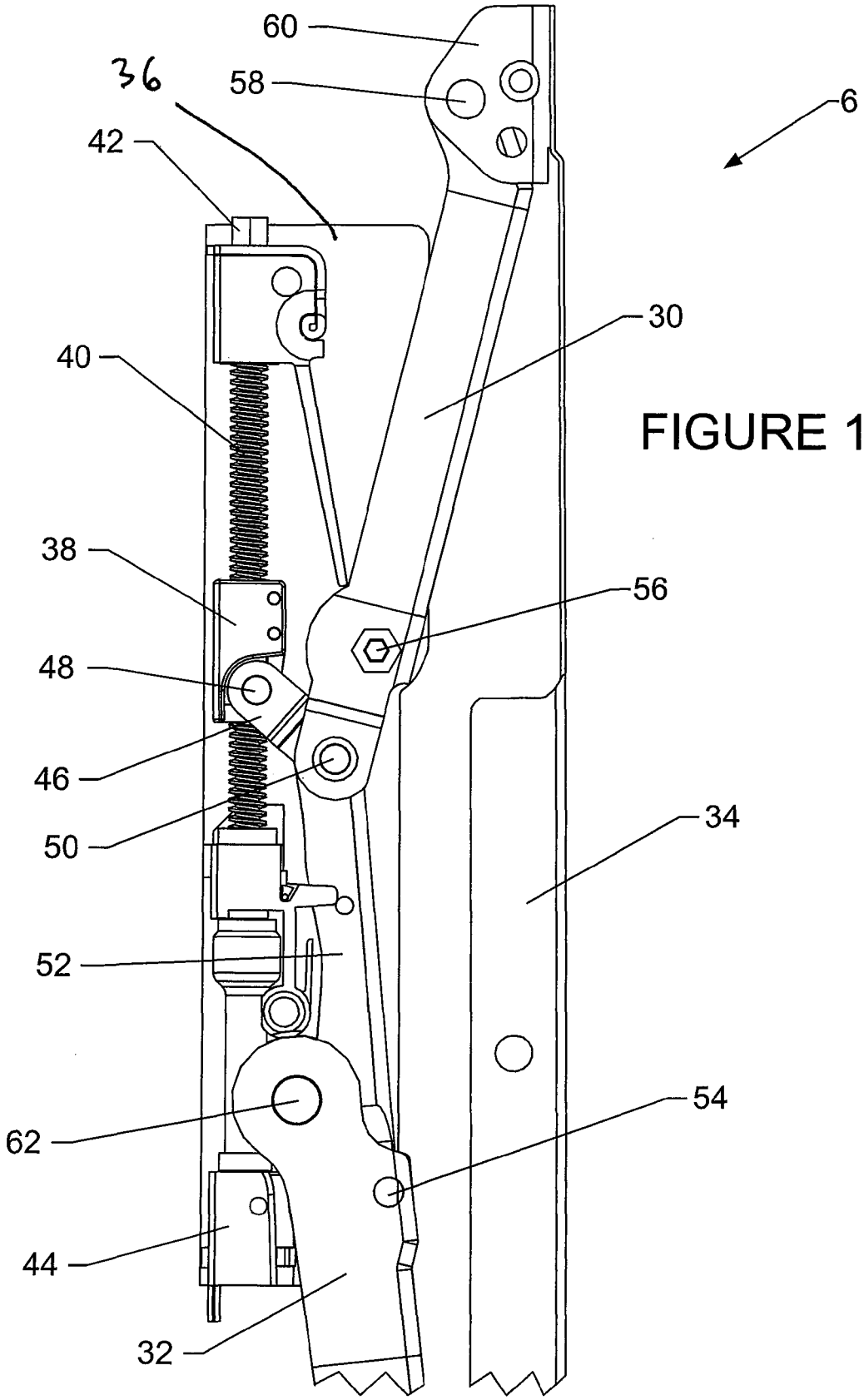
FIG. 11 is a top view of the actuator as shown in FIG. 10 where the actuator has moved further toward a closed position.
Figure 12:
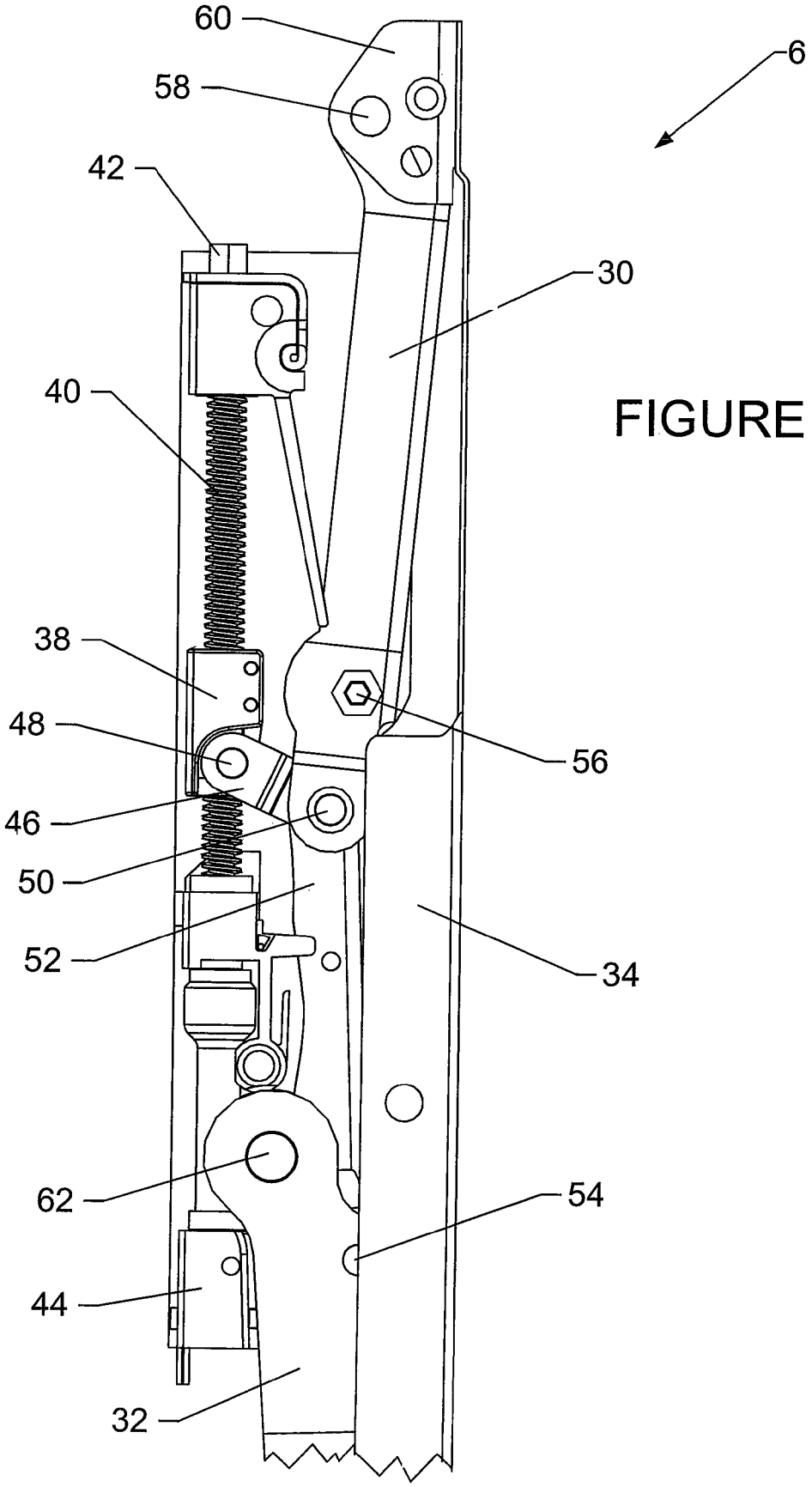
FIG. 12 is a top view of the actuator as shown in FIG. 11 where the actuator has moved toward a closed position.

In FIG. 11, as the crank is turned further, the sleeve 38 moves further along the universal screw 40 and the sash continues to move toward the closed position to the location shown where the support 34 is parallel to the frame (not shown) in which the housing 36 is mounted. The frame is parallel to the housing 36. In FIG. 12, the sleeve 38 has moved still further from the projection 42, thereby causing the support 34 to be moved closer to the housing 36 and the frame (not shown).

Figure 13:
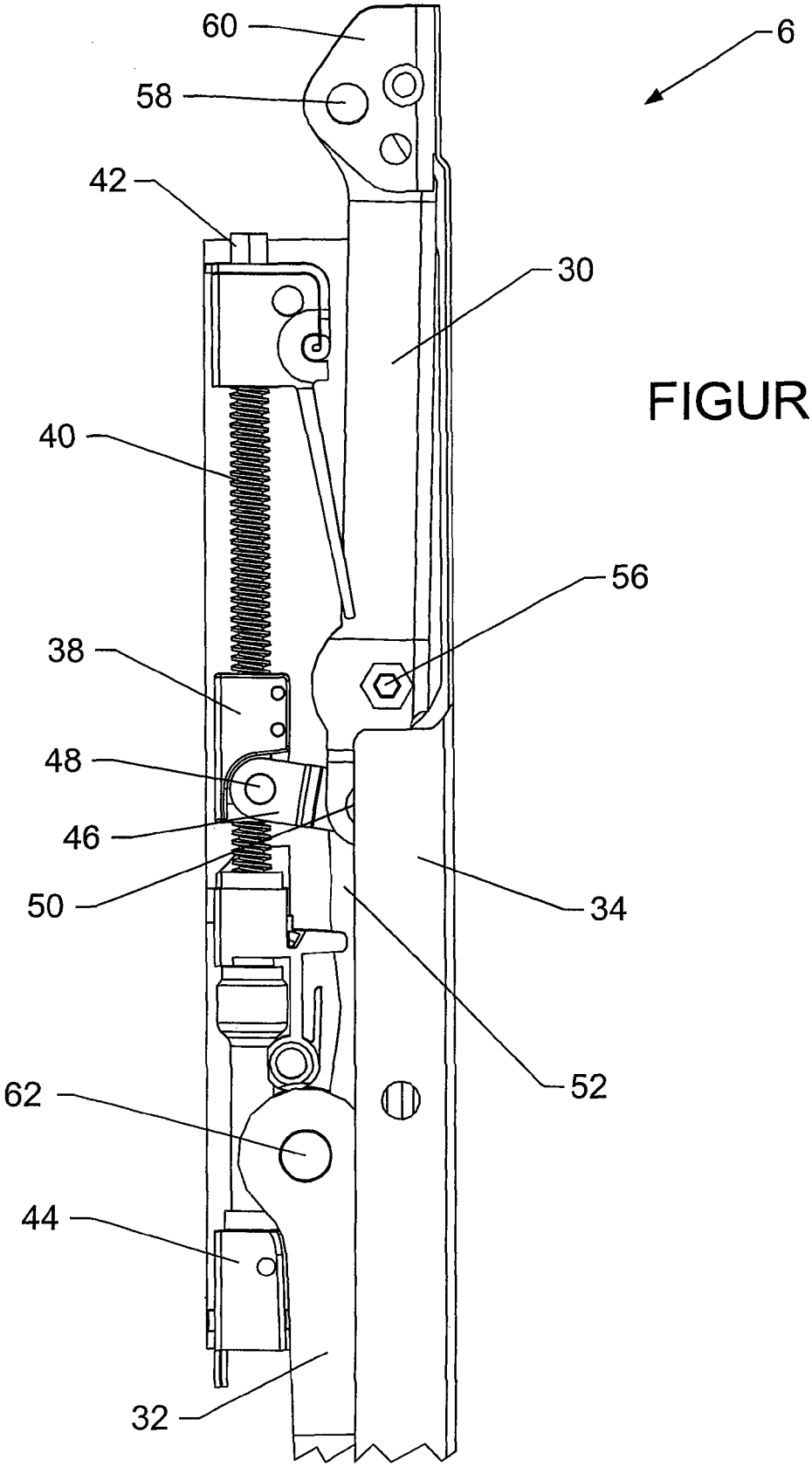
FIG. 13 is a top view of the actuator of FIG. 12 in a position where the actuator is nearly closed.
Figure 14:
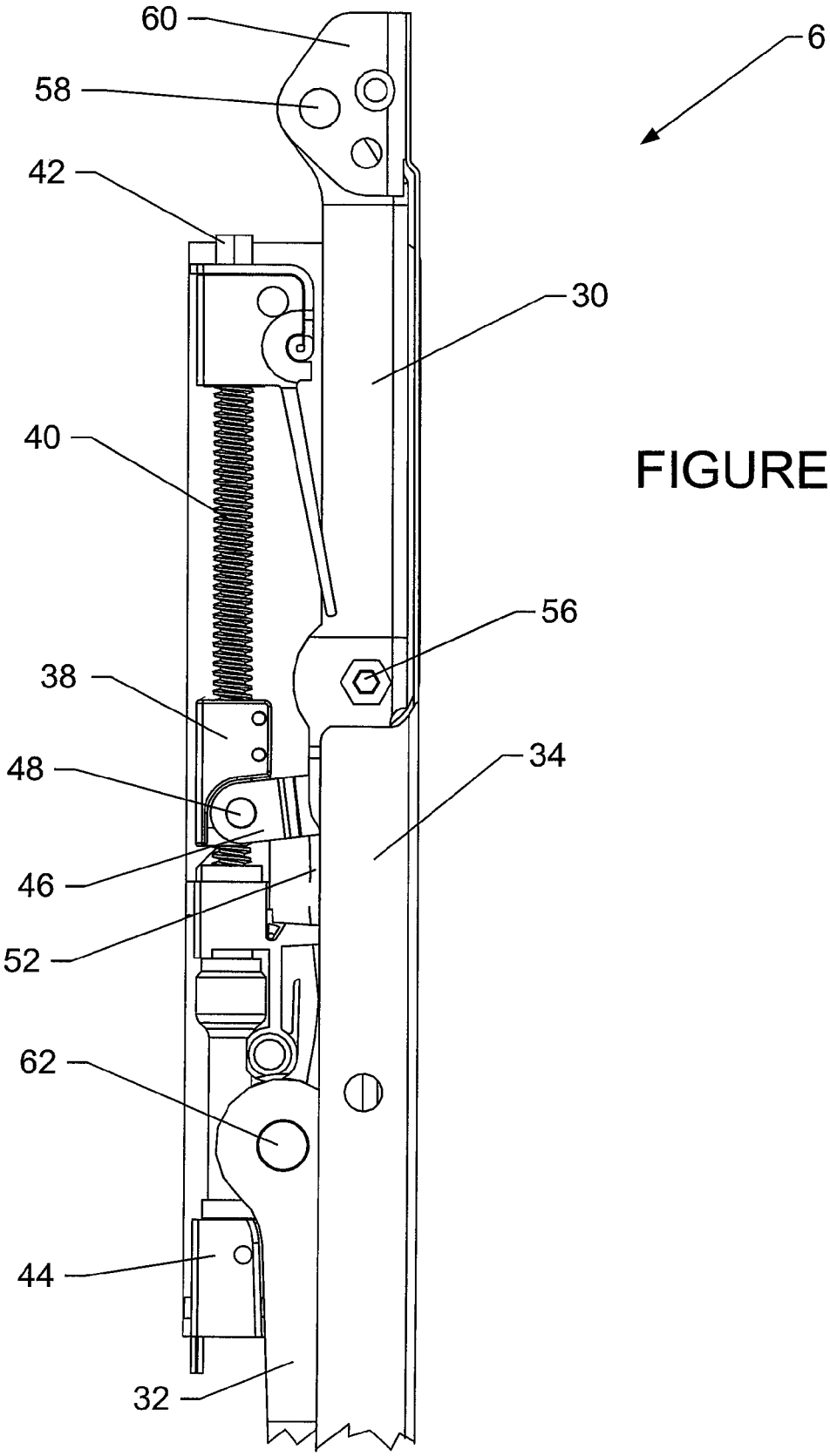
FIG. 14 is a top view of an actuator of FIG. 13 where, the actuator is in a closed position.

In FIG. 13, the sleeve 38 has moved still further away from the projection 42 and the support 34 has moved still closer to the fully closed position. In FIG. 14, the sleeve 38 has moved still further from the projection 42 along the universal screw 40 and the support 34 and the sash (not shown in FIGS. 8 to 14) is in the fully closed position.

Figure 15:
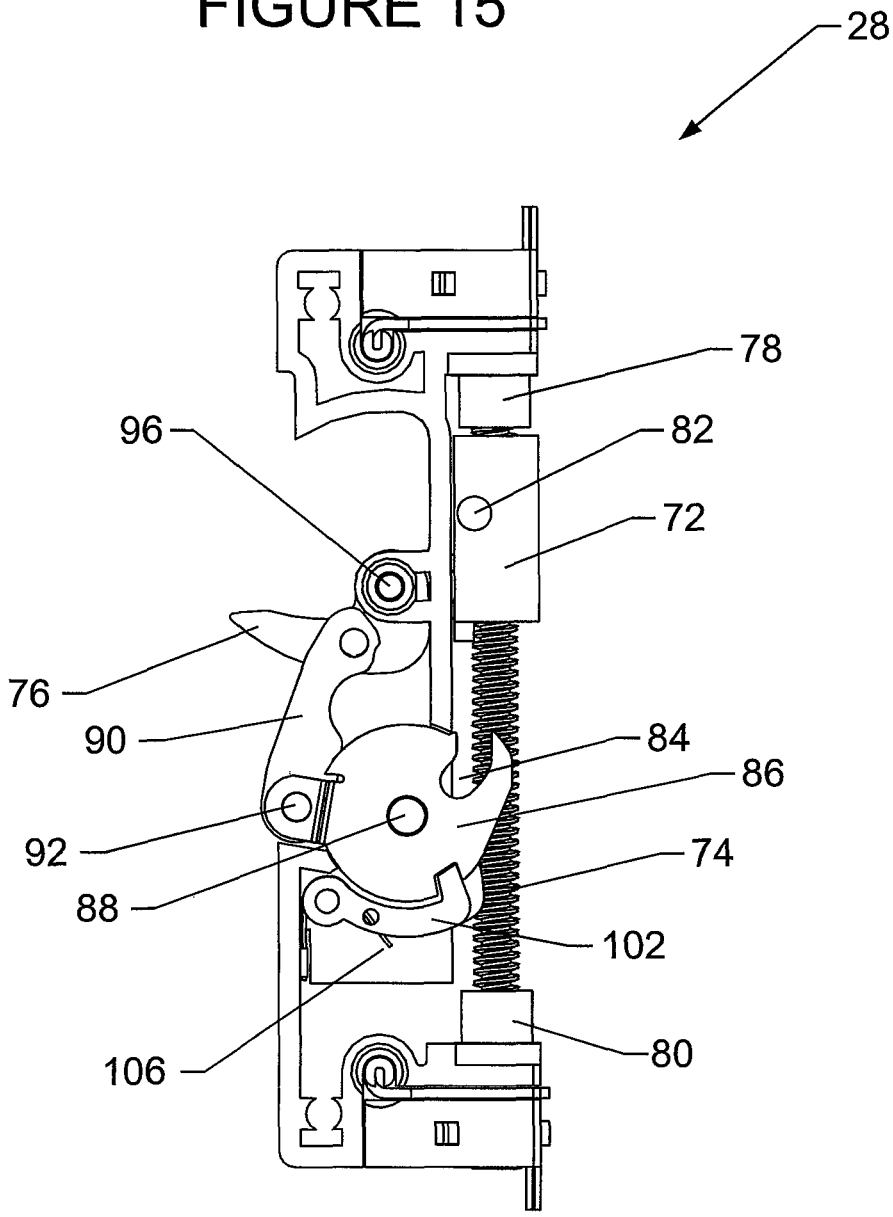
FIG. 15 is a top view of a lock with the cover removed in the fully open position.
Figure 16:
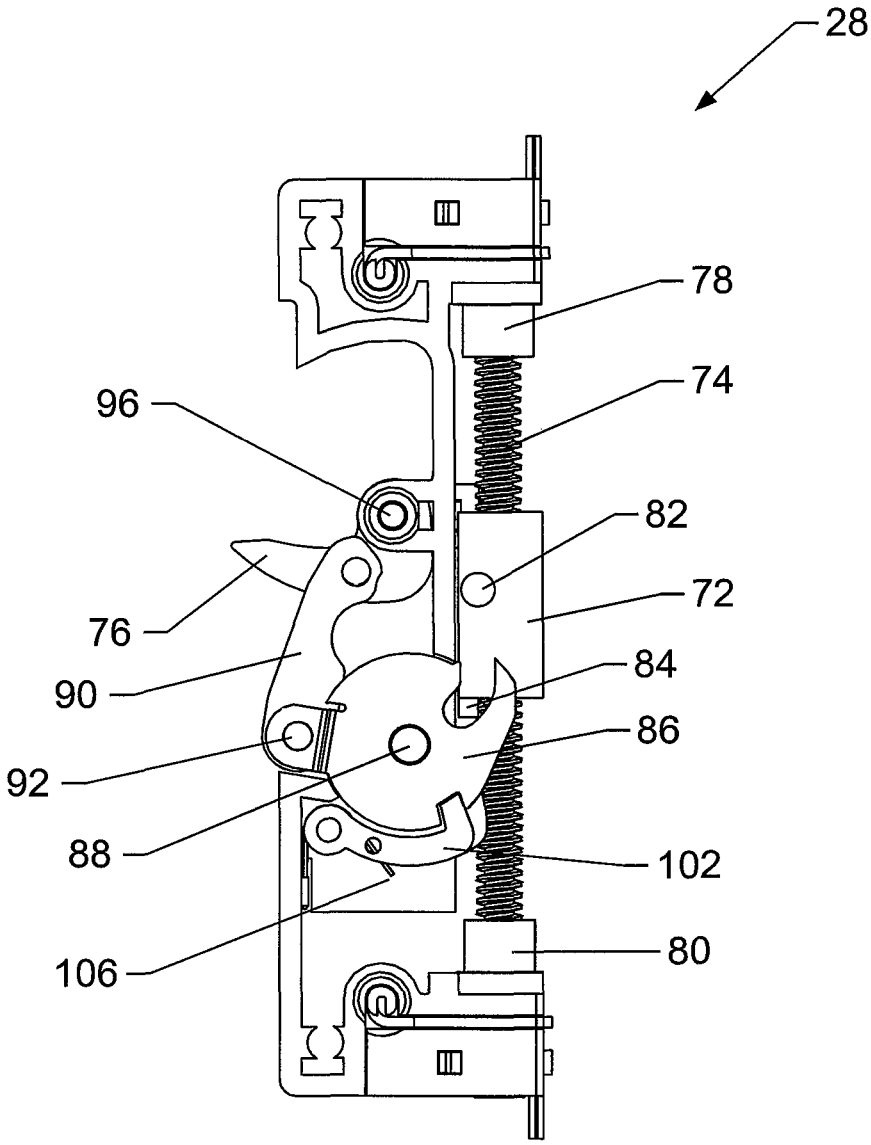
FIG. 16 is a top view of the lock shown in FIG. 15 where the lock has moved toward a closed position.

In FIGS. 15 to 21, there is shown a side view of the lock 28, when viewed from the right hand side as shown in FIG. 1, with a housing removed. The lock 28 is synchronized with the actuator 6 and FIGS. 15 to 21 show the movement of the lock 28 as the actuator 6, (not shown in FIGS. 15 to 21) moves through the positions in FIGS. 8 to 14 respectively. FIG. 15 shows the lock 28 when the actuator 6 is in the fully open position and a sleeve 72, which has corresponding threads to the universal screw 74 is at an uppermost position and a clasp 76 of the lock 28 is also in a fully open position. As the crank (not shown in FIGS. 15 to 21) is turned clockwise, the sleeve 72 moves down the universal screw 74 to a position shown in FIG. 16 in which the clasp 76 is still in the fully open position. The connecting rods and collars are not shown in FIGS. 15 to 21 but receptacles 78, 80 can be seen at either end of the universal screw 74. The receptacles 78, 80 each have the projection 42 (not shown) therein and receive the connecting rod, which is held in place by a collar (also not shown in FIGS. 15 to 21). FIG. 16 shows the lock in the position corresponding to the position of the actuator shown in FIG. 9.

Figure 17:
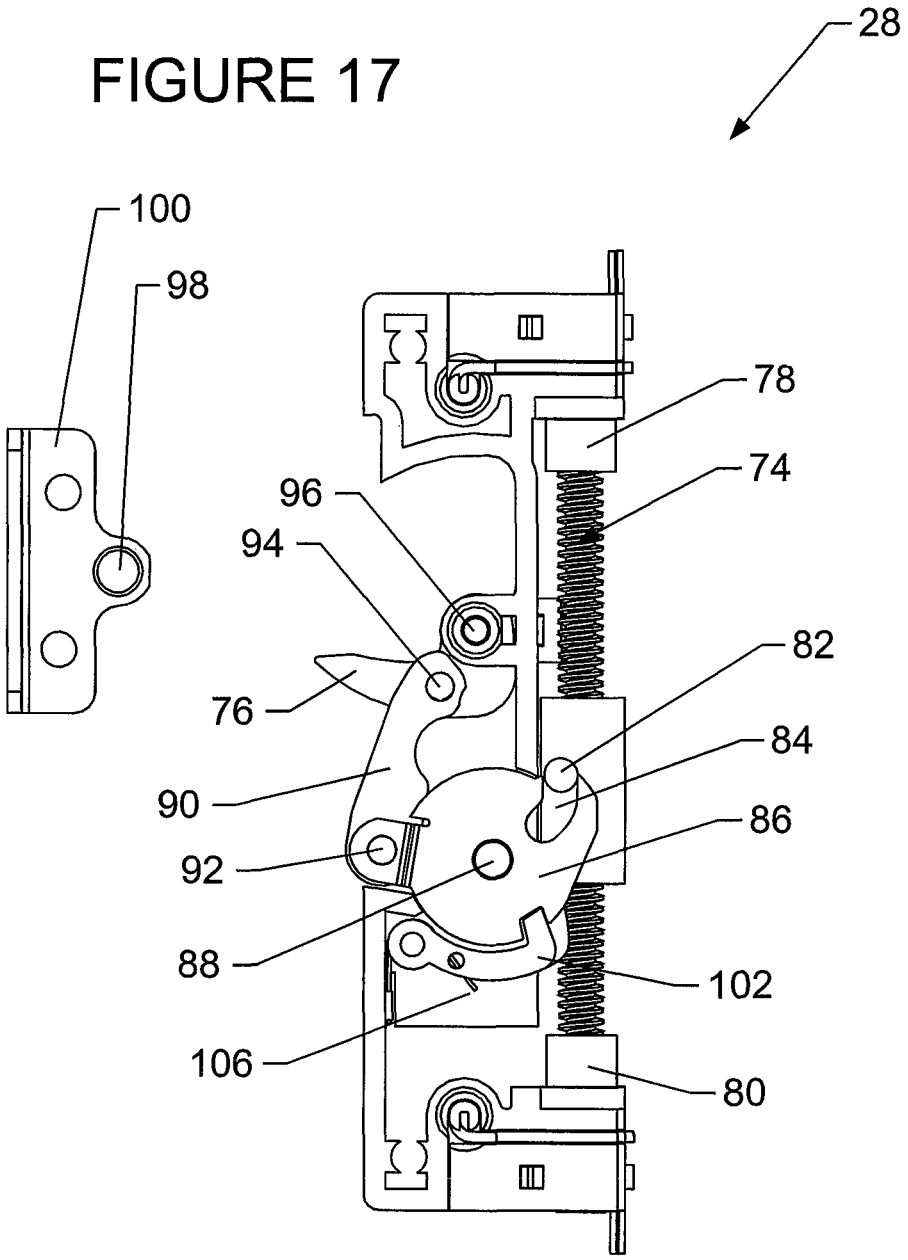
FIG. 17 is a top view of the lock shown in FIG. 16 where the lock has moved still further toward the closed position and a keeper has moved closer to the lock.

In FIG. 17, the sleeve 72 has continued to move downward as the universal screw 74 rotates and a nodule 82 on the sleeve 72 has just started to enter a short channel 84 on a rotatable disk 86. The disk 86 pivots about a pivot axis 88. The disk 86 is pivotally connected to a third pivot arm 90 at a pivot axis 92 on the disk 86. An opposite end of the third pivot arm 90 is pivotally connected to the clasp 76 about a pivot axis 94. The clasp 76 has an L-shape and an inner end of the clasp 76 is pivoted about a pivot axis 96. Since the sash (not shown in FIGS. 15 to 21) located on the bracket 34 is in the position shown for the actuator 6 in FIG. 10, the sash is getting closer to the actuator 6 and a keeper 98, which is mounted on the sash by means of a bracket 100, is getting closer to the lock 28 as shown in FIG. 17. A retainer 102 is pivoted about a pivot axis 104 and is biased in a counterclockwise direction by a spring 106 to hold a free end of the retainer 102 in a corresponding slot 108 (best seen in FIGS. 18 to 21) in the disk 86.

Figure 18:
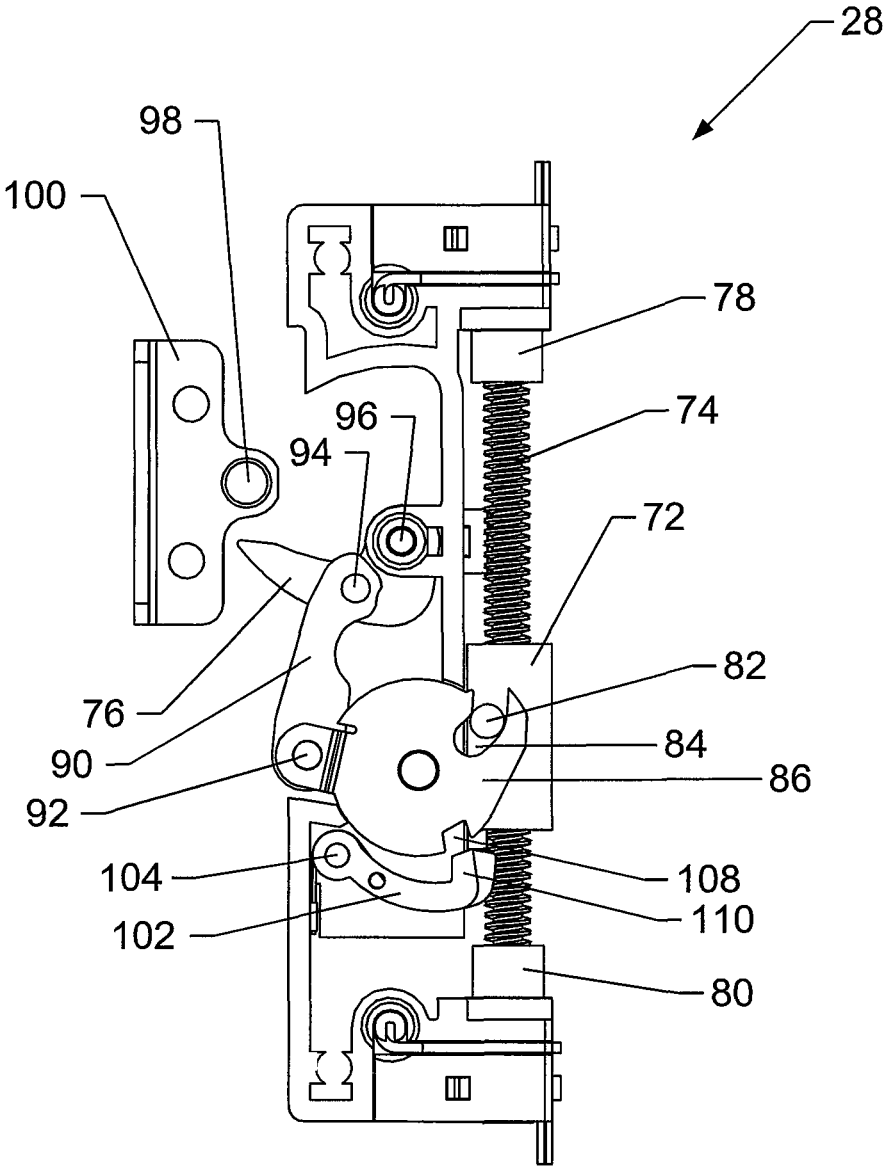
FIG. 18 is a top view of the lock as shown in FIG. 17 where the lock has moved further toward the closed position and the keeper has moved still closer to the lock.
Figure 19:
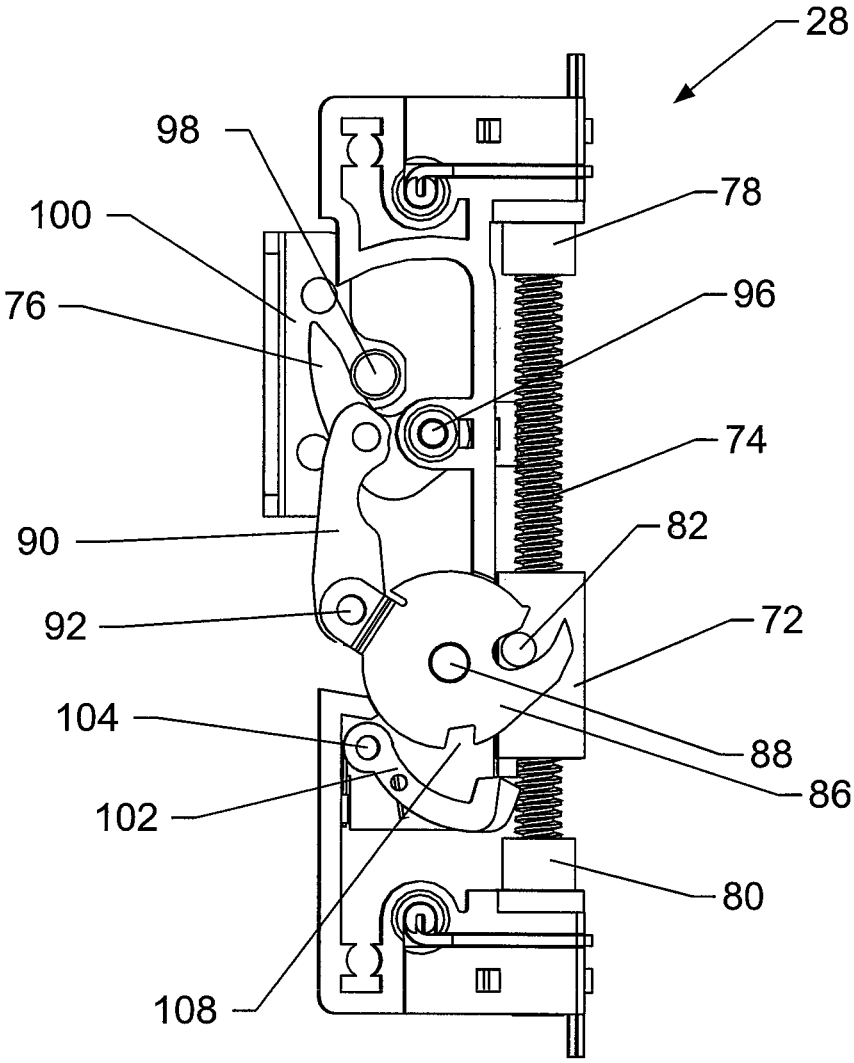
FIG. 19 is a top view of the lock and keeper as shown in FIG. 18 where the lock and keeper have moved further toward the closed position.

As shown in FIG. 18, as the sleeve 72 moves further downward on the universal screw 74, a leading portion of the sleeve 72 contacts the retainer 102 and pivots the retainer 102 out of the slot 108 in the disc 86 so that as the nodule 82 enters further into the channel 84, the disk 86 is free to rotate clockwise. As the disk 86 pivots clockwise, the pivot axis 92 pushes the third pivot arm 90 toward the clasp 76 causing the clasp to pivot clockwise about the pivot axis 96, thereby beginning to move the clasp toward a closed position. At the same time, the keeper 98 has moved much closer to the lock 28. The position of the lock 28 in FIG. 18 corresponds to the position of the actuator 6 shown in FIG. 11. In FIG. 19, the sleeve 72 has moved still further downward on the universal screw 74 causing the disk 86 to rotate further clockwise resulting in the clasp 76 moving further toward the closed position with the keeper 98 inside the clasp. The position of the lock 28 as shown in FIG. 19 corresponds to the position of the actuator 6 as shown in FIG. 12. It can be seen that the actuator 6 is getting very close to the closed position.

Figure 20:
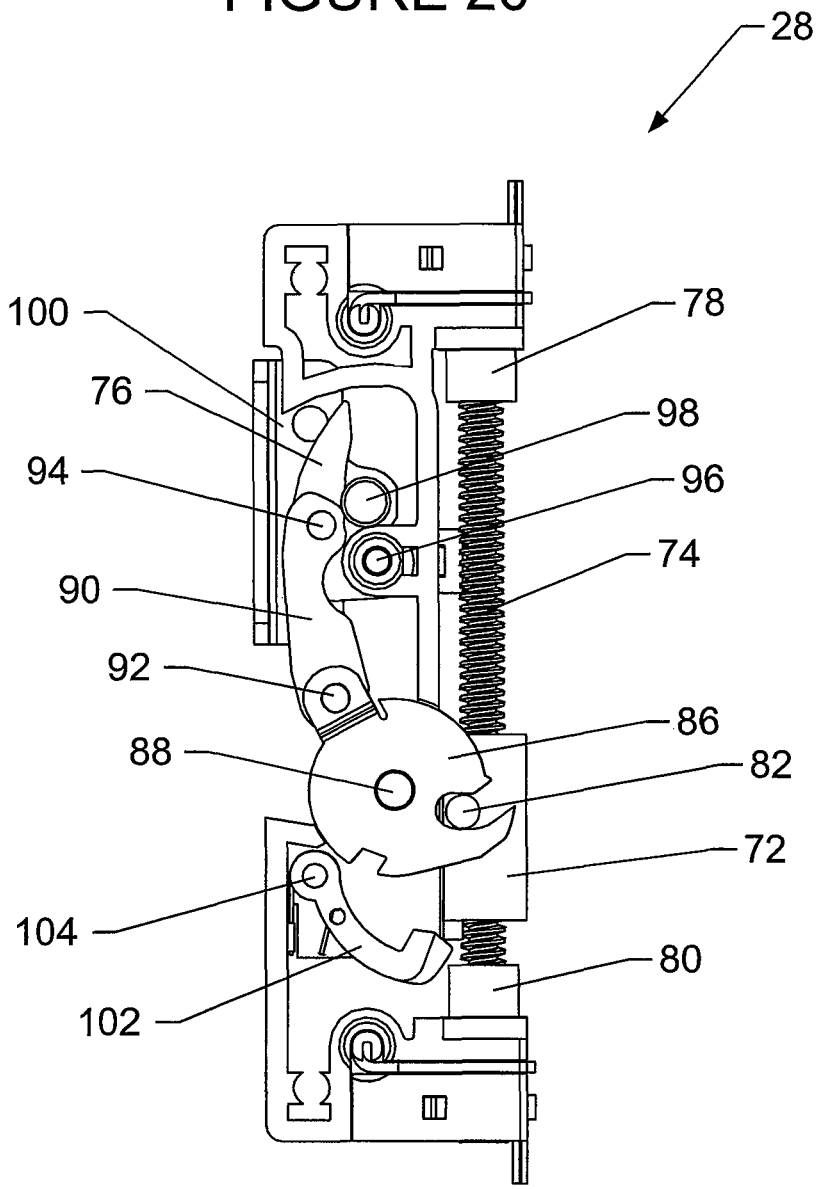
FIG. 20 is a top view of the lock and keeper of FIG. 19 where the lock and keeper have moved further toward a closed position.
Figure 21:
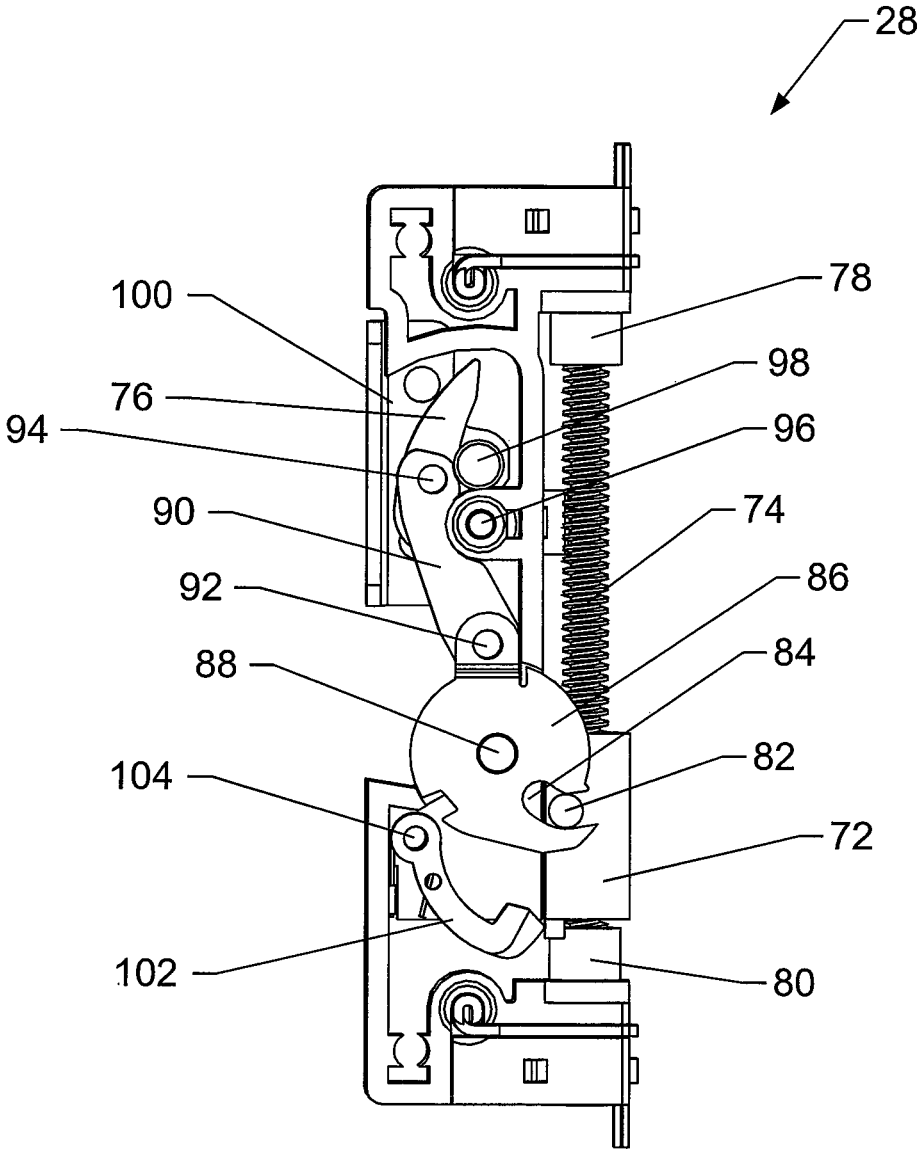
FIG. 21 is a top view of a lock and keeper of FIG. 20 where the lock is in a closed position in engagement with the keeper.

In FIG. 20, the clasp 76 closes still further onto the keeper 98 and the actuator 6 is nearly fully closed as shown in FIG. 13. In FIG. 21, the sleeve 72 is nearly at the lower end of the universal screw 74 and the actuator 6 as shown in FIG. 14 is fully closed and the clasp 76 shown in FIG. 21 is also fully closed.

In order to open the window, the crank is turned in an opposite direction (counterclockwise when viewed from inside the window), the sleeve 72 begins to move upward on the universal screw 74 and the operation described in FIGS. 15 to 21 and FIGS. 8 to 14 is reversed.

Figure 22:
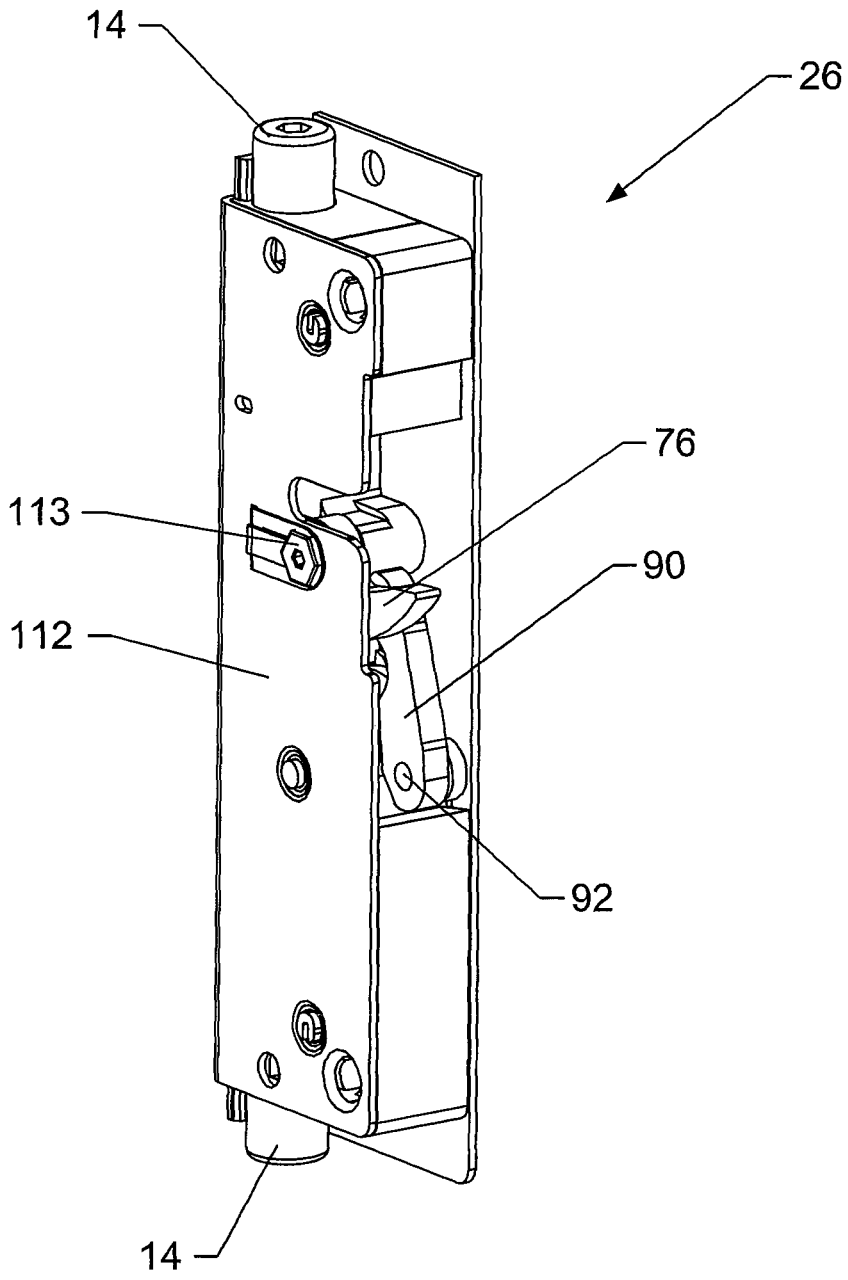
FIG. 22 is a perspective view of a lock with a cover thereon with the lock in an open position.

In FIG. 22, there is shown an enlarged perspective view of the lock 26 shown in FIG. 1 in an open position. The same reference numerals are used in FIG. 22 as those used in FIGS. 15 to 21 for those components that are identical. The lock 26 has a housing 112 with collars 14 connected into receptacles (not shown in FIG. 22) located inside the housing 112. If lock should fail or the window operating system should fail when the lock 26 is in the locked position, the lock can be released by removing a hexnut 113. When the hexnut 113 is removed, the clasp 76 shown in the locked position in FIG. 21 will release the keeper as the pivot axis 96 will be removable from the lock.

Figure 23:
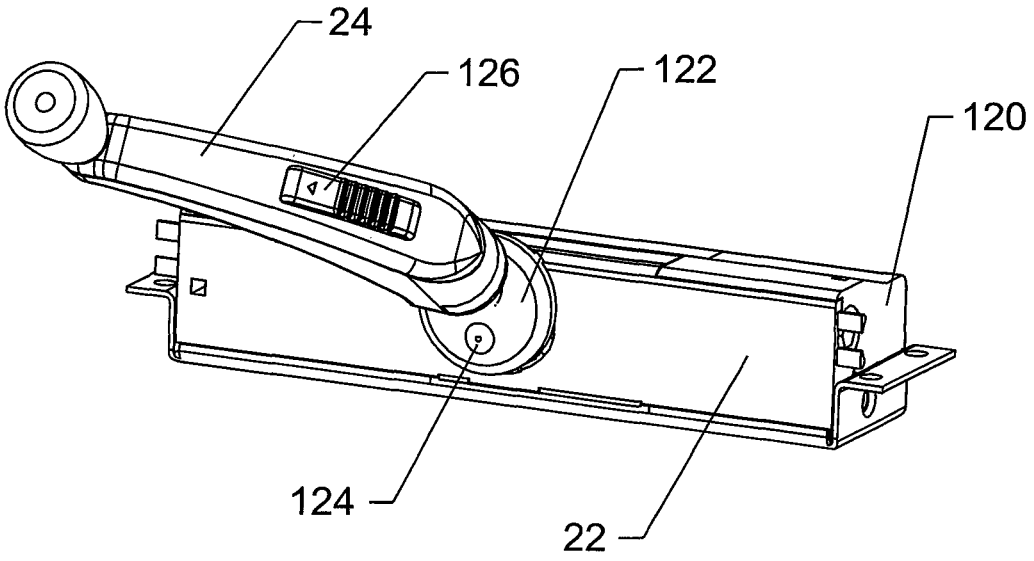
FIG. 23 is a perspective view of a crank assembly when viewed from a crank side.
Figure 24:
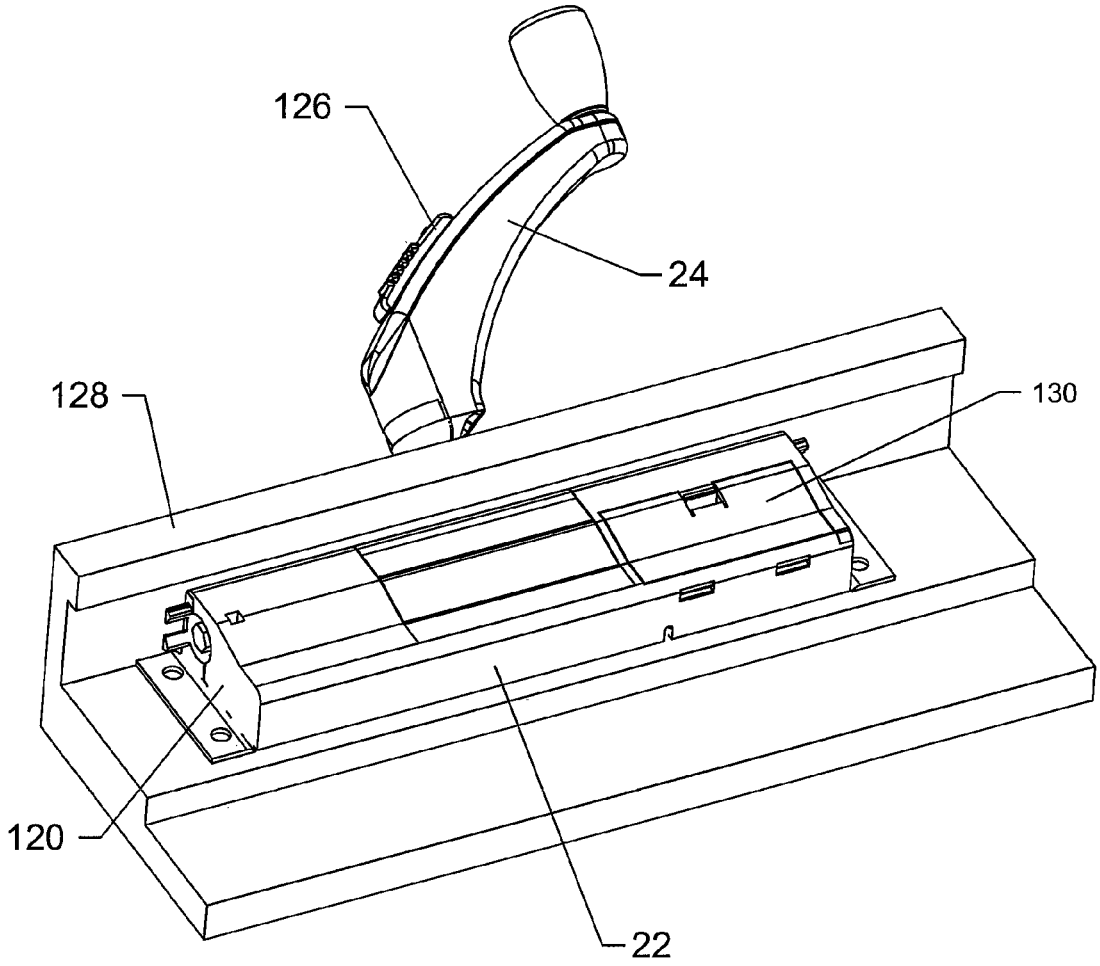
FIG. 24 is a perspective view of a crank assembly mounted in a frame when viewed from a side opposite to the crank.

FIGS. 23 to 37 show the crank assembly 22 and the crank 24. In FIGS. 23 and 24, a crank assembly 22 has a housing 120 with a crank 24 extending out of said housing. The crank 24 can be turned clockwise or counterclockwise and extends out of a base 122. The base 122 has an LED light therein. The LED light is powered by one or more batteries (not shown) and illuminates when the window (not shown in FIGS. 23 and 24) is closed and the lock or locks are in a fully locked position. A button 126 is located on the crank and can be moved towards a free end of the crank 24 to allow the crank to be moved from an operating position to a folded position. In FIG. 24, the crank assembly is mounted within a frame 128 with the crank 24 protruding from the frame 128 toward an interior. A cover 130 in the housing 120 provides access to a storage area (not shown) for batteries (not shown) to power the LED 124. The crank assemblies shown in the drawings are separate components from the actuators and thereby provide greater flexibility in the design of the window system. The actuators can be designed as operators with the crank assembly made part of the operator to carry out the present invention.

Figure 25:
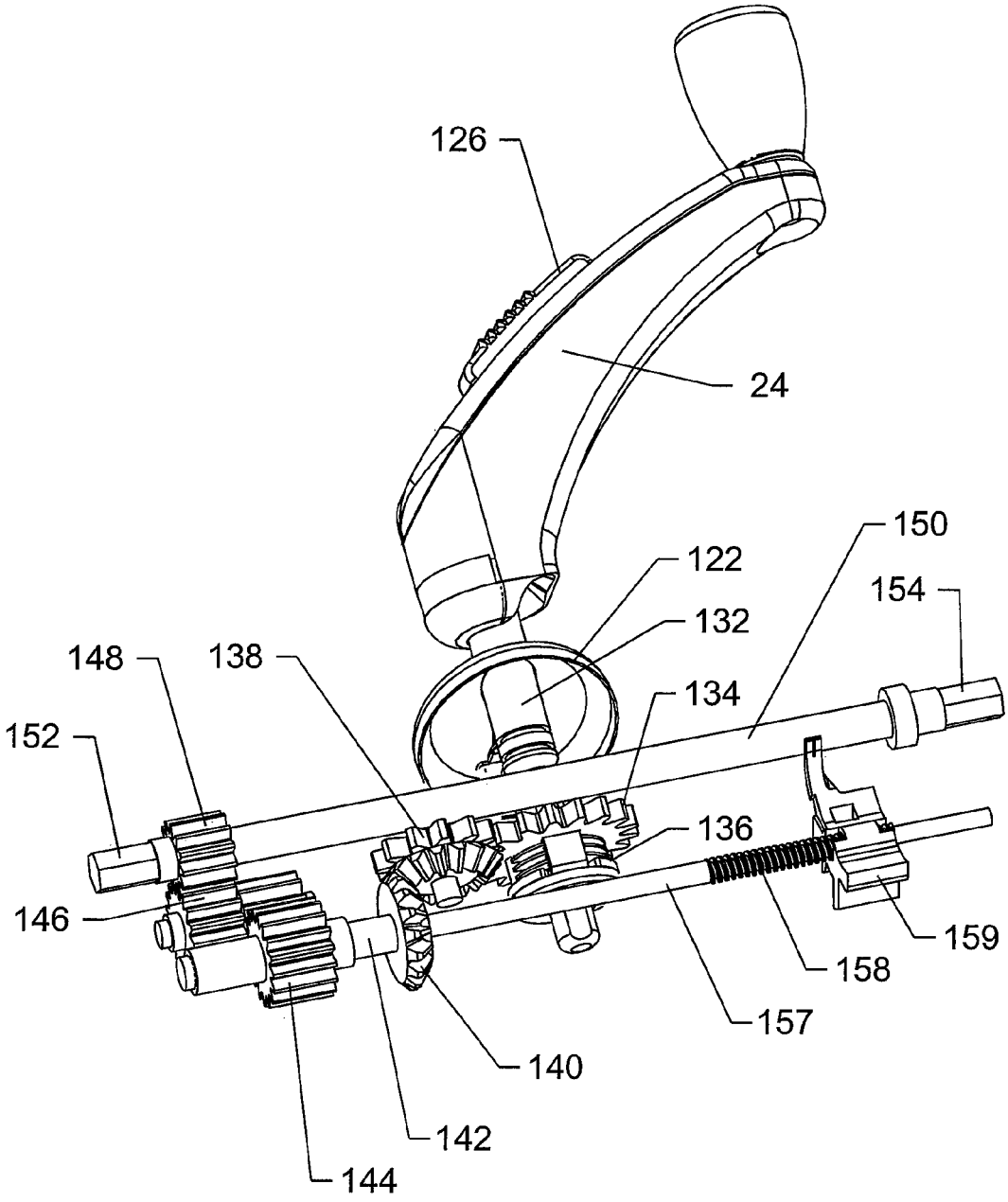
FIG. 25 is a perspective view of a crank assembly with a housing removed to expose an interior.

In FIG. 25, there is shown a perspective view of the crank assembly 22 and crank 24 with the housing removed to expose an interior. It can be seen that the crank 24 has a shaft 132 extending downward therefrom through the base 122. The shaft 132 extends through a drive gear 134 and into a clutch assembly 136. The drive gear 134 engages with a double gear 138. The double gear 138 in turn drives the gear 140 mounted on a shaft 142. The shaft 142 has a gear 144 thereon that intermeshes with a double gear 146, which in turn intermeshes with a gear 148 that is rigidly connected to a rod 150 having two ends 152, 154 that are shaped to receive a collar (not shown in FIG. 25) and a connecting rod (not shown in FIG. 25). The shaft 142 is coaxially connected to a shaft 157. The shaft 157 therefore rotates as the shaft 142 rotates. The shaft 157 has a threaded portion 158 that extends through a block 159 which slides along the housing as the rod 157 rotates until the lock reaches the fully open or fully closed positions (not shown in FIG. 25). The block 159 is prevented by the housing from rotating with the rod 157. When the actuators and locks reach the fully closed position the block 159 is at one end of the threaded portion and has moved into contact with the electric switch to illuminate the LED.

Figure 26:
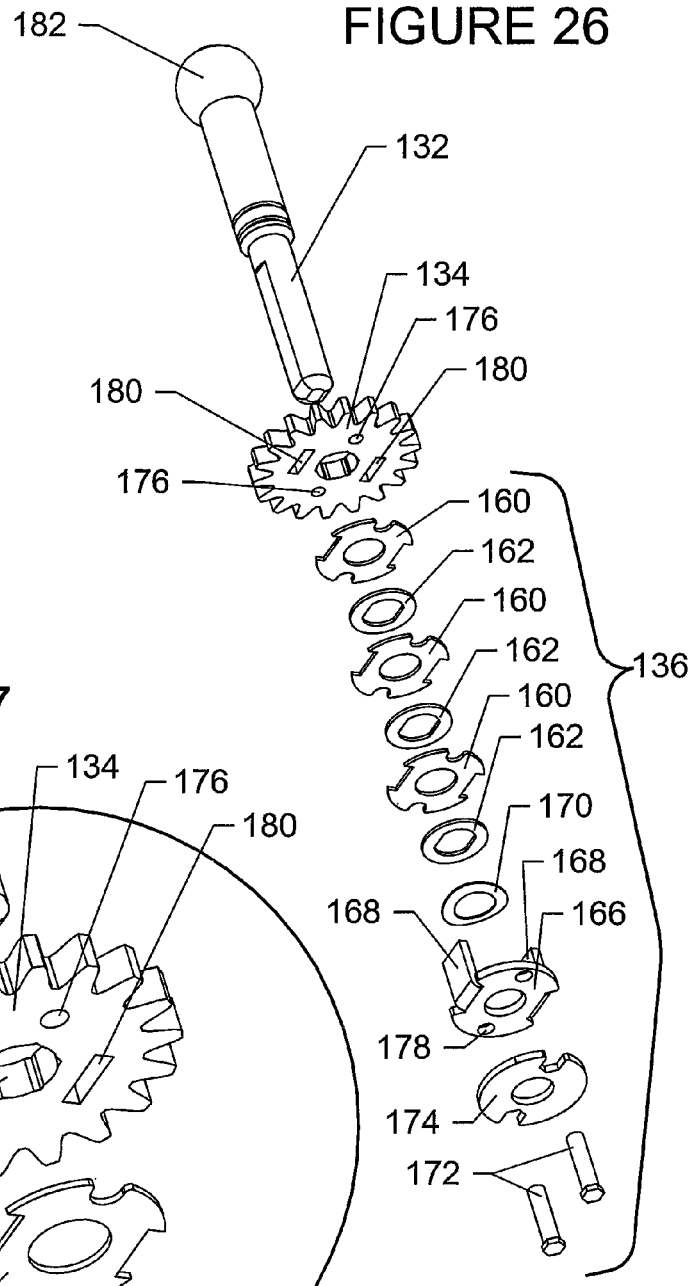
FIG. 26 is an exploded perspective view of a clutch of the crank assembly.
Figure 27:
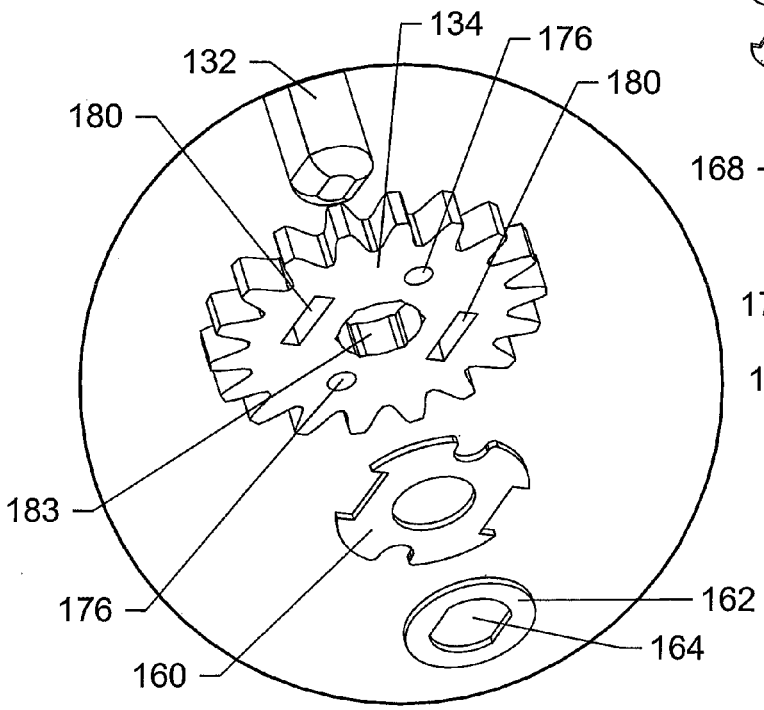
FIG. 27 is an enlarged partial exploded perspective view of the clutch shown in FIG. 26.

In FIGS. 26 and 27, a clutch assembly 160 is assembled on a shaft 132, the clutch assembly has a plurality of plates with a circular central opening and an irregular circumference 160 and a plurality of plates 162 with a circular circumference and a non-circular central opening 164. As can best be seen from FIG. 27, the shaft 132 is free to rotate relative to the plates 160 and the central opening 164 of the plates 162 that has flat sides to conform to the shape of the shaft 132. The plates 162 will therefore rotate as the shaft rotates. The plates 160 are prevented from rotating by a stop 166. Between the stop 166 and a lowermost washer, is a spring washer 170. The stop 166 is held in place on a shaft 132 by pins 172 and a bottom plate 174. The pins 172 are threaded as are openings 176 in the drive gear 134. The pins 172 are preferably threaded and extend through openings 178 in the stop 166. The flanges 168 are sized to fit within slots 180 in the drive gear 134. Since the drive gear 134 is connected to the stop 166, if the plates 160 rotate, the stop 166 and the drive gear 134 will also rotate as will all of the gears shown in FIG. 25 that are driven by the drive gear 134.

The tighter that the pins 172 are turned into the openings 176, the more difficult it is to rotate the shaft 132 relative to the drive gear 134. The less tight that the pins 172 are in the openings 176, the easier it will be to rotate the shaft 132 relative to the drive gear 134. When the sleeves 72 in the locks 26 and 28 (not shown in FIGS. 26 and 27) and the sleeves 38 and the actuators 4 and 6 (not shown in FIGS. 26 and 27) reach either end of their travel along their universal screws 74 and 40 respectively (not shown in FIGS. 26 and 27), the drive gear 134, which eventually drives them, will no longer rotate. In that situation or in any other situation where the drive gear resists rotation, if the drive shaft 132 is rotated, when the force of friction of plates 160 and 162 is exceeded, the rotation of the drive shaft 132 will no longer cause the drive gear 134 to rotate. The tightness of the pins 172 is maintained after being set by the bottom plate 174, which holds the heads of the pins 172. The shaft 132 has a spherical upper end 182. A central opening 183 in the drive gear 134 has a shape, which is largely circular, with 6 equally shaped grooves located outside of that circular portion. The circular portion of the opening 183 allows the drive gear 134 to not rotate as the shaft 132 rotates without the clutch 136. The six grooves on a periphery of the central opening 183 are included to allow a repair technician to replace the shaft 132 with a hexagonal tool to bypass the clutch 136 (see FIG. 25) and rotate the drive gear 134 When the window is closed and locked, it becomes more difficult to rotate the drive gear 134. When the clutch is set up properly, the plates 162 will rotate but the drive gear 134 and the plates 160 will not rotate when the window is closed and the crank is continued to be rotated in the window closing direction.

Figure 28:
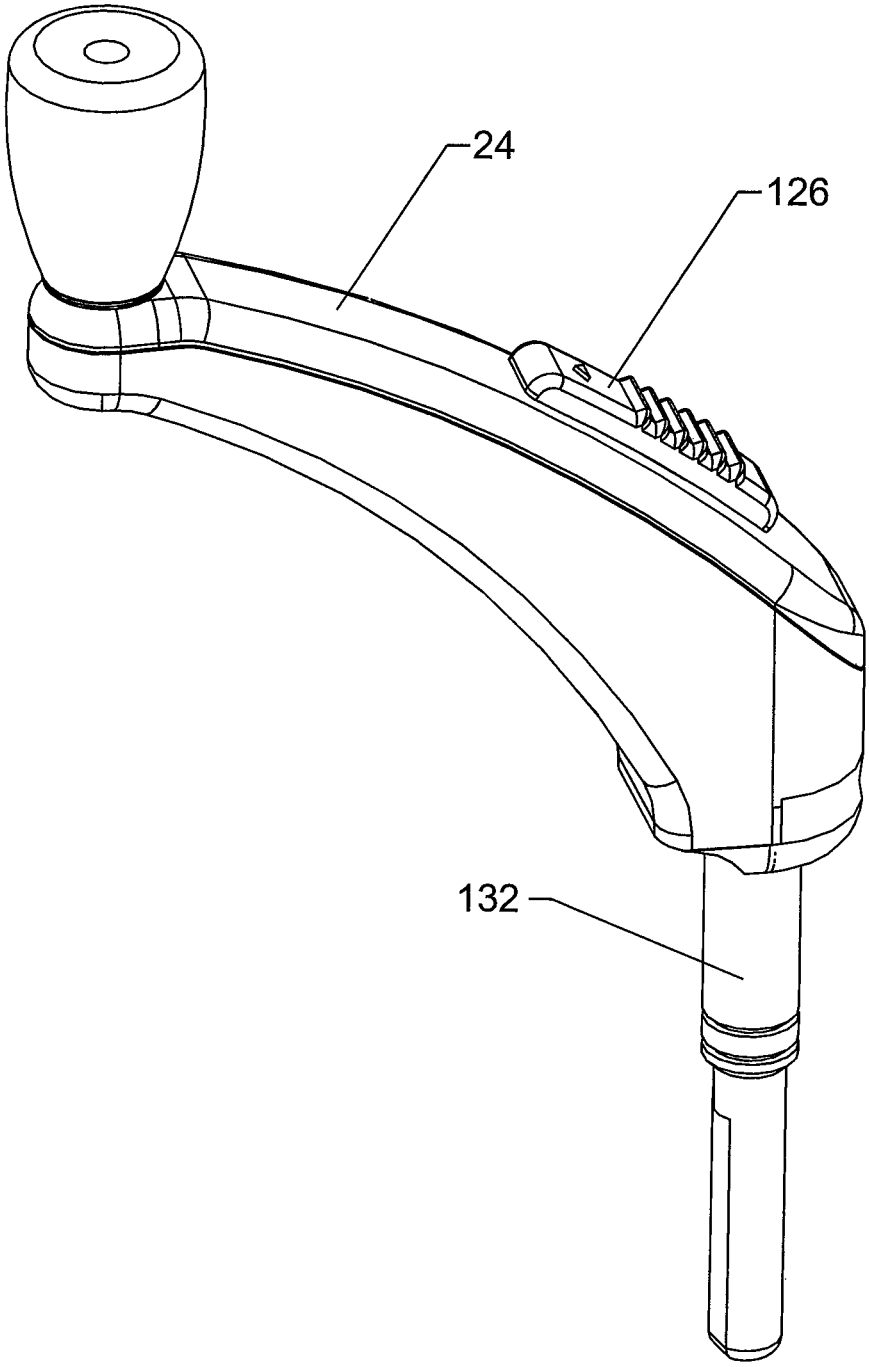
FIG. 28 is a perspective view of a crank with a shaft extending therefrom.
Figure 29A:
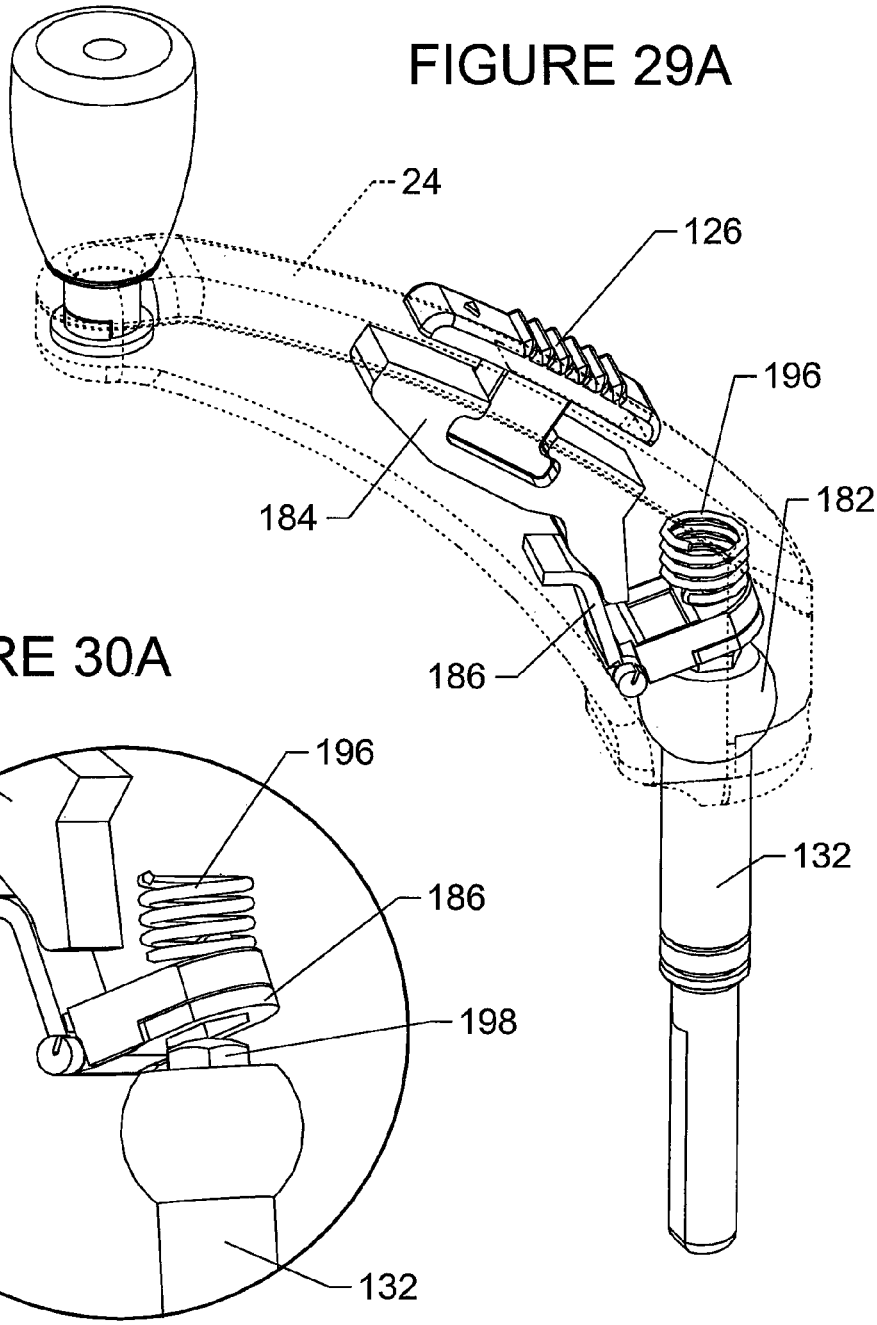
FIG. 29A is a perspective view of the crank and shaft with a housing of the crank shown with dotted lines to expose an interior in a disengaged position.
Figure 30A:
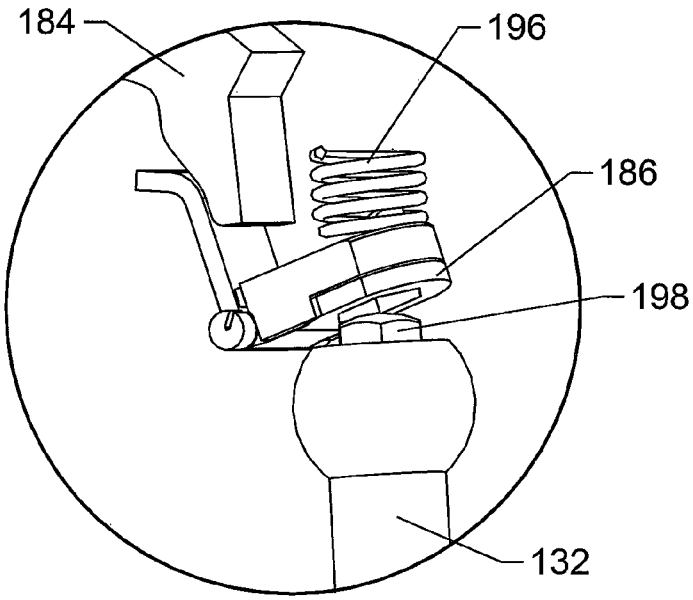
FIG. 30A is an enlarged perspective view of part of the interior of the crank in a disengaged position.
Figure 29B:
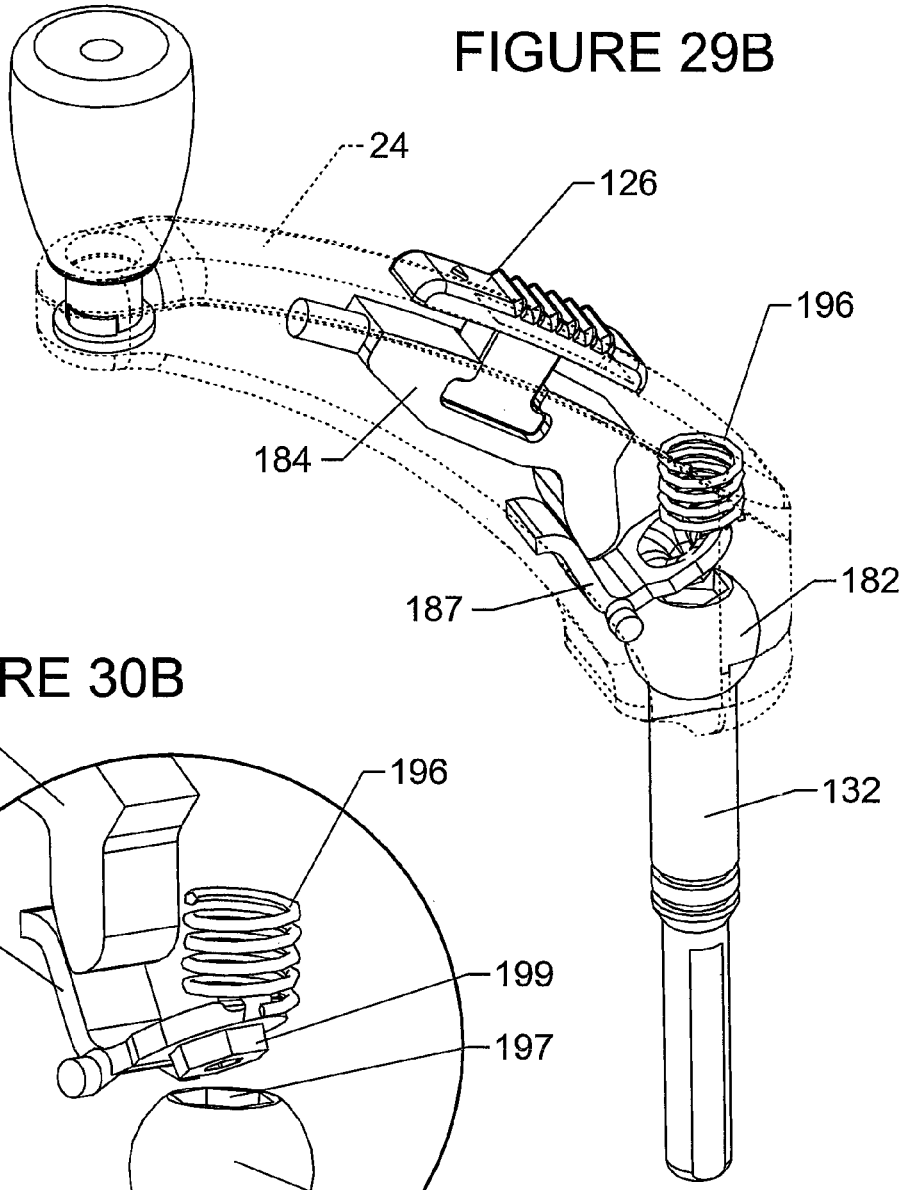
FIG. 29B is a perspective view of a further embodiment of the crank and shaft in a disengaged position.
Figure 30B:
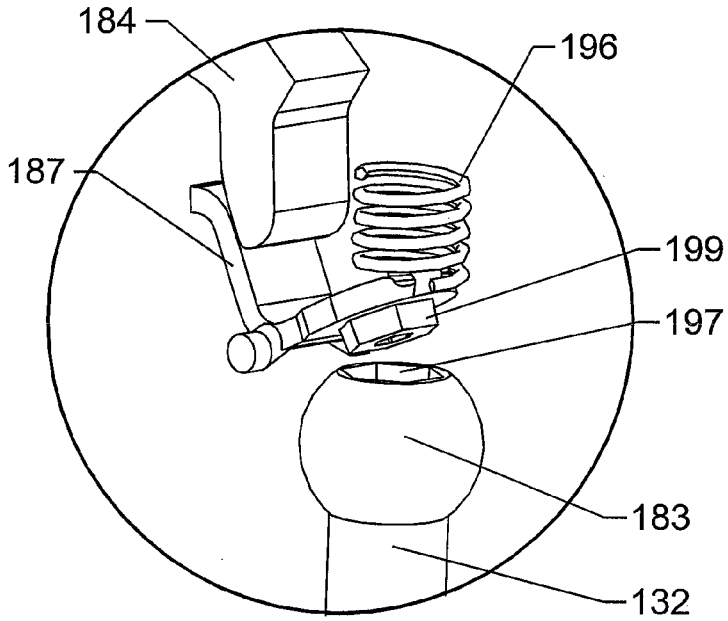
FIG. 30B is an enlarged perspective view of part of the interior of the crank shown in FIG. 29B in a disengaged position.
Figure 31:
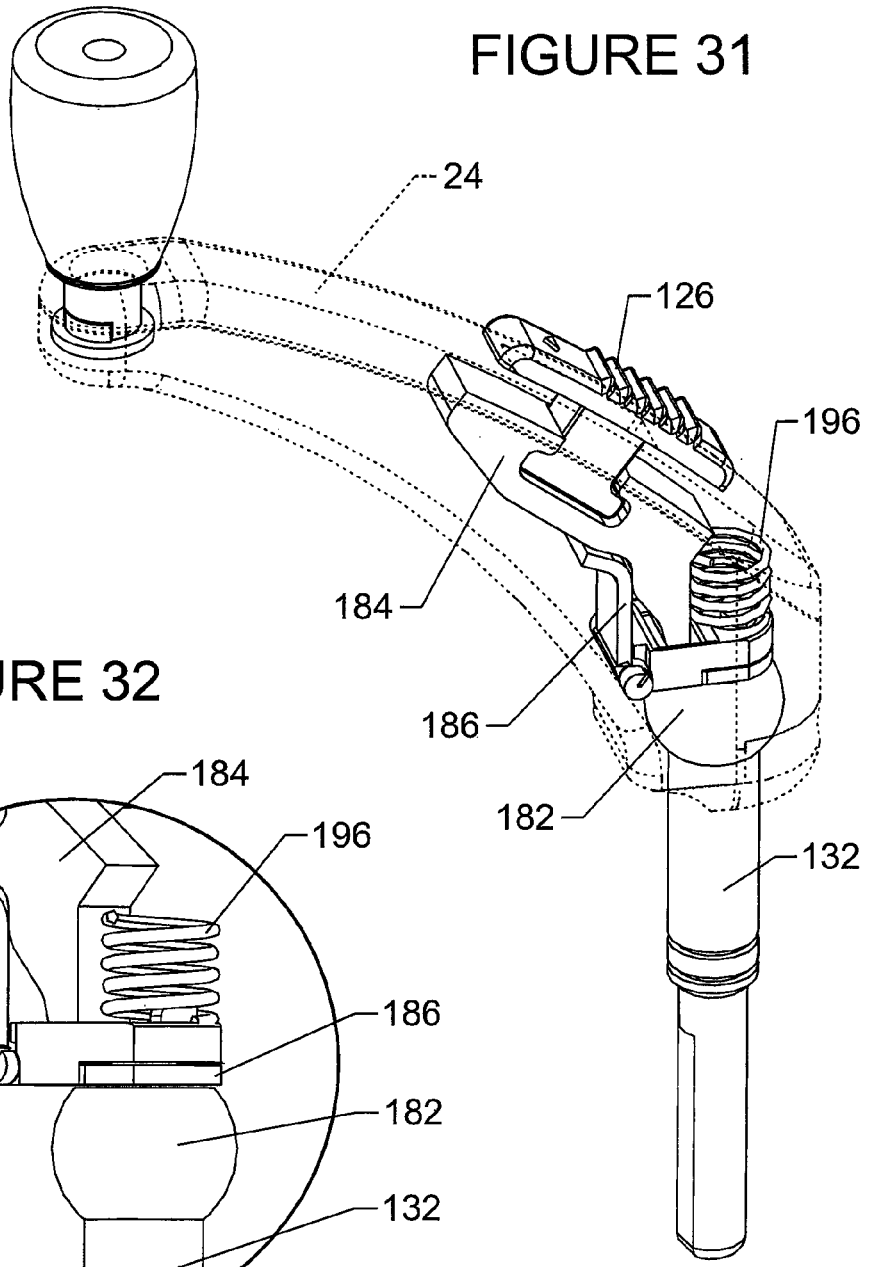
FIG. 31 is a perspective view of a crank shaft in an operating position where a housing of the crank is shown by way of dotted lines to expose the interior.
Figure 32:
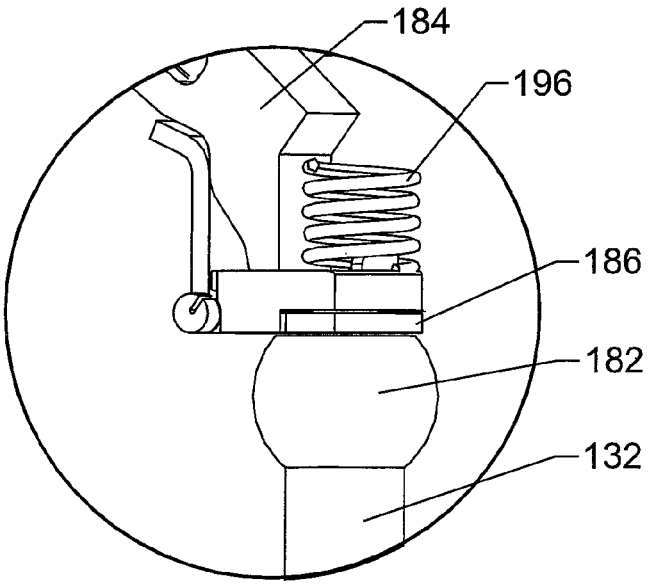
FIG. 32 is an enlarged partial perspective view of part of the interior of the crank in the operating position.

In FIG. 28, there is shown a crank 24 and a shaft 132 extending downward therefrom. In FIGS. 29A, 30A, 31 and 32, there is shown the crank and shaft of FIG. 28 with a housing of the crank shown in dotted lines to expose an interior. When the button 126 is moved toward a free end of the crank 24, a lever 184 pivots a holding bracket 186 as shown in FIGS. 29 and 30 to allow the crank 24 to be pivoted downward relative to the shaft 132 to a folded position. Moving the button 126 toward the free end tilts the bracket 186. When the crank 24 is in the folded position, it can slide on the spherical upper end 182 and can be returned to the operating position as shown in FIGS. 29 to 32 simply by pivoting the crank to the operating position. When the crank is in the operating position, a spring 196 will bias the bracket 186 onto a hexagonal protrusion 198 on top of the spherical end 182 as shown in FIGS. 31 and 32. FIGS. 29B and 30B differ from 29A and 30A in that a spherical end 183 of the shaft 132 has a hexagonal depression 197 and a bracket 187 has a protrusion 199 thereon that is sized to fit into the hexagonal depression 197 when the crank 24 is in the operating position. The same reference numerals are used in FIGS. 29B and 30B as those used in FIGS. 29A and 30A for those components that are identical or at least similar. The embodiment shown in FIGS. 29B and 30B is the preferred embodiment and operates in the same way as described for the embodiment shown in FIGS. 29A, 30A, 31 and 32. Drawings corresponding to FIGS. 31 and 32 have not been provided for the embodiment of FIGS. 29B and 30B. The embodiment shown in FIGS. 29B and 30B can easily be substituted into FIGS. 31 and 32 and will look almost identical when the crank 24 is in the operating position.

Figure 33:
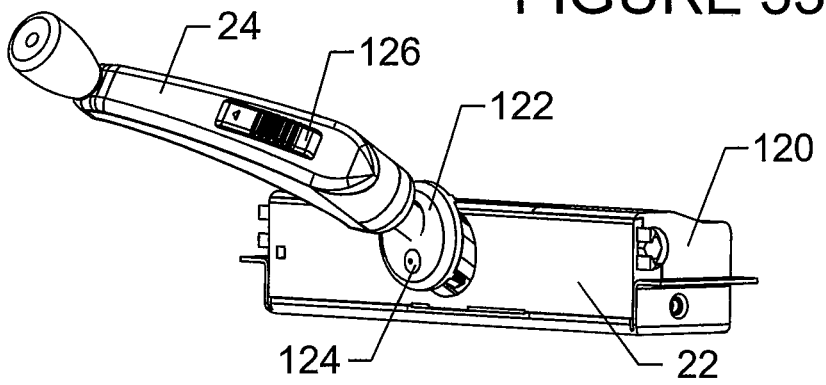
FIG. 33 is a perspective view of a crank assembly with the crank in an operating position.
Figure 34:
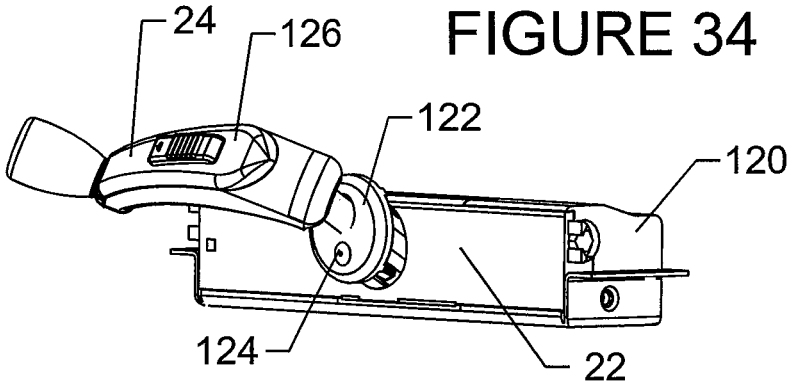
FIG. 34 is a perspective view of a crank assembly with the crank in a first folded position.
Figure 35:
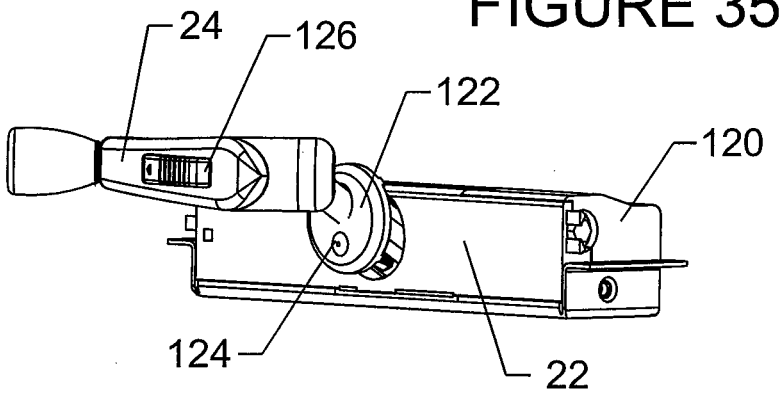
FIG. 35 is a perspective view of a crank assembly with the crank in a second folded position.
Figure 36:
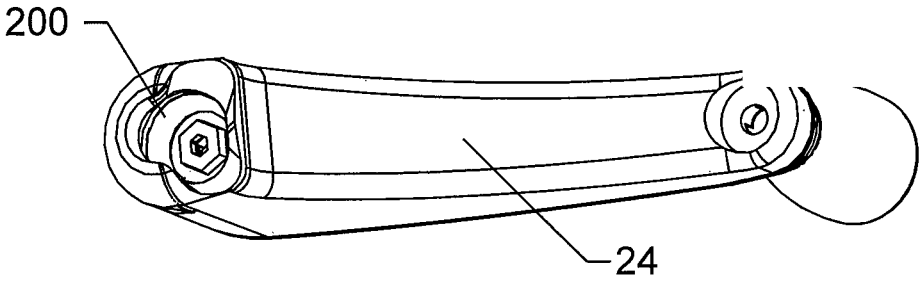
FIG. 36 is a perspective view of the crank when viewed from a bottom.
Figure 37:
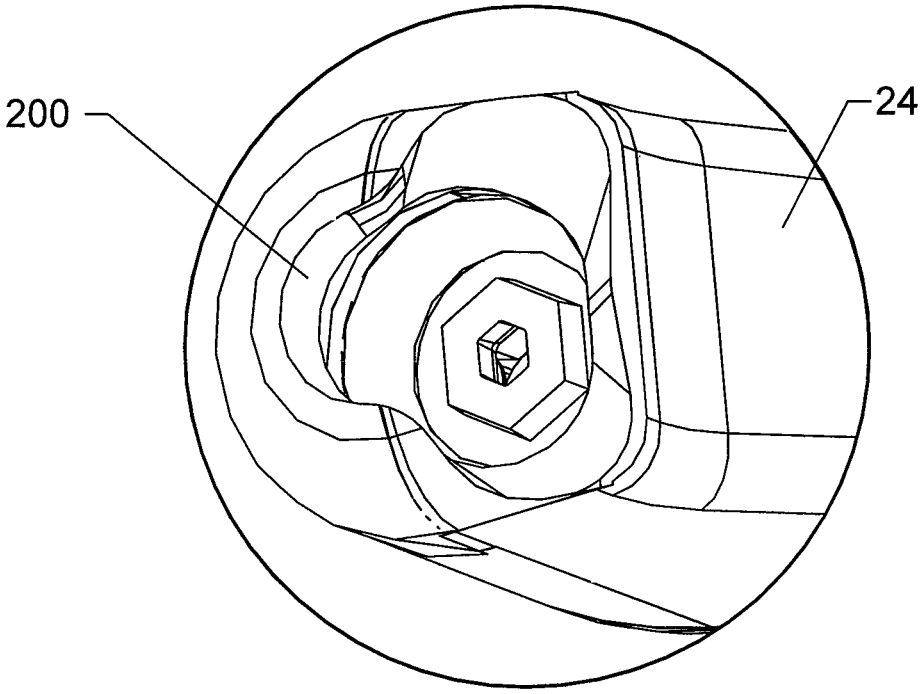
FIG. 37 is an enlarged partial perspective view of an opening in the bottom of the crank.

In FIG. 33, the crank 24 is shown in the operating position. In FIG. 34, the crank is shown in a first folded position and in FIG. 35, the crank 24 is shown in a second folded position. In the first folded position the crank is pivoted downward from the operating position. In the second folded position, the crank is pivoted to one side from the first folded position. In FIG. 36 and FIG. 37 there is shown an enlarged view of a bottom of a crank 24. It can be seen that an opening 200 is a three-sided opening in order to limit the movement of the crank 24 to one or more folded positions when the crank is released from the operating position. The opening 200 limits the movement of the crank 24 so that the crank will easily return to the operating position when the crank is raised toward that position from the folded position.

Figure 38:
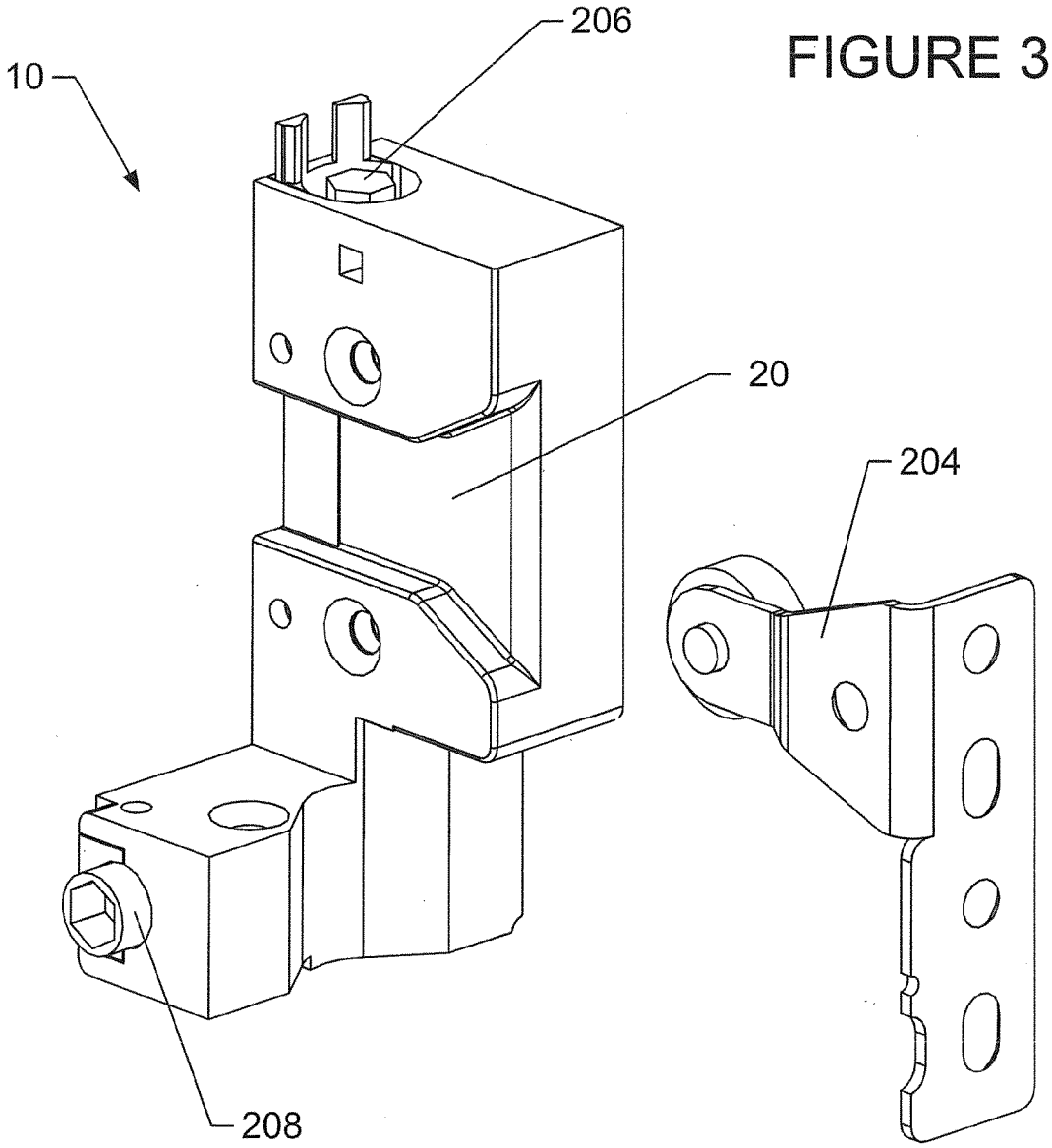
FIG. 38 is a perspective view of a corner transfer and guide.

In FIG. 38, there is shown a perspective view of the corner transfer 10 having the channel 20 therein to receive a guide 204 that is mounted on the window sash (not shown in FIG. 38). The corner transfer 10 has a hexagonal projection 206 and a receptacle 208. The receptacle 208 is a female end.

Figure 39:
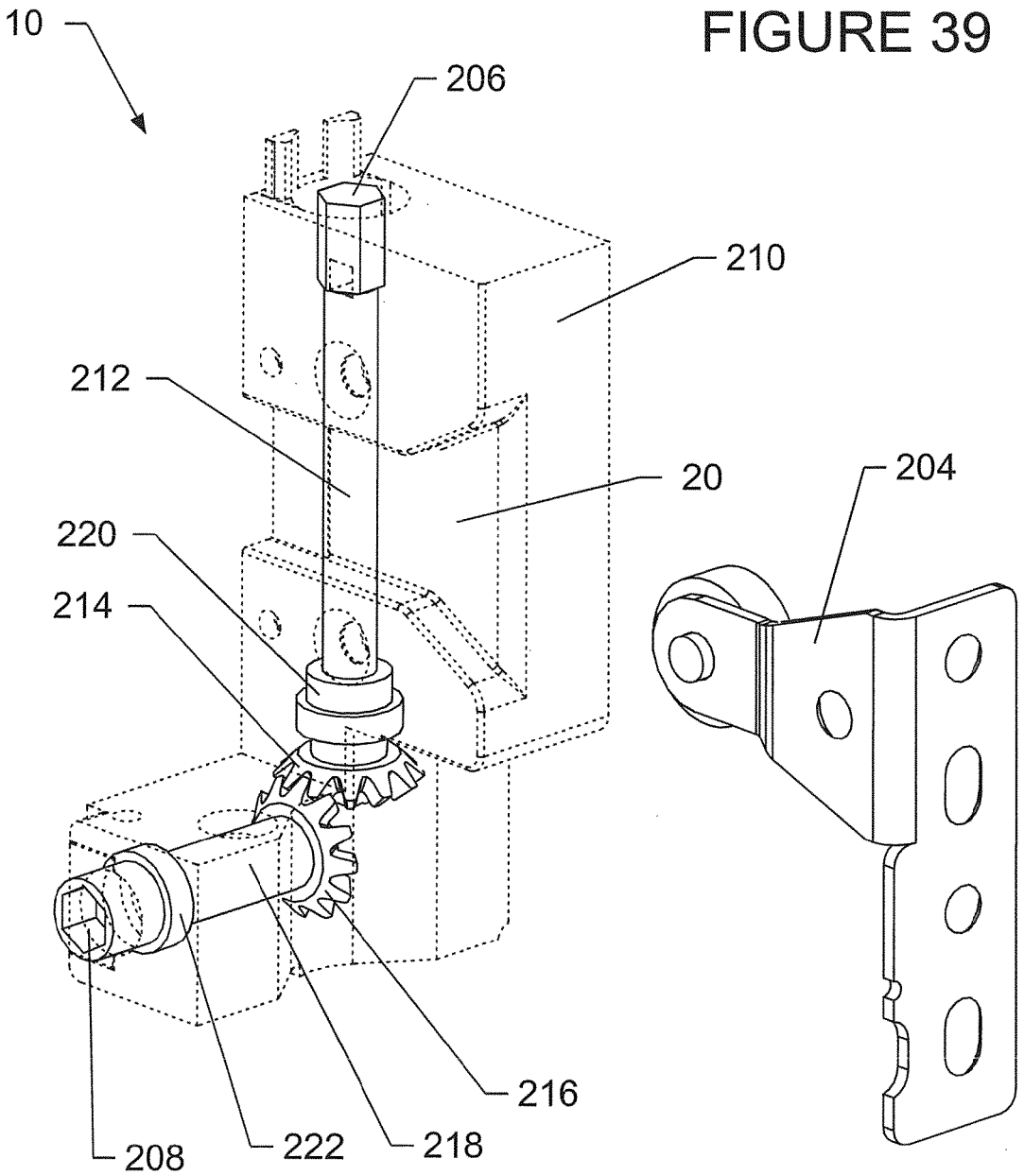
FIG. 39 is a perspective view of the corner transfer and guide of FIG. 38 with a housing of the corner transfer shown by way of dotted lines to expose an interior.

FIG. 39 is identical to FIG. 38 except that a housing 210 of the corner transfer 10 is shown in dotted lines to expose an interior. The hexagonal projection 206 is connected to a rotatable elongated member 212 having a gear 214 at an inner end thereof. The gear 214 intermeshes with a gear 216 connected to a rotatable longitudinal member 218 having an outer end receptacle 208. The receptacle 208 is a female end. The elongated member 212 has a collar 220 and the elongated member 218 has a collar 222. The elongated members 212, 218 are perpendicular to one another to enable the corner transfer 10 to transmit rotational energy around a corner transfer of the frame (not shown) of the window (not shown). The corner transfers 8, 10, 16, 18 shown in FIG. 1 are essentially identical to one another except for the orientation of the channel 20 and except that corner transfers 8 and 10 are shaped to fit against and connect directly to actuators 4 and 6.

Figure 40:
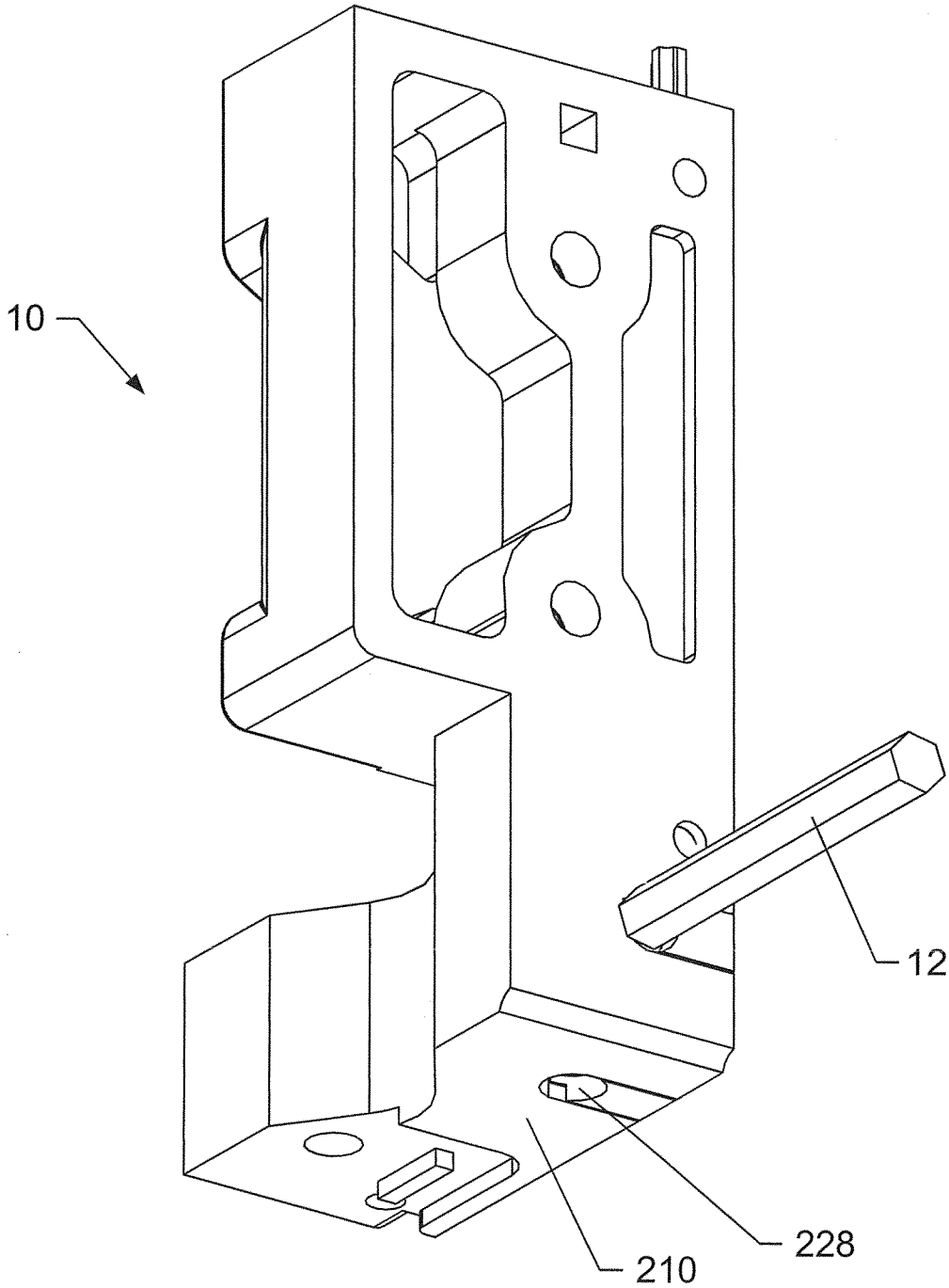
FIG. 40 is a perspective view of a corner transfer when viewed from an outside.
Figure 41:
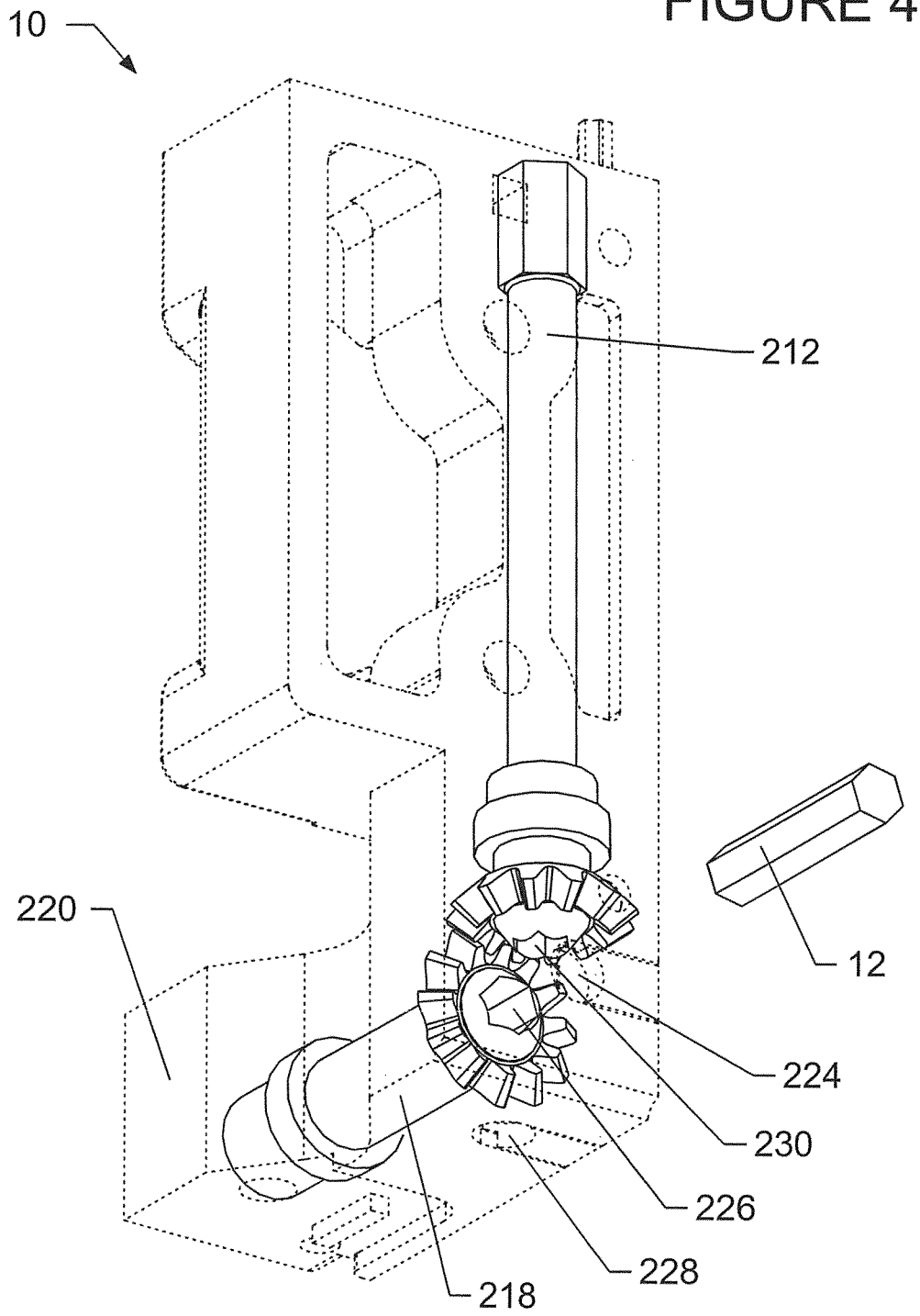
FIG. 41 is a perspective view of the corner transfer of FIG. 40 with the housing shown in dotted lines to expose an interior.

In FIGS. 40 and 41 it can be seen that the housing 210 of the corner transfer 10 has a horizontal opening 224 therein that is aligned with the elongated member 218. The elongated member 218 also has an opening 226 therein at the gear end of said member. The opening 226 has a hexagonal shape and is sized to receive the connecting rod 12, which is inserted through the opening 224 and into the opening 226. Similarly, if desired, but not shown in the drawings, a connecting rod 12 can be inserted through an opening 228 in the housing 210 and into a hexagonal opening 230 in the gear end of the elongated member 212. Connecting rods 12 cannot be simultaneously inserted into the openings 226 and 230 but can only be inserted into one of the two openings at any given time. The purpose of the openings 224, 226, 228, and 230 is to connect the corner transfers and therefore the window systems of two separate windows together so that both windows can be controlled by the same crank. The windows might be horizontally apart from one another or vertically apart from one another or both, and can be interconnected through connecting rods. All four corner transfers preferably have this interconnecting feature even though it is only described for corner transfer 10.

Figure 42:
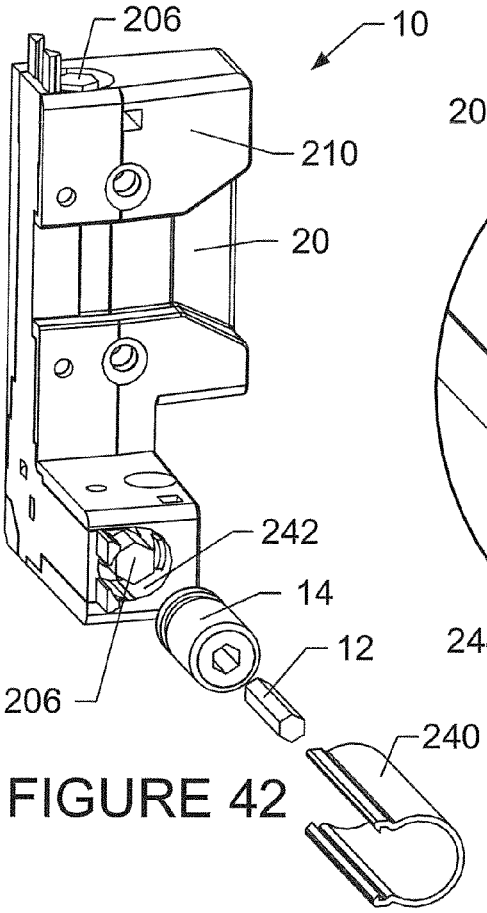
FIG. 42 is a perspective view of a corner transfer with a collar and connecting rod.
Figure 43:
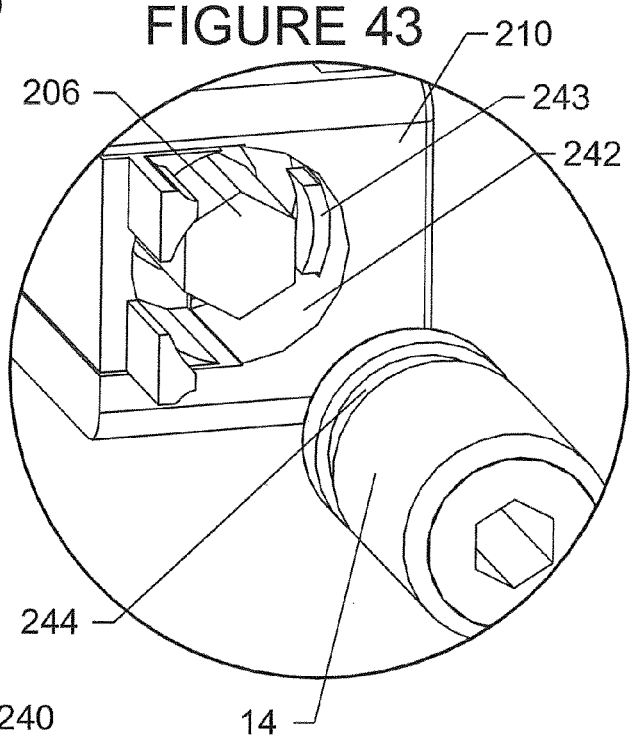
FIG. 43 is an enlarged view of part of the corner transfer and collar of FIG. 42.
Figure 44:
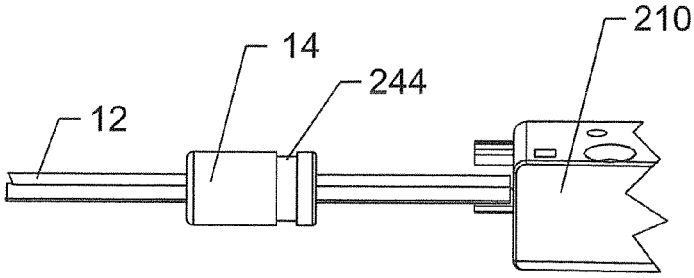
FIG. 44 is a perspective view of part of the rod, collar and corner transfer with the collar separate from the corner transfer.
Figure 45:
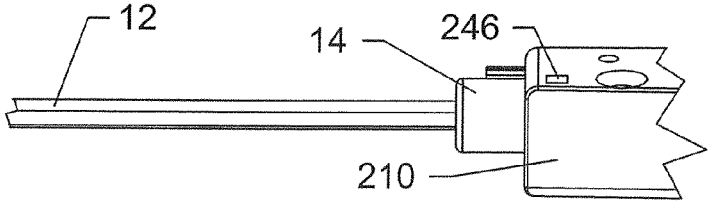
FIG. 45 is a perspective view of part of the connecting rod, collar and corner transfer with the collar and rod installed in the corner transfer.

In FIG. 42, the corner transfer 10 has hexagonal projections 206 about the horizontal end and the vertical end. A collar 14 can be inserted over the hexagonal projection 206 and the collar 14 can receive a connecting rod 12. When the collar is inserted over the hexagonal projection 206, it snaps into place. The connecting rod 12 and collar 14 are covered by a shield 240 after they have been properly installed. A partial enlarged view of the hexagonal projection 208 and collar 14 are shown in FIG. 43. As shown in FIGS. 44 and 45, the collar 14 is slidably installed over a suitable length of connecting rod 12. The connecting rod is then held against the hexagonal projection 206 and the collar is manually pushed into an opening 242 (not shown in FIGS. 44 and 45) surrounding the hexagonal projection 206 (not shown in FIGS. 44 and 45). The collar snaps into place within the opening 242 as a spring loaded projection 243 (see FIG. 43) enters a radial channel 244 on the collar 14. In order to release the collar 14 from the opening 242, the spring mounted projection must be retracted by inserting an elongated member through an opening 246 in the housing 210. This same collar arrangement is used on one end of the actuators 4, 6 and on both ends of the locks 26, 28 and the crank assembly 22 of FIG. 1 (not shown in FIG. 42).

Figure 46:
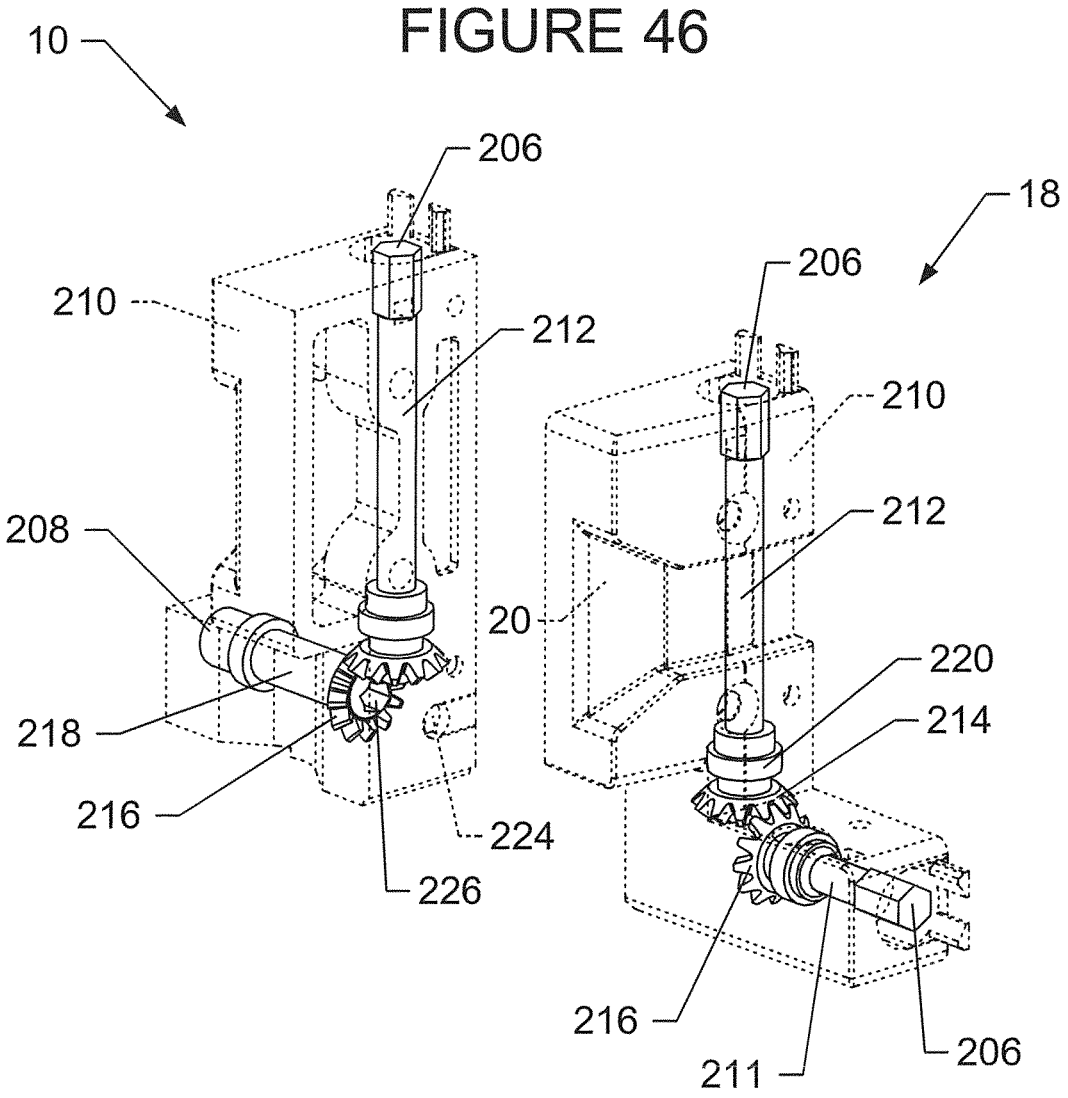
FIG. 46 is a perspective view of two corner transfers located back to back from one another with the housing shown in dotted lines to expose an interior.
Figure 47:
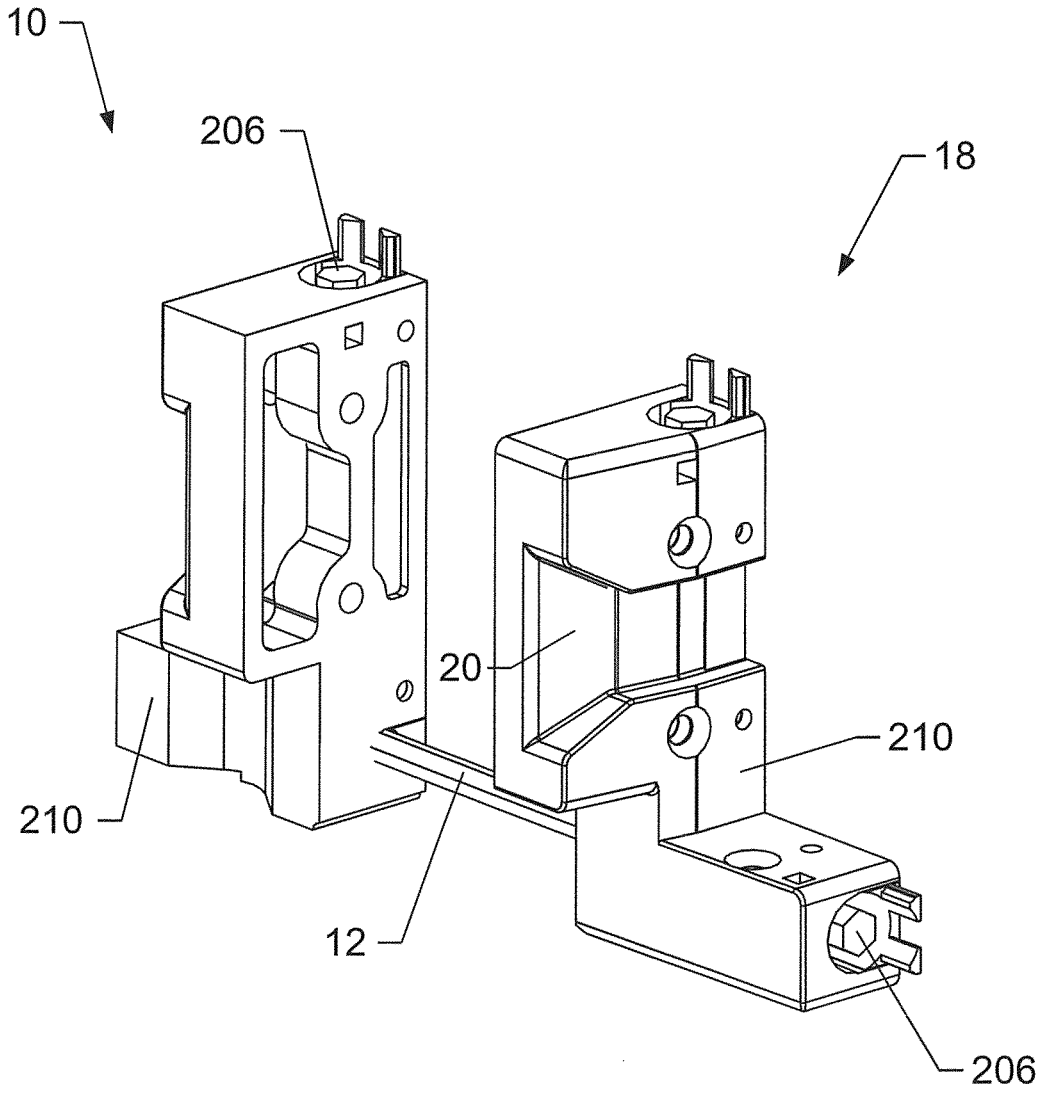
FIG. 47 is a perspective view of the corner transfers and connecting rods shown in FIG. 46 with the housings shown as solid and a connecting rod located between the two corner transfers.
Figure 48:
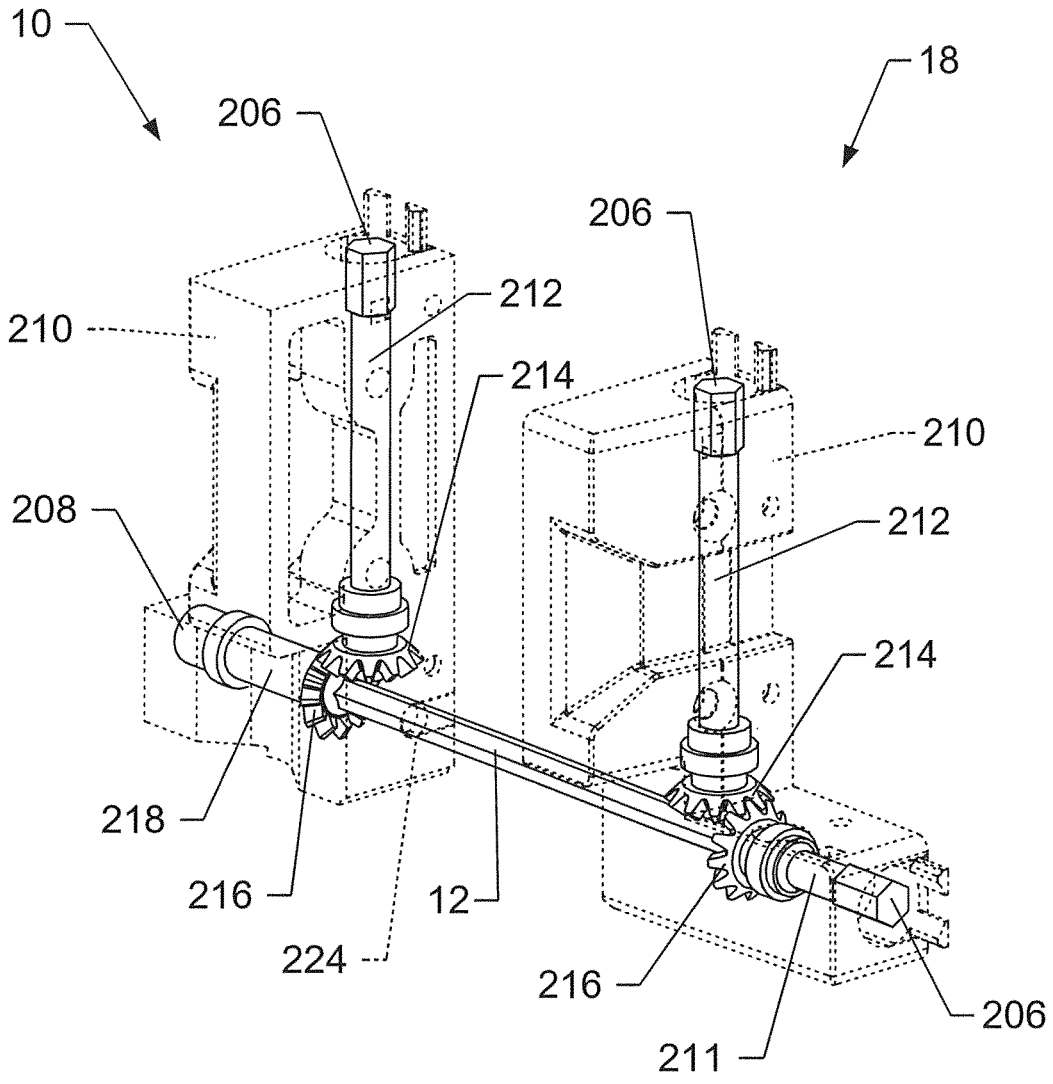
FIG. 48 is a perspective view of the two corner transfers of FIG. 47 with the housings of the corner transfers shown in dotted lines to expose an interior.

In FIGS. 46, 47 and 48, two corner transfers 10, 18 are shown as being oriented back to back. The two corner transfers 10, 18 each have dotted housings 210 to expose an interior. The corner transfer 10 is mounted within the frame of a first window (not shown) and the corner transfer 18 is mounted in the frame of a second window (not shown). The corner transfer 18 has a rotatable elongated member 211 extending between the gear 216 and the hexagonal projection 206. The elongated member 218 has the receptacle 208, which is a female end. The first and second windows are located side by side. The operating systems for each of the first and second windows can be joined together by installing a connecting rod 12 through the openings 224 and 226 of each of the corner transfers 10, 18 as shown in FIGS. 47 and 48. When the connecting rod is installed, the two windows (not shown) can be unlocked, opened, closed and locked simultaneously using the crank assembly (not shown) of only one of the windows. When the two operating systems are joined together, only one cranking assembly is required to operate both windows. Whether or not to join windows together will depend on the proximity and the size of the windows as well as the desirability of always opening and closing the windows simultaneously. Just as the operating systems of two windows can be joined together, three or more adjacent windows can also be joined together.

Figure 49:
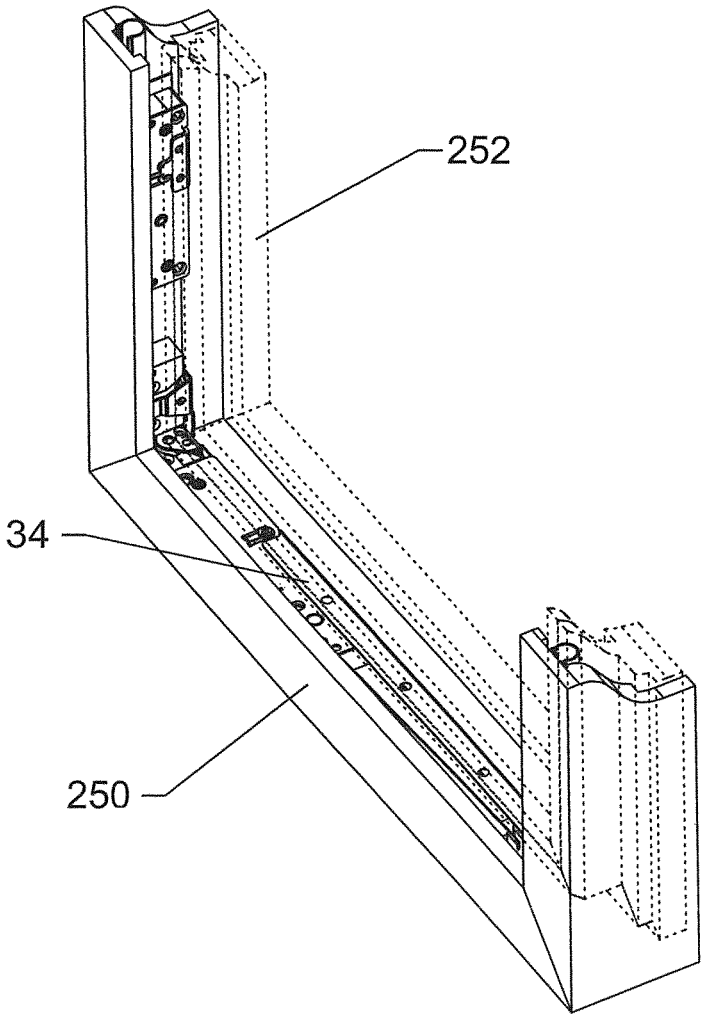
FIG. 49 is a partial perspective view of a window frame and sash in a closed position and the sash shown in dotted lines.
Figure 50:
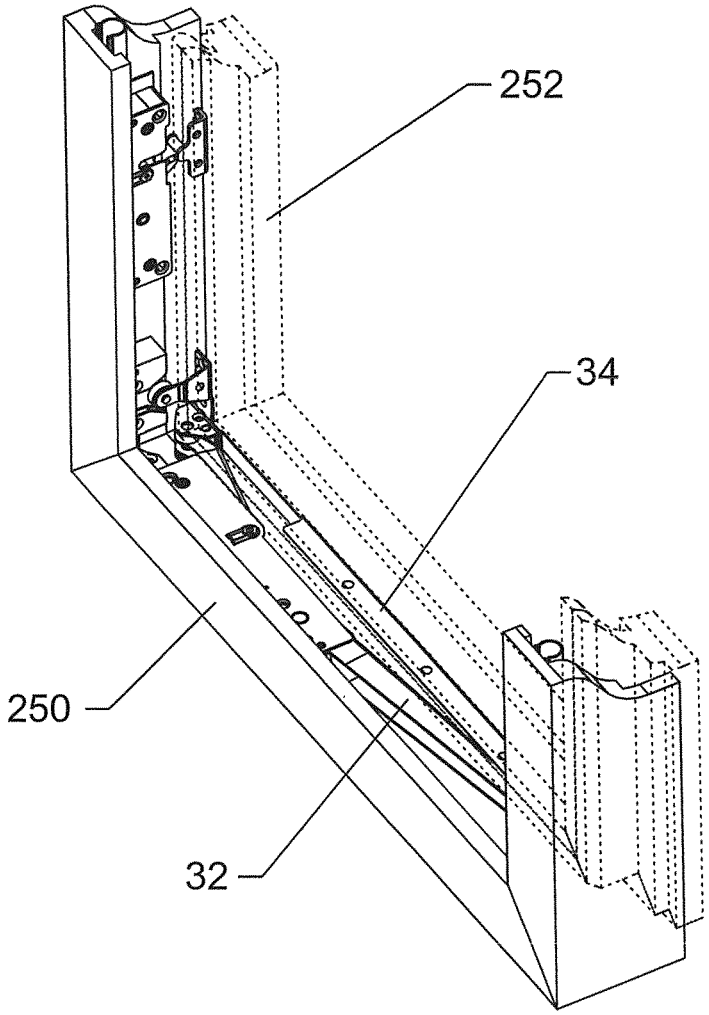
FIG. 50 is a partial perspective view of the window frame and sash in FIG. 49 with the sash in a slightly open position.

In FIGS. 49 to 52, there are shown partial perspective views of a window frame 250 and a sash 252 the same reference numerals are used in FIGS. 49 to 52 as those used in FIGS. 1, 17 and 38 to describe those components that are identical. The sash 252 is shown by way of dotted lines to expose parts of the operating system. No crank assembly is shown in the four figures, but the window operating system has a crank assembly located on a portion of the frame 250 that is not shown in the drawings. In FIG. 49, the sash 252 is in a closed position relative to the frame 250. In FIG. 50, the sash is slightly open and it can be seen that the sash has moved substantially perpendicularly outward from the frame 250.

Figure 51:
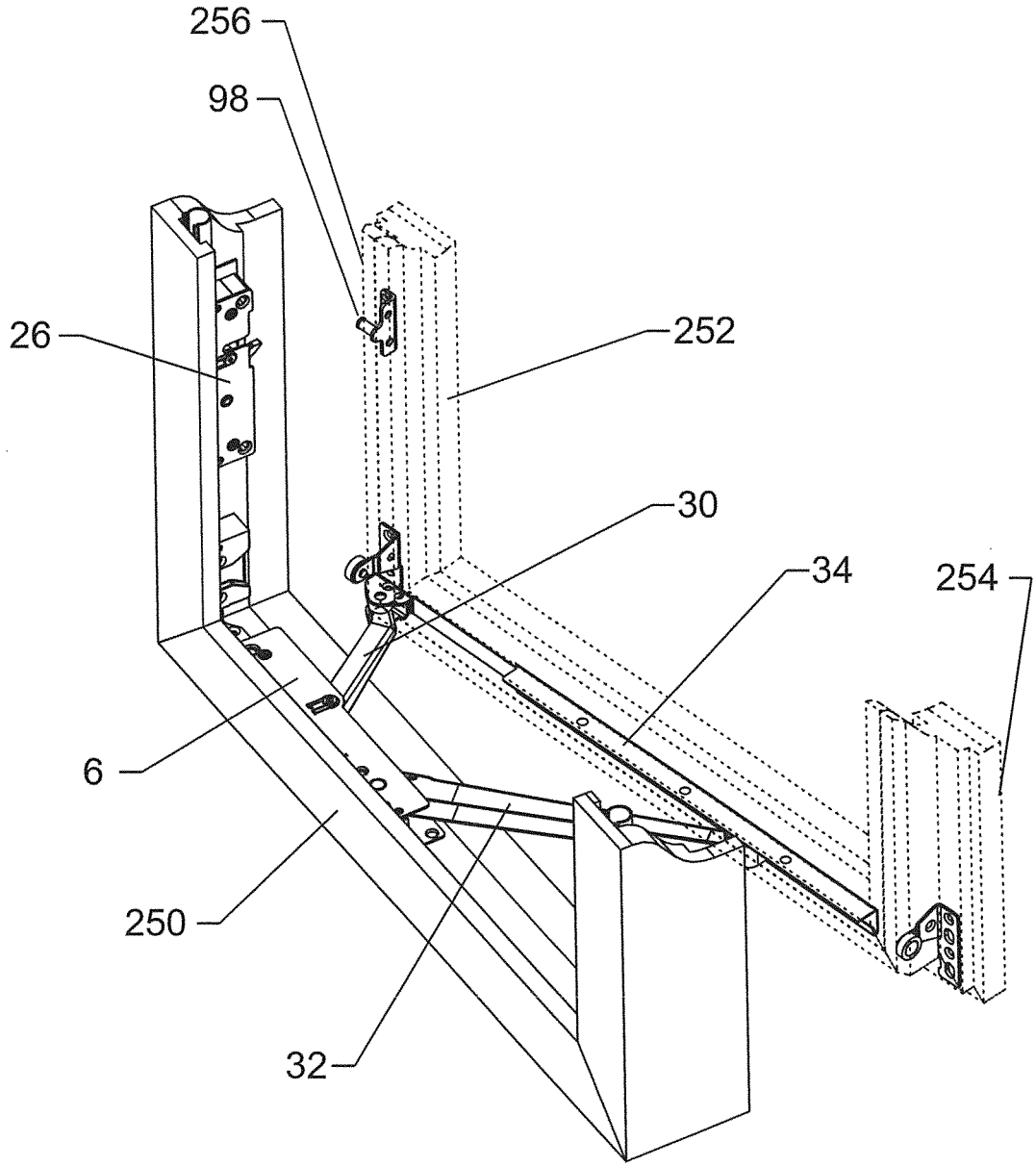
FIG. 51 is a partial perspective view of the frame and sash shown in FIG. 50 with the sash in a further open position.
Figure 52:
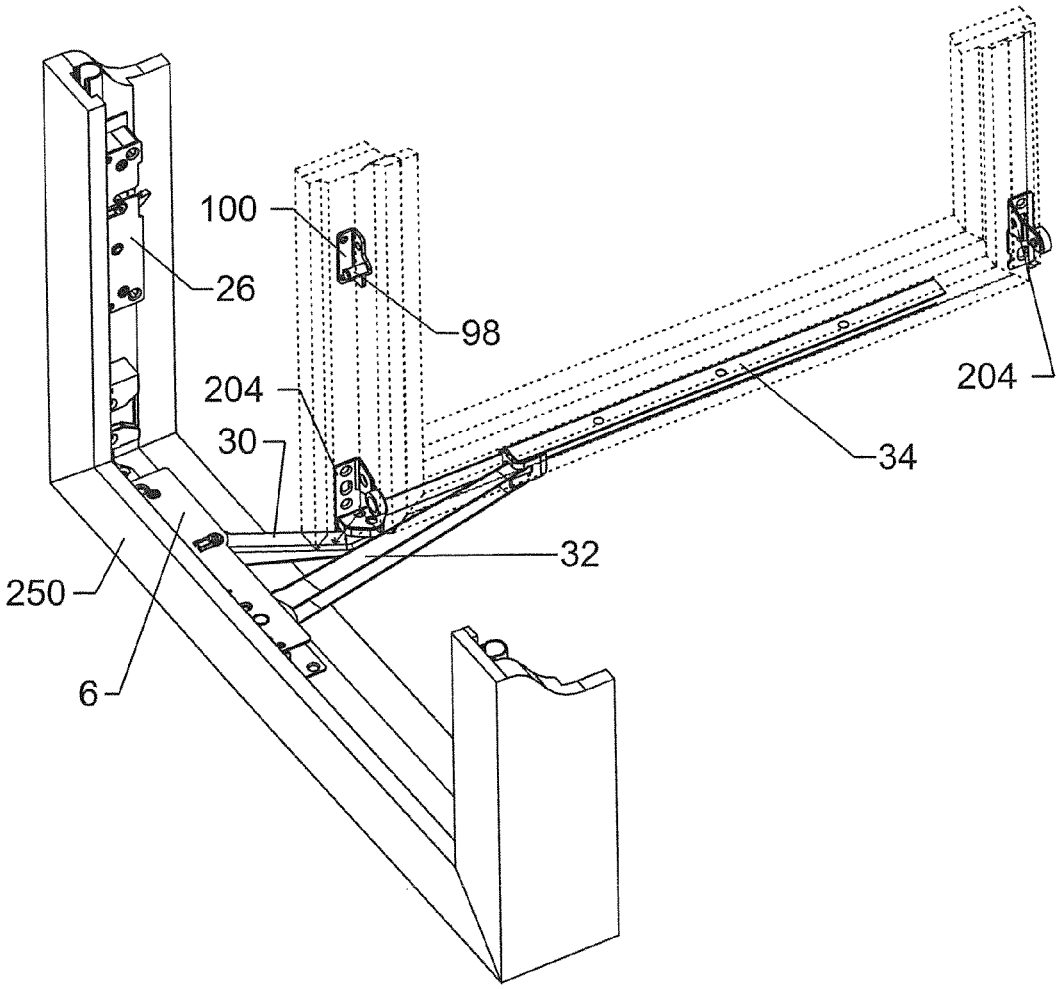
FIG. 52 is a partial perspective view of the frame and sash shown in FIG. 51 with the sash in a fully open position.

In FIG. 51, the sash 252 has opened still further relative to the frame 250 and is at a slight angle to the frame. In FIG. 52, the sash 252 is in the fully open position relative to the frame 250 and comparing FIGS. 51 and 52, an outer edge 254 of the sash 252 has rotated about an inner edge 256. The inner edge 256 is located beyond an outer most edge 258 of the frame 250 in both FIGS. 51 and 52. The inner edge 256 has also moved toward a center from the sides of the frame and the sash 252 is substantially perpendicular in the fully open position. An outer surface of the glass (not shown) located within the sash can be cleaned when the window is fully open. The same reference numerals are used in FIGS. 49 to 52 as those used in FIGS. 1 to 48 for those components that are identical. The inner edge 256 and the outer edge 254 are two opposing edges of the sash 252 that are not connected to the actuator. When the sash initially opens relative to the frame, the two opposing edges 254, 256 are substantially equidistant from the frame 250 from a closed position to a first open position. The sash 252 is movable from the first open position to a fully open position whereby the outer edge 254 of the sash 252 rotates about the inner edge 256 which moves towards a middle of the frame 250. This movement can also be seen in FIGS. 8 to 14 which successively show the actuator moving from the fully open position to the fully closed position.

In FIGS. 53 to 58, there are shown several perspective views of a further embodiment of a lock 260 having a release mechanism 262. The release mechanism 262 has a release bracket 264 and a release pivot 266. The release pivot 266 pivots about a pivot axis 268 and has a faceplate 270 that is fixed to a locking plate 272. The faceplate 270 contains an oblong opening 271 to receive a flat head screwdriver or similar tool (not shown) that is sized and shaped to fit within the oblong opening 271.

The locking plate 272 has a protrusion 274 that is sized to fit within a slotted opening 276 of the release bracket 264.

Figure 53:
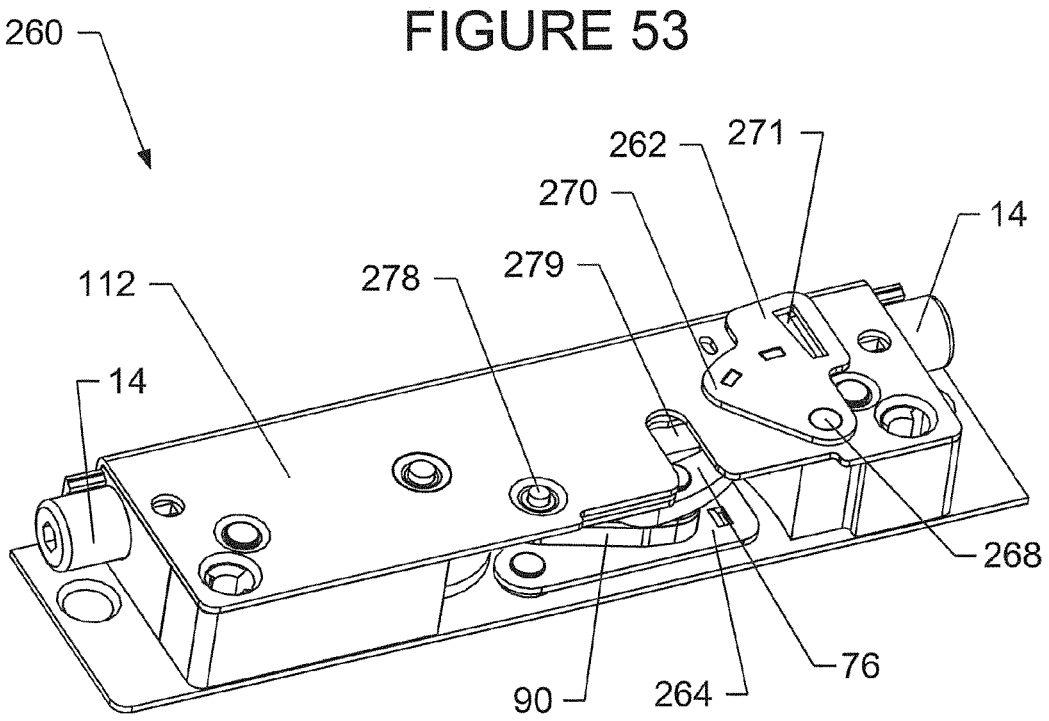
FIG. 53 is a perspective view of a further embodiment of a lock in a locked position.
Figure 54:
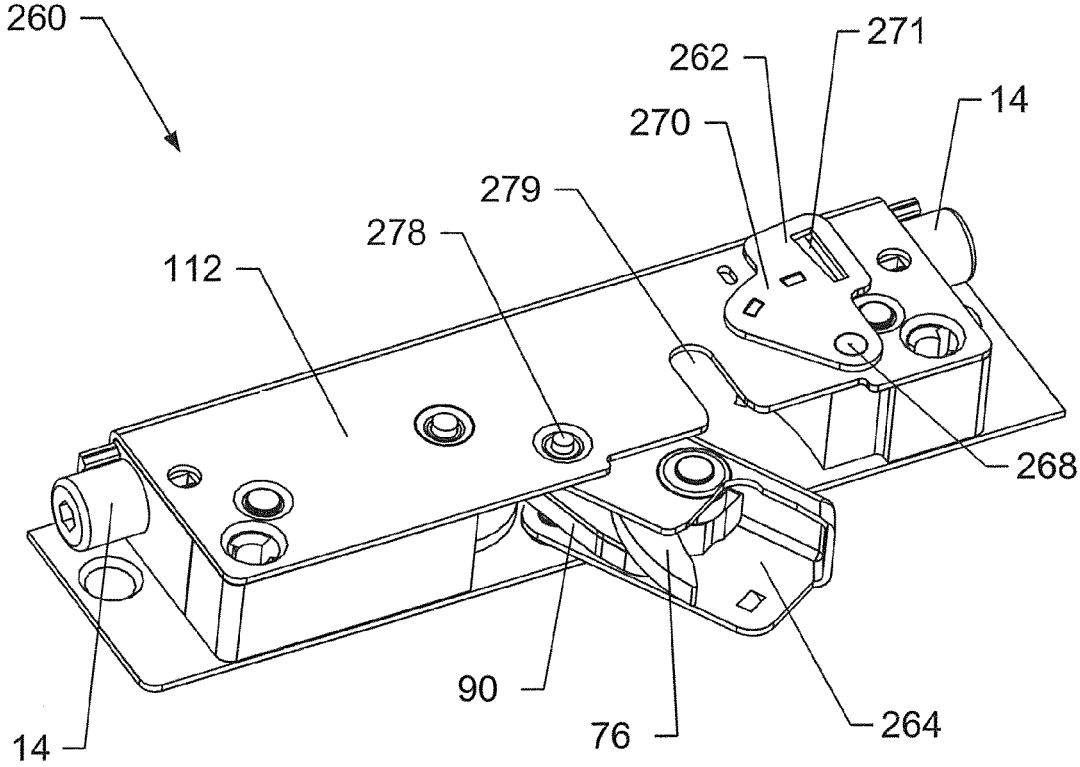
FIG. 54 is a perspective view of the lock shown in FIG. 53 in a released position.
Figure 55:
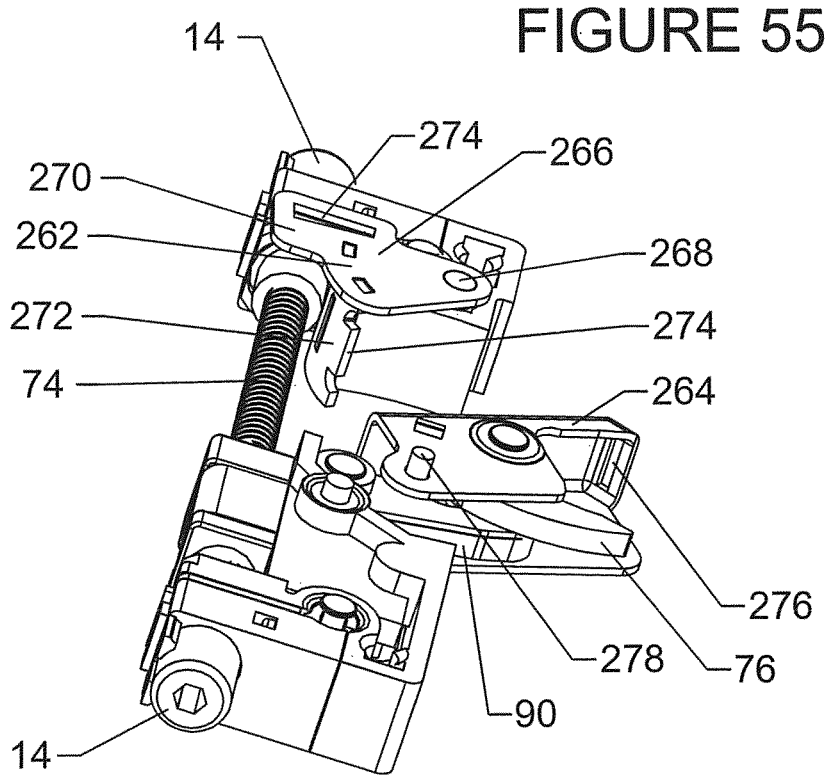
FIG. 55 is a perspective view of the lock shown in FIG. 54 with a cover removed.
Figure 56:
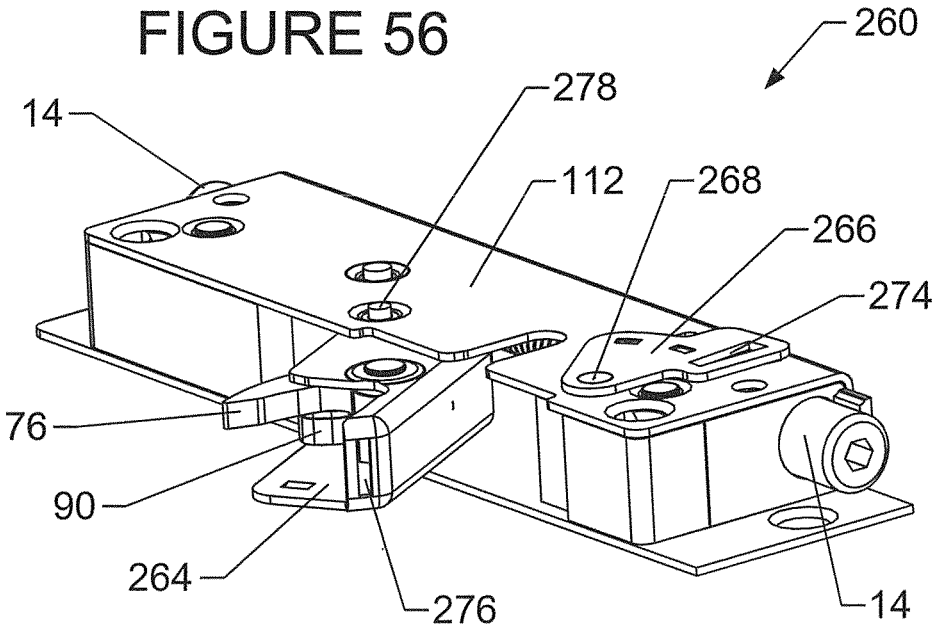
FIG. 56 is a perspective view of the lock shown in FIG. 54 from a different angle.
Figure 57:
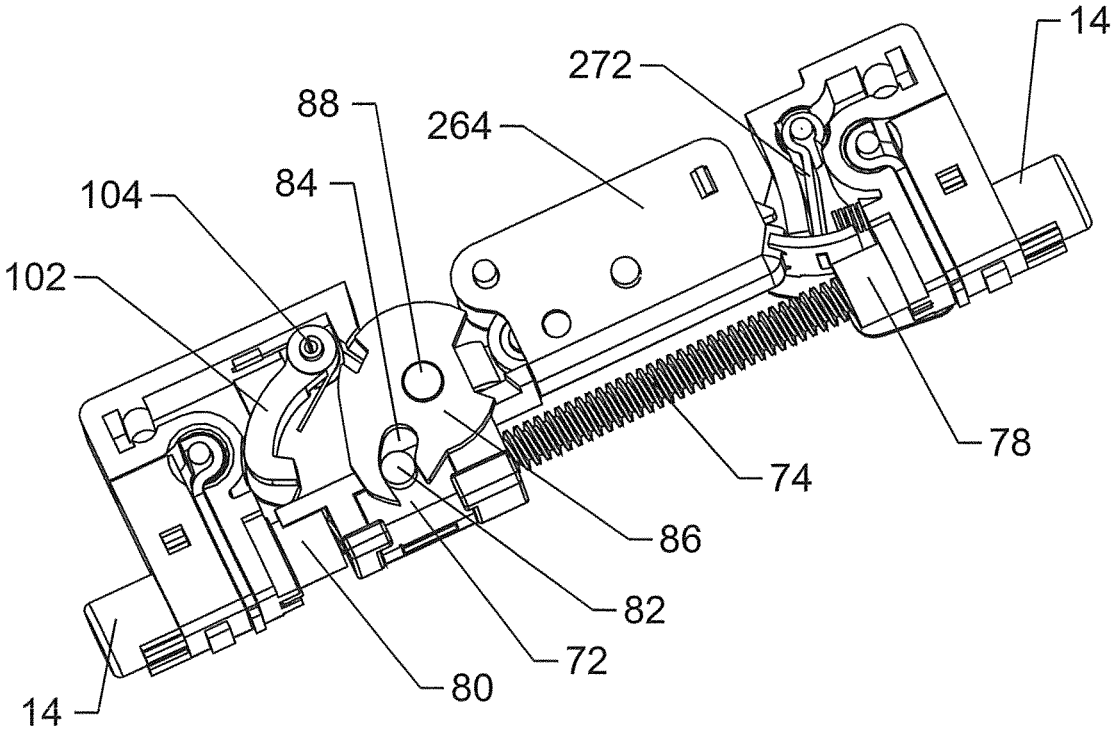
FIG. 57 is a perspective view of the lock in a locked position with the cover removed.
Figure 58:
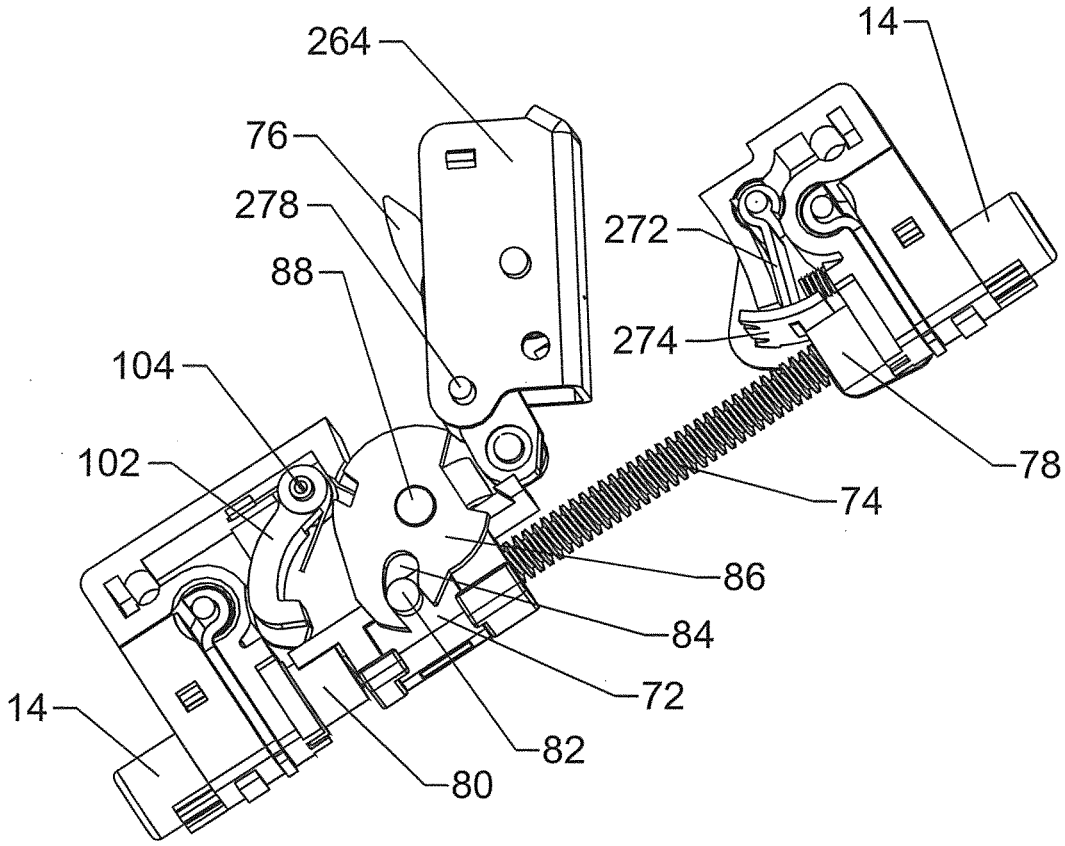
FIG. 58 is a perspective view of the lock with the cover removed in a released position.

The release bracket 264 can be pivoted on a pivot axis 278 between an unreleased position shown in FIGS. 53 and 57 and a released position shown in FIGS. 54, 55, 56, and 58. The same reference numerals are used as those used in FIGS. 15 to 22 for those components that are identical. The clasp 76 and third pivot arm 90 are mounted within the release bracket 264. The housing 112 shown in FIGS. 53, 54, 56 is removed in FIGS. 55, 57 and 58. The housing 112 has a slot 279 therein to receive a keeper (not shown in FIGS. 53 to 58).

In FIG. 59 there is shown a perspective view of the release bracket 264 which has openings 280 therein that are aligned with one another along the pivot axis 278.

In FIG. 60 there is shown a perspective view of the release pivot 266 having a pivot axis 268, in a faceplate 270 with an oblong opening 271 and a locking plate 272. The locking plate 272 is affixed to the faceplate 270 and has the protrusion 274.

In FIG. 61, there is shown a different orientation of the release bracket 264 from that shown in FIG. 59. In FIG. 62, there is shown a different orientation of the release pivot 266 from that shown in FIG. 60. The same reference numerals are used in FIGS. 61 and 62 as those used in FIGS. 59 and 60.

In FIGS. 63 and 64, the release bracket 264 and release pivot 266 are connected to one another in the unreleased position with the protrusion 274 located in the slotted opening 276. The same reference numerals are used in FIGS. 63 and 64 as those used in FIGS. 59 to 62.

In operation, if the window operating system should fail when the system is in a locked position, the release mechanism described in FIGS. 53 to 64 allows a user to release the lock by inserting a flat head screwdriver or similar tool (not shown) into the oblong opening 271 in the faceplate 270 of the release pivot 266. The screwdriver is twisted in a clockwise direction which imparts a clockwise motion to the release pivot 266 about the pivot axis 268, thereby removing the protrusion 274 from the slotted opening 276. The release bracket 264 will then pivot about the pivot axis 278 to the released position shown in FIGS. 54 and 58, thereby unlocking the lock 260.

In FIGS. 65 to 69, there is shown an actuator 282 having a release mechanism 284 with a release bracket 286 and a release pivot 288 having a faceplate 290. The release pivot 266 has a pivot axis 292. The release bracket 286 has a pivot axis 294. The faceplate 290 has an oblong opening 296 therein to receive a flat head screwdriver or similar tool (not shown) and a second opening 298 to receive a nodule 300 on a slidable locking plate 302. The slidable locking plate 302 is mounted on a backing plate 304. The locking plate 302 and the backing plate 304 are spring mounted on a spring 306. The same reference numerals are used in FIGS. 65 to 69 as those used in FIGS. 3 to 14 for those components that are identical.

Figure 65:
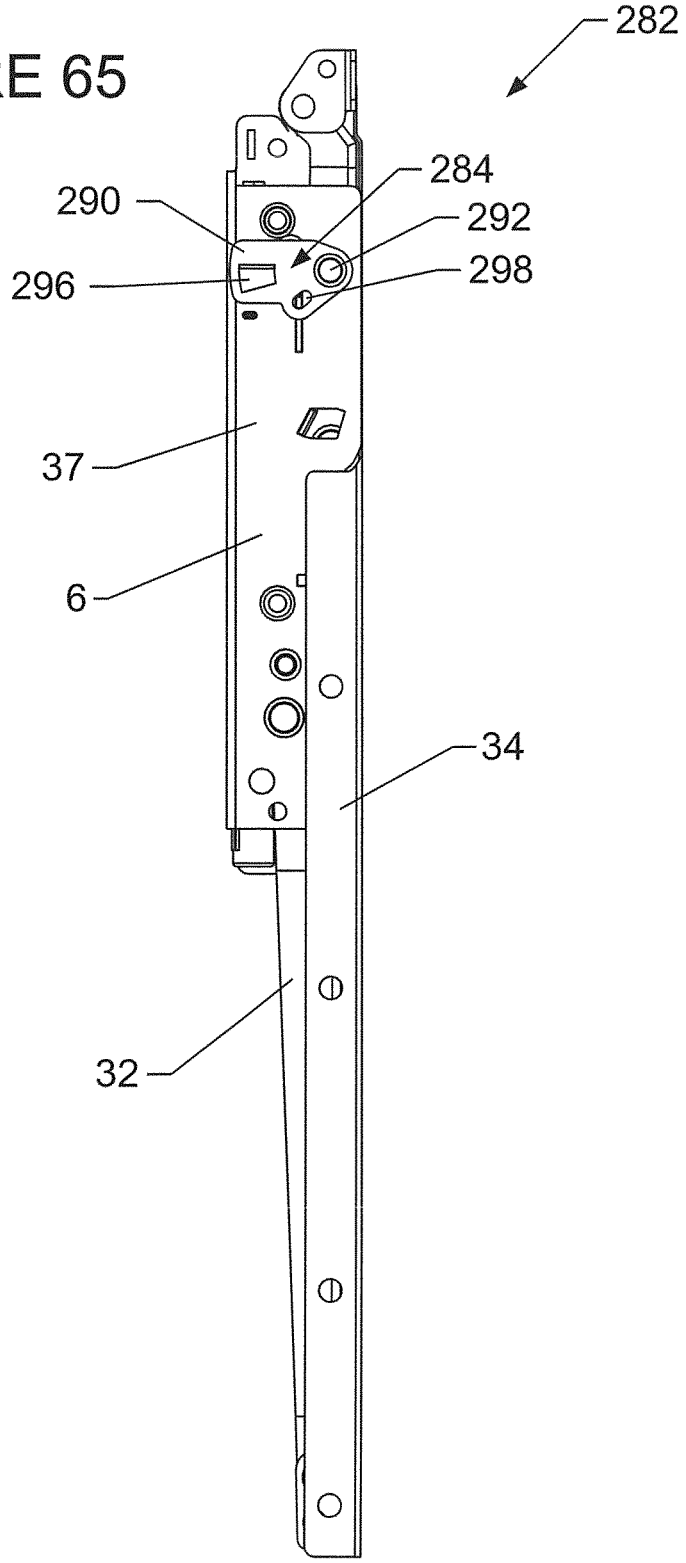
FIG. 65 is a top view of a further embodiment of an actuator in a closed position.
Figure 66:
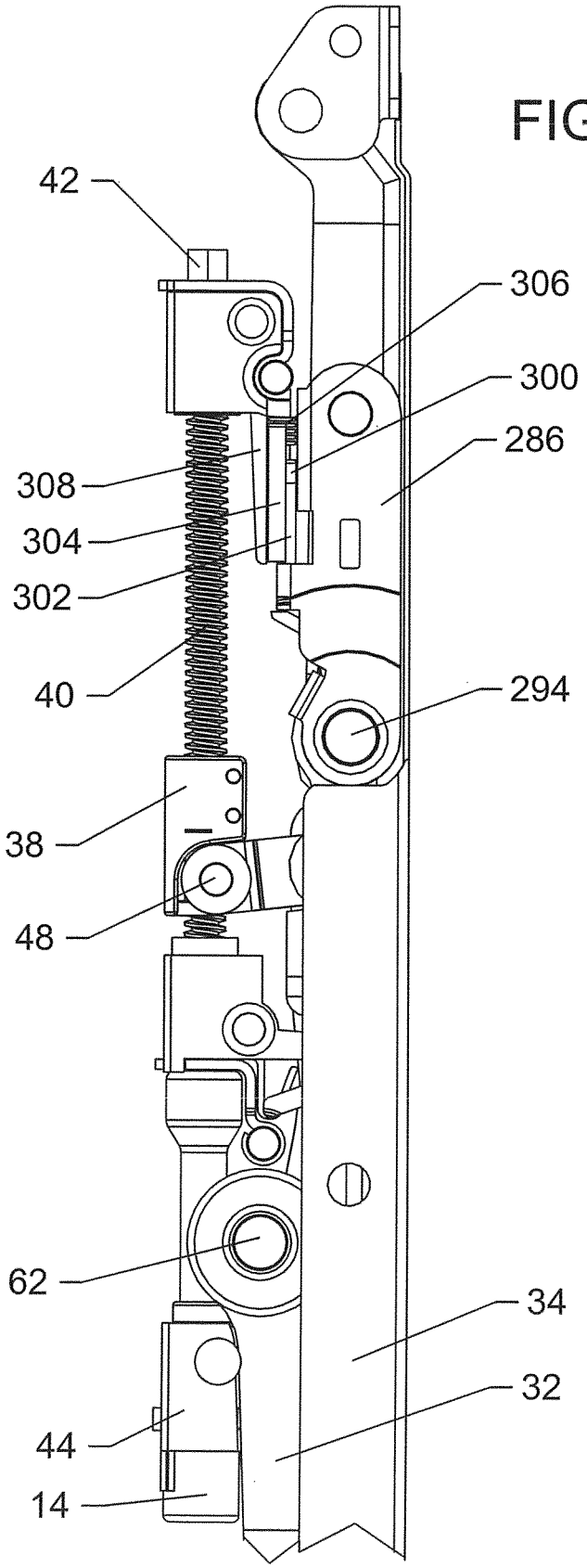
FIG. 66 is a partial top view of the actuator shown in FIG. 65 with the cover removed.
Figure 67:
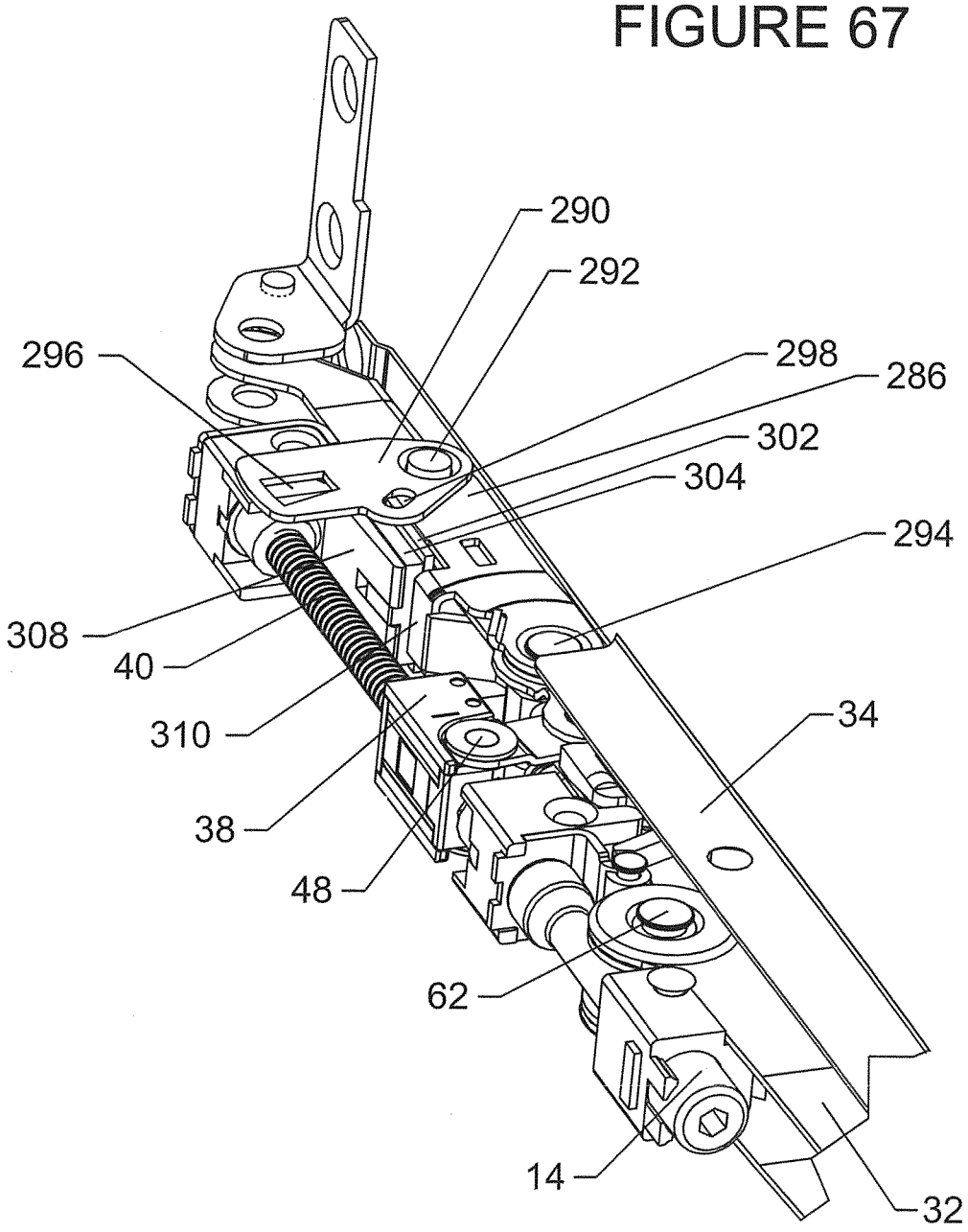
FIG. 67 is a partial perspective view of the actuator of FIG. 66.
Figure 68:
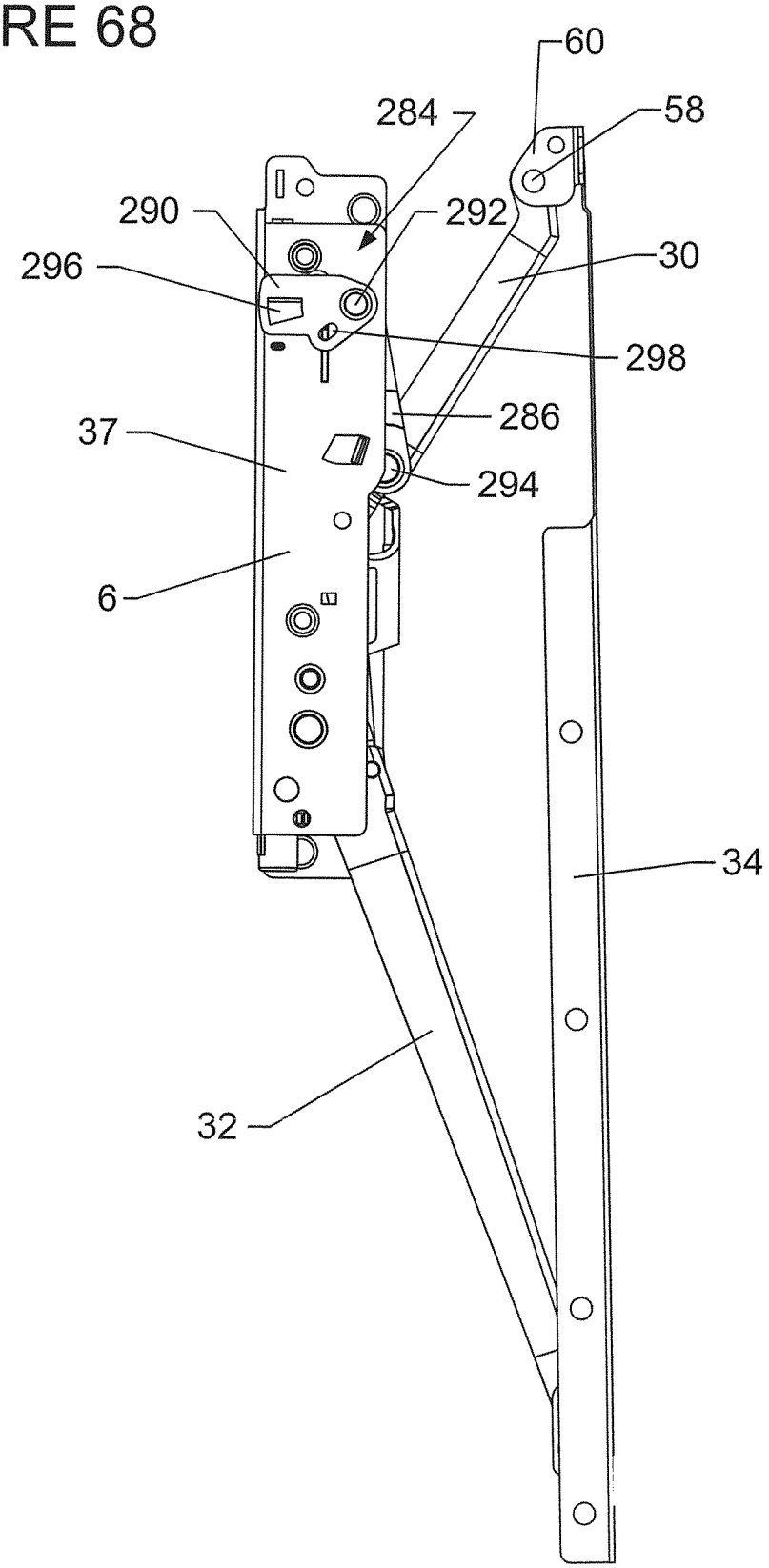
FIG. 68 is a top view of the actuator shown in FIG. 65 in a released position.
Figure 69:
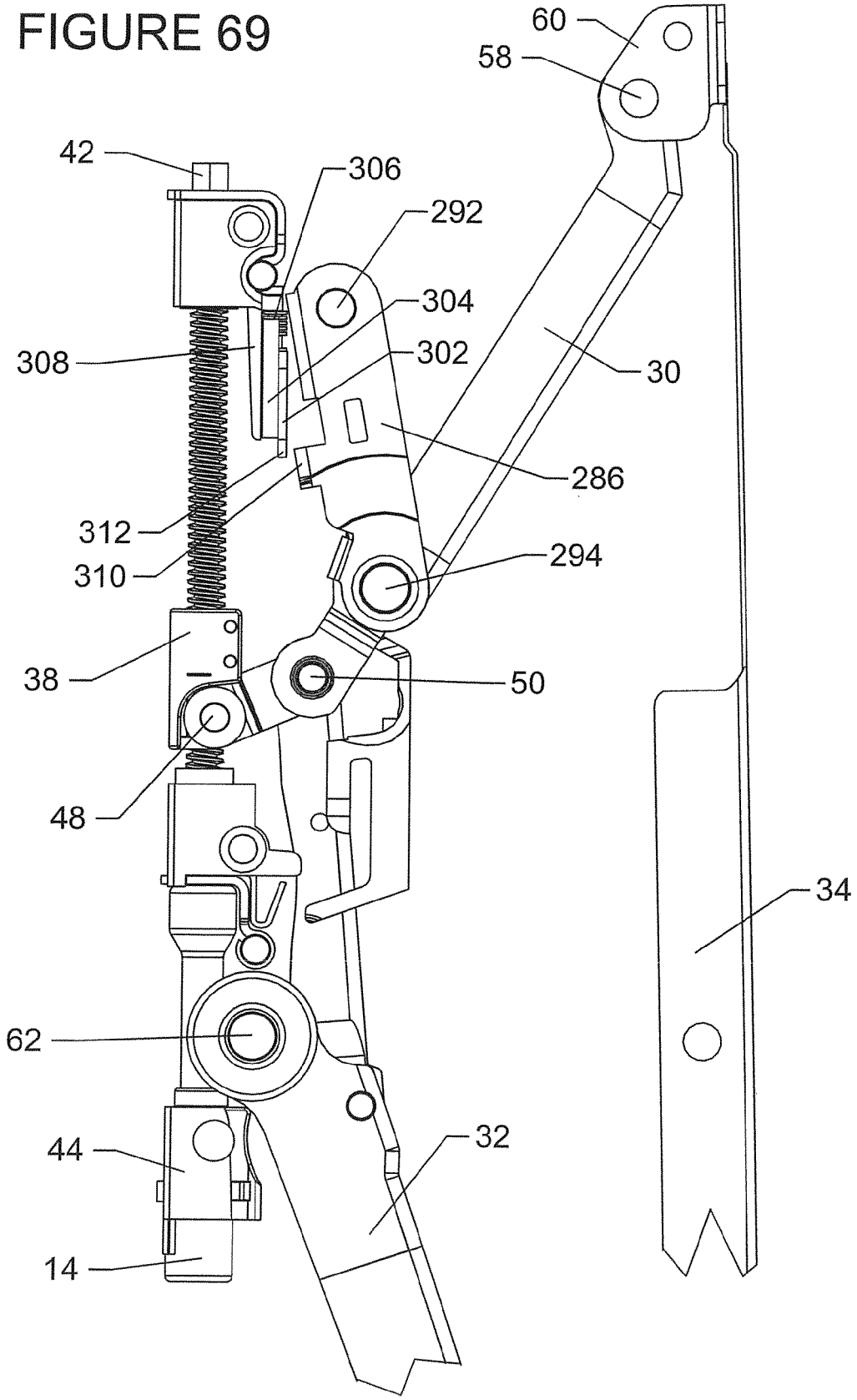
FIG. 69 is a partial top view of the actuator shown in FIG. 68 with a cover removed.

In FIGS. 65, 66 and 67, the actuator 282 is in a locked position. In FIGS. 68 and 69, the actuator 282 is in an unlocked position. In FIG. 66, the cover 37 has been removed to expose an interior and the faceplate 290 has also been removed. In FIG. 67, while the cover 37 has been removed, the faceplate 290 remains in place on the pivot axis 292. The backing plate 304 is slidably mounted in contact with a guide plate 308. In FIG. 67, it can be seen that the nodule 300 extends into the second opening 298 on the faceplate 290. In FIGS. 68 and 69, the release mechanism 284 has been released and the actuator 282 is in a partially open position and can be manually moved to a fully open position. The release bracket 286 has a bridge 310 thereon which is best seen in FIGS. 66, 67 and 69. In the unreleased position, the slidable locking plate 302 has one end that is located beneath the bridge 310. In the released position, the slidable locking plate 302 has been slid against the force of the spring 306 so that no part of the slidable locking plate 302 is beneath the loop 310.

Figure 70:
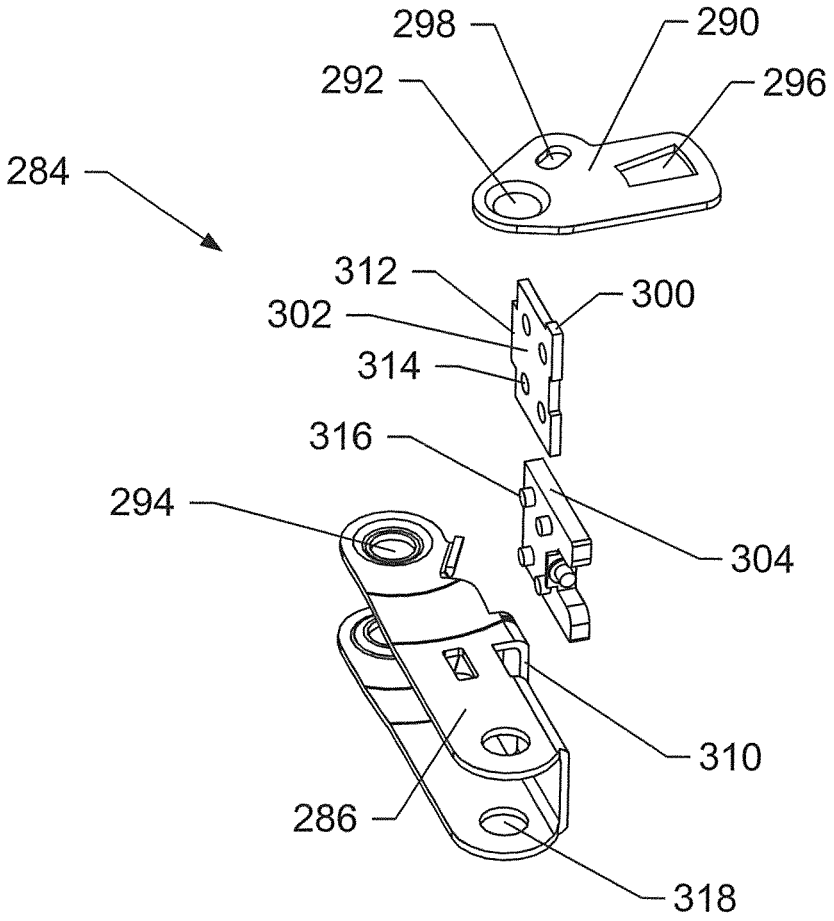
FIG. 70 is an exploded perspective view of an actuator release.

In FIGS. 70 to 73, there are shown various perspective views of the release mechanism 284. The same reference numerals are used in FIGS. 70 to 73 as those used in FIGS. 65 to 69 for those components that are identical. In FIG. 70, there is shown an exploded perspective view of the release mechanism 284. The locking plate 302 has a protrusion 312 thereon and four openings 314 therein. The four openings 314 correspond to four knobs 316 on the backing plate 304. The locking plate 302 is connected to the backing plate 304 with the knobs 316 extending through the openings 314. The pivot axis 292 in the faceplate 290 is coaxially aligned with the opening 318 of the release bracket 286.

Figure 72:
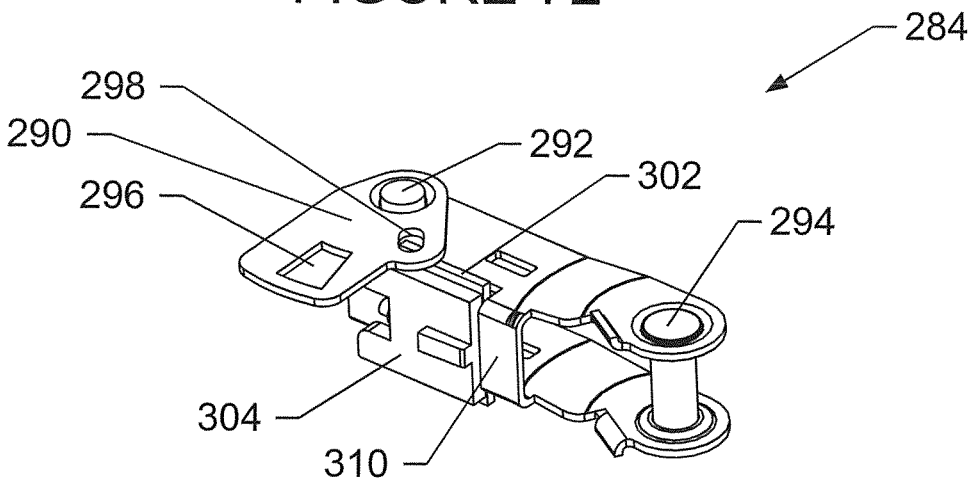
FIG. 72 is a perspective view of the actuator release of FIG. 71 when viewed from a top.
Figure 71:
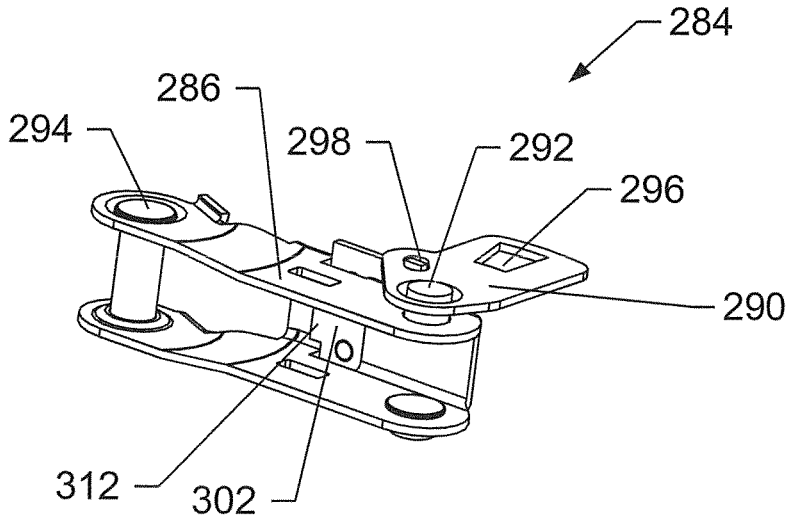
FIG. 71 is a perspective view of an assembled actuator release in an unreleased position when viewed from a bottom.
Figure 73:
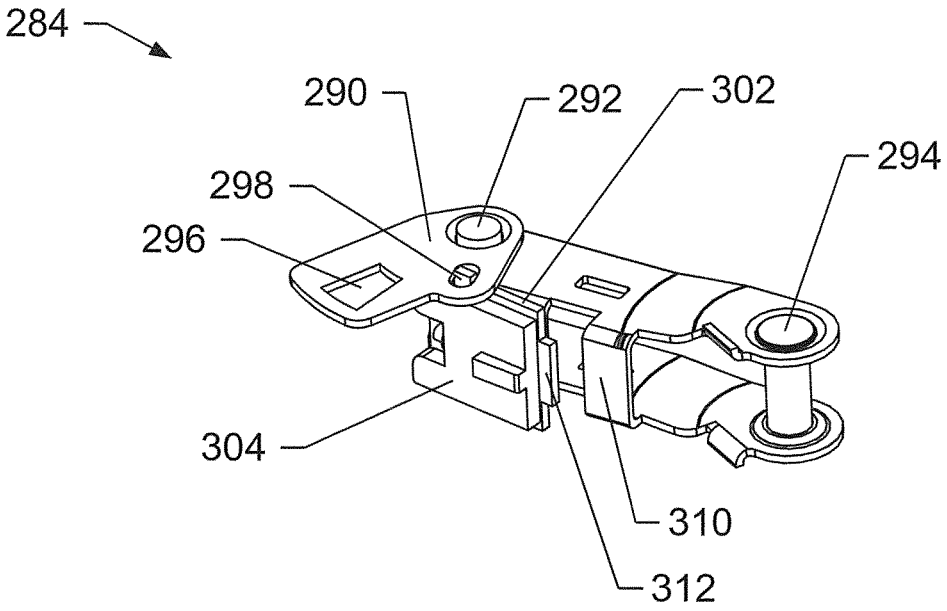
FIG. 73 is a perspective view of the actuator release in a released position.

In FIGS. 71 and 72, the release mechanism 284 is in an unreleased position with the projection 312 on the slidable locking plate 302 located beneath the bridge 310 of the release bracket 286. The nodule 300 extends into the second opening 298 of the faceplate 290. In FIG. 73, the locking plate 302 and backing plate 304 have been slid toward the spring 306 (not shown) in FIGS. 71 to 73 to slide the projection 312 out from under the bridge 310. Thus, the release mechanism is in the released position in FIG. 73. In the released position, the actuator 282 can be manually moved to the open position as shown in FIGS. 68 and 69.

In operation, commencing from the unreleased position, a flat head screwdriver or similar tool (not shown) is inserted into the oblong opening 296, shown in FIG. 65 and twisted clockwise, thereby rotating the faceplate 290 and thereby the release pivot 288 clockwise about the pivot axis 292, thereby sliding the locking plate 302 out from under the bridge 310 and moving the release mechanism 284 to the released position. The release mechanism 284 is designed to be used to unlock the actuator when the window operating system fails and the actuator is in the closed position. In the released position, the actuator can be moved from the closed position to the open position manually.

Various materials are suitable for the various components of the system, but stainless steel is preferred. The manner in which the sash moves initially outward substantially perpendicularly from the frame as it opens eliminates or at least reduces any sideways motion when the sash is in contact with the seals (not shown) within the frame. This substantially perpendicular motion during opening and closing (see FIGS. 11 to 14, 49, 50) extends the life of the seals and it ensures a tighter fit between the sash and the frame when the sash is in a closed position. The crank has a ball joint at the outer end of the shaft so that the crank can be folded into two folded positions when the crank is not in use.

Adjacent windows can be operated from the same window system whether the windows open and close in parallel or opposite to one another. The purpose of the clutch is to ensure that the window operating system does not break down when a user turns the crank whenever the rest of the system is unable to move. The indicator light illuminates to show the user that the window has reached the fully closed position. The crank assembly has a three to one ratio in gearing and makes the speed of the connecting rods faster and reduces the torque carried by the rods.

The locks, crank assembly and actuators are synchronized to operate in the correct orientation of the window throughout its motion. When one of the components is replaced on a window, the window can be placed in a particular position in which the new component can be preset so that it is in the correct position from the time of installation. The actuators can operate as a left hand opening or a right hand opening or as a top located actuator or a bottom located actuator simply by changing the thread direction of the universal screw. Similarly, the window locks can operate in opposite directions as well by changing the thread direction of the universal screw. The minimum size of window, with which the device can be used, is currently nineteen inches square. A window is closed by turning the crank in one direction and opened by turning the crank in an opposite direction. A window is said to be "fully closed" or in the fully "closed position" when the sash is most tightly held against the frame (usually in the locked position). A window is said to be "fully open" or in the fully "open position" when the sash is in the maximum open position relative to the frame.

With the window operating system of the present invention, the torque from the crank is transferred around the window by way of interconnecting rods or directly interconnected modules and acts through each actuating hinge module causing the window to open or close. Since the force to open a window having two actuators acts both at the top and bottom of the sash, the twisting force on the sash common to a single operator, particularly with large windows, is avoided. The manner in which the sash initially moves substantially perpendicularly away from the frame allows compression type seals to be used between the frame and the sash. Compression type seals are more air tight than other types of seals.

When windows are shipped containing operating systems in accordance with the present invention, the crank and the crank shaft can be shipped separately to avoid the danger of damage during shipping. The modules of the present invention are designed to fit within a distance perpendicular to that portion of the frame in which they are installed of less than seven eighths of an inch. This allows for a low profile stationary window frame and an enlarged proportion of glass to frame than previous windows. With the window operating system of the present invention, all mounting holes in all of the modules are aligned so that if the modules are mounted on extruded windows, a supported area can be designed into the extrusion to receive screws which hold the hardware securely. When two or more windows are joined together to be operated by a single crank on one of the windows, the surface area of all of the sashes operated by the single crank must not exceed the surface area limit for a single sash. An optional electric motor driven module to replace the crank module can be utilized and will allow for remote operation of a casement window or of an awning window.

As a variation of the folding window crank, a child resistant version can be utilized in which the button must be activated both to fold the crank downward and to return the crank to the operating position. With the present version described herein, the button must be depressed to fold the crank downward. However, the crank can be returned to the operating position simply by moving it to that position and the crank will snap into place. When the sash is fully closed within the frame, the arms of the actuator are buckled back such that a manual pull out on the arms by, for example, an intruder trying to force the window open from the outside, will tend to bind the linkage rather than open it. The lock module also buckles back in a similar manner so that when the window is locked, if it is attempted to be forcibly opened from the outside, the lock module will tend to bind rather than open.

The invention claimed is:

1. A window operating system for use with a casement or awning window, said window having a frame and a sash, said sash being movable between a closed position and an open position, said system comprising at least one actuator located on one side of said frame and operable to open and close said sash, the at least one actuator having a universal screw, said actuator functioning as a hinge as well as an actuator, a hinged support on said frame on a side directly opposite to said actuator, a crank assembly mounted on said frame, said crank assembly having a crank extending therefrom on an inner side of said frame, said crank assembly being located on said frame at a different location from said actuator, said crank being rotatable in one direction to operate said actuator to open the sash and in an opposite direction to operate said actuator to close said sash, there being at least one lock mounted on said frame with a keeper for each lock being mounted on said sash, said at least one lock being connected into said system to be operated by said crank to lock said sash within said frame in a fully closed position and to open said at least one lock to allow said sash to move from said fully closed position to a fully open position, wherein said at least one lock has a universal screw that is connected to rotate as said crank rotates, said actuator and said at least one lock being synchronized to operate in sequence, wherein said actuator, at least one lock, and crank assembly are individual modules connected to be operated by said crank, said crank being a single crank, wherein said at least one lock has a disk that is pivotally mounted on said at least one lock with a pivot arm being pivotally mounted on said disk, said pivot arm being pivotally connected to a clasp that is pivotally mounted on said at least one lock to release and receive said keeper as said crank is rotated, said disk being connected to pivot as said universal screw of said at least one lock rotates, thereby causing said pivot arm to pivot relative to said clasp and causing said clasp to pivot to release or receive said keeper of said at least one lock respectively, and wherein the pivot arm pivots relative to the disk and the clasp pivots relative to the at least one lock.

2. A system as claimed in claim 1 wherein said actuator is a first actuator and said hinged support is a second actuator, said second actuator being connected into said system to be operated in synchronization with said first actuator by rotation of said crank, said first and second actuators supporting said sash and moving said sash between a closed position and a fully open position, said second actuator functioning as a hinged support as well as an actuator.

3. A system as claimed in claim 2 wherein said actuators each contain a universal screw, said universal screws rotating with said crank in a direction to cause said actuators to open said sash when said crank is turned in one direction and to close said sash when said crank is closed in an opposite direction.

4. A system as claimed in claim 2 wherein said actuators are constructed to move said inner edge of said sash toward a middle of said frame as said sash is opened between said first open position and said fully open position, said sash being substantially perpendicular to said frame in said fully open position.

5. A system as claimed in claim 4 wherein said operating system at least almost completely surrounds said frame and has a corner transfer at each corner through which said system extends to transmit rotational movement from said crank through each corner of said frame.

6. A system as claimed in claim 5 wherein said system is mounted substantially within said frame and completely surrounds said frame.

7. A system as claimed in claim 4 wherein said at least one actuator and said at least one lock are synchronized to operated in response to said crank, on opening said window said at least one actuator beginning to open before said lock is fully open and on closing said window said at least one lock beginning to close before said at least one actuator is fully closed.

8. A system as claimed in claim 2 wherein said sash is constructed to moved said sash substantially perpendicularly outward from said frame from a closed position to a first open position, said sash being movable from a first open position to a fully open position whereby one edge of said sash rotates about an inner edge of said sash, said inner edge of said sash moving toward a middle of said frame as said sash is open between said first position and said fully open position, they lock for said window being constructed and connected to be operated by a said crank in synchronization with said actuators.

9. A system as claimed in claim 8 wherein said at least one lock is a plurality of locks mounted in said frame and constructed and connected to be operated by rotation of said crank.

10. A system as claimed in claim 9 wherein said crank assembly has an indicator light thereon, said light being connected to activate when said window is fully closed and locked.

11. A system as claimed in claim 10 wherein said crank assembly has a clutch therein, said crank has an indicator light thereon, said indicator light being connected to activate when said window is in a fully closed and locked position.

12. A system as claimed in claim 11 wherein said crank is mounted in said crank assembly on a spherical end of a shaft to enable said crank to be pivoted toward the frame when said crank is not in use.

13. A system as claimed in claim 12 wherein said crank has a button thereon that is connected to release said crank from an operating position to allow said crank to be moved to a folded position.

14. A system as claimed in claim 1 wherein said modules are connected by connecting rods that are shaped to rotate said universal screws with said crank.

15. A system as claimed in claim 14 wherein there are corner transfers to transmit rotational energy from said crank around each corner of said frame where said corner transfers are located, said corner transfers being individual modules that are connected to be operated by said crank.

* * * * *